US011276339B2

(12) United States Patent
Kim et al.

(10) Patent No.: US 11,276,339 B2
(45) Date of Patent: Mar. 15, 2022

(54) DISPLAY DEVICE AND METHOD OF INSPECTING THE SAME

(71) Applicant: Samsung Display Co., Ltd., Yongin-si (KR)

(72) Inventors: Mi Hae Kim, Asan-si (KR); Kyung Hoon Kim, Uiwang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 68 days.

(21) Appl. No.: 16/741,443

(22) Filed: Jan. 13, 2020

(65) Prior Publication Data

US 2020/0327834 A1 Oct. 15, 2020

(30) Foreign Application Priority Data

Apr. 11, 2019 (KR) ..... 10-2019-0042355

(51) Int. Cl.
*G09G 3/00* (2006.01)
*G09G 3/20* (2006.01)

(52) U.S. Cl.
CPC ..... *G09G 3/006* (2013.01); *G09G 3/2074* (2013.01); *G09G 2300/0408* (2013.01); *G09G 2300/0426* (2013.01); *G09G 2310/0297* (2013.01)

(58) Field of Classification Search
CPC ..... G09G 3/006; G09G 3/2074; G09G 2300/0408; G09G 2300/0426; G09G 2310/0297; G09G 3/3291; G09G 3/3233; G09G 2300/0819; G09G 2300/0842; G09G 2300/0861; G09G 2320/0214; G09G 2330/12; G09F 9/33; H01L 27/3244; H01L 27/3276
See application file for complete search history.

(56) References Cited

U.S. PATENT DOCUMENTS

2008/0203391 A1* 8/2008 Kim ..... G09G 3/3611 257/59
2008/0284697 A1* 11/2008 Nam ..... G02F 1/136209 345/87
2011/0279746 A1* 11/2011 Kim ..... G09G 3/3648 349/54

(Continued)

FOREIGN PATENT DOCUMENTS

KR 10-2013-0139614 A 12/2013
KR 10-2015-0039491 A 4/2015
KR 10-2018-0065061 A 6/2018

*Primary Examiner* — Jose R Soto Lopez
(74) *Attorney, Agent, or Firm* — Lewis Roca Rothgerber Christie LLP

(57) ABSTRACT

A display device includes sub-pixels in a display area and arranged along first to eighth columns; first to fourth wiring pads in a non-display area and arranged at one side of the display area; crack detection lines in the non-display area; first to fourth fan-out lines connecting the sub-pixels arranged along the first to eighth columns to the first to fourth wiring pads; and an inspection unit between the first to fourth wiring pads and the display area, the inspection unit being electrically connected to the crack detection lines and the first to fourth fan-out lines, the inspection unit to apply a test voltage to the first to fourth fan-out lines to inspect whether the first to fourth fan-out lines are shorted or open, and to apply the test voltage to the crack detection lines to inspect damage to the crack detection lines.

18 Claims, 33 Drawing Sheets

(56) References Cited

U.S. PATENT DOCUMENTS

2012/0162165 A1* 6/2012 Lee ..... G09G 3/006 345/206
2013/0335397 A1* 12/2013 Kim ..... G09G 3/3233 345/212
2014/0176844 A1* 6/2014 Yanagisawa ..... G09G 3/006 349/43
2014/0354285 A1* 12/2014 Kim ..... G09G 3/3233 324/414
2014/0354286 A1* 12/2014 Kim ..... G09G 3/3225 324/414
2015/0090961 A1* 4/2015 Lee ..... G09G 3/006 257/40
2015/0241501 A1* 8/2015 Jang ..... G09G 3/006 324/527
2015/0347793 A1* 12/2015 Hsiao ..... G06K 19/0722 340/10.5
2016/0043010 A1* 2/2016 Kwak ..... H01L 51/0024 257/48
2016/0078792 A1* 3/2016 Chang ..... G01R 31/28 324/555
2016/0225312 A1* 8/2016 Byun ..... G09G 3/006
2016/0260367 A1* 9/2016 Kwak ..... G09G 3/006
2016/0267826 A1* 9/2016 Seo ..... G09G 3/006
2016/0293078 A1* 10/2016 Byun ..... G09G 3/006
2016/0322451 A1* 11/2016 Park ..... G09G 3/006
2016/0351093 A1* 12/2016 Kim ..... G09G 3/2092
2016/0372017 A1* 12/2016 Byun ..... G09G 3/20
2017/0213490 A1* 7/2017 Jeong ..... G09G 3/006
2017/0263880 A1* 9/2017 Lee ..... H01L 27/3244
2018/0033354 A1* 2/2018 Lee ..... G09G 3/006
2018/0033355 A1* 2/2018 Lee ..... H01L 27/3223
2018/0069030 A1* 3/2018 Zhang ..... H01L 27/14636
2018/0076102 A1* 3/2018 Ka ..... H01L 27/3262
2018/0330653 A1* 11/2018 Zhou ..... G02F 1/13452
2019/0294290 A1* 9/2019 Pu ..... G06F 11/2221
2020/0185428 A1* 6/2020 Um ..... G02F 1/133345
2020/0343270 A1* 10/2020 Huang ..... G09G 3/006

* cited by examiner

DISPLAY DEVICE AND METHOD OF INSPECTING THE SAME

CROSS-REFERENCE TO RELATED APPLICATION

This application claims priority to and the benefit of Korean Patent Application No. 10-2019-0042355, filed on Apr. 11, 2019, in the Korean Intellectual Property Office (KIPO), the entire disclosure of which is incorporated herein by reference.

BACKGROUND

1. Field

The present invention relates to a display device and a method of inspecting the same.

2. Description of the Related Art

With the development of information society, requirements for display devices for displaying images have increased in various forms. For example, display devices are applied to various suitable electronic appliances such as smart phones, digital cameras, notebook computers, navigators, and smart televisions. A display device may be a flat panel display device such as a liquid crystal display device, a field emission display device, or a light emitting display device. In a light emitting display device from among flat panel displays, each of the pixels of a display panel includes a light emitting element capable of emitting light, and thus the light emitting display device may display an image without a backlight unit for providing light to the display panel.

The light emitting display device may include a plurality of pixels, and each of the plurality of pixels may include a light emitting element, a driving transistor for adjusting the amount of a driving current supplied to the light emitting element according to the voltage of a gate electrode, and a scan transistor for supplying the data voltage of a data line to the gate electrode of the driving transistor in response to the scan signal of a scan line.

For such a display device, it is desirable to perform a lighting inspection, a crack inspection, and/or a spider wiring inspection for transmitting the output of a driving IC.

SUMMARY

Aspects of the present invention are directed to a display device capable of performing a lighting inspection, a crack inspection, and a spider wiring inspection, and a method of inspecting the display device.

However, aspects of the present invention are not restricted to the one set forth herein. The above and other aspects of the present invention will become more apparent to one of ordinary skill in the art to which the present invention pertains by referencing the detailed description of the present invention given below.

An embodiment of a display device includes sub-pixels in a display area and arranged along first to eighth columns; first to fourth wiring pads in a non-display area at a periphery of the display area and arranged at one side of the display area; crack detection lines in the non-display area; first to fourth fan-out lines connecting the sub-pixels arranged along the first to eighth columns to the first to fourth wiring pads; and an inspection unit between the first to fourth wiring pads and the display area, the inspection unit being electrically connected to the crack detection lines and the first to fourth fan-out lines, wherein the inspection unit is configured to apply a test voltage to the first to fourth fan-out lines to inspect whether the first to fourth fan-out lines are shorted or open, and is configured to apply the test voltage to the crack detection lines to inspect damage to the crack detection lines.

In an embodiment of a display device, the first fan-out line and the third fan-out line are at a same layer, the second fan-out line and the fourth fan-out line are at a same layer, and the first fan-out line and the second fan-out line are at different layers.

In an embodiment of a display device, the inspection unit includes first to fourth switches, a first control line configured to supply a first inspection control signal to a gate of each of the first switch and the second switch, a second control line configured to supply a second inspection control signal to a gate of each of the third switch and the fourth switch, and a data voltage line configured to supply the test voltage to a first terminal of each of the first to fourth switches.

In an embodiment of a display device, a second terminal of the first switch is connected to the first fan-out line, a second terminal of the second switch is connected to the second fan-out line, a second terminal of the third switch is connected to the third fan-out line, and a second terminal of the fourth switch is connected to the fourth fan-out line.

An embodiment of a display device includes a first data line connected to the sub-pixels arranged along the first column, a second data line connected to the sub-pixels arranged along the second column, a third data line connected to the sub-pixels arranged along the third column, a fourth data line connected to the sub-pixels arranged along the fourth column, a fifth data line connected to the sub-pixels arranged along the fifth column, a sixth data line connected to the sub-pixels arranged along the sixth column, a seventh data line connected to the sub-pixels arranged along the seventh column, and an eighth data line connected to the sub-pixels arranged along the eighth column; and a demultiplexer unit in the non-display area and located between the display area and the inspection unit, the first data line and the second data line are connected to the first fan-out line through the demultiplexer unit, the third data line and the fourth data line are connected to the second fan-out line through the demultiplexer unit, the fifth data line and the sixth data line are connected to the third fan-out line through the demultiplexer unit, and the seventh data line and the eighth data line are connected to the fourth fan-out line through the demultiplexer unit.

In an embodiment of a display device, the demultiplexer unit includes fifth to twelfth switches, a third control line configured to supply a first demultiplexer control signal to a gate of each of the fifth, seventh, ninth and eleventh switches, and a fourth control line configured to supply a second demultiplexer control signal to a gate of each of the sixth, eighth, tenth and twelfth switches.

In an embodiment of a display device, first terminals of the fifth switch and the sixth switch are connected to the first fan-out line, first terminals of the seventh switch and the eighth switch are connected to the second fan-out line, first terminals of the ninth switch and the tenth switch are connected to the third fan-out line, and first terminals of the eleventh switch and the twelfth switch are connected to the fourth fan-out line.

In an embodiment of a display device, a second terminal of the fifth switch is connected to the first data line, a second terminal of the sixth switch is connected to the second data line, a second terminal of the seventh switch is connected to the third data line, a second terminal of the eighth switch is connected to the fourth data line, a second terminal of the ninth switch is connected to the fifth data line, a second terminal of the tenth switch is connected to the sixth data line, a second terminal of the eleventh switch is connected to the seventh data line, and a second terminal of the twelfth switch is connected to the eighth data line.

An embodiment of a display device includes a lighting circuit unit between the display area and the demultiplexer unit.

In an embodiment of a display device, the lighting circuit unit further includes a lighting inspection signal line configured to supply a white data voltage to the second data line, the fourth data line, the sixth data line, and the eighth data line.

In an embodiment of a display device, the test voltage is a black data voltage.

In an embodiment of a display device, the sub-pixels includes: red sub-pixels and blue sub-pixels alternately arranged in the first, third, fifth, and seventh columns; and green sub-pixels arranged in the second column between the first column and the third column, the fourth column between the third column and the fifth column, the sixth column between the fifth column and the seventh column, and the eighth column outside the seventh column, the red sub-pixels and the blue sub-pixels are alternately arranged in the third column and the seventh column in a reverse order to the first column and the fifth column.

In an embodiment of a display device, the first to fourth switches are transistors, the gate is a gate electrode, the first terminal is a drain electrode, and the second terminal is a source electrode.

An embodiment of a display device includes sub-pixels in a display area; a display driving circuit in a non-display area at a periphery of the display area and located below the display area in a plan view; crack detection lines in the non-display area; fan-out lines connecting the sub-pixels and the display driving circuit; and an inspection unit between the display area and the display driving circuit, located adjacent to the display driving circuit, and electrically connected to the crack detection lines and the fan-out lines, wherein the inspection unit is configured to apply a test voltage to the fan-out lines to inspect whether the fan-out lines are shored or open, and is configured to apply the test voltage to the crack detection lines to inspect damage to the crack detection lines.

An embodiment of a display device includes wiring pads electrically connected to the fan-out lines, the display driving circuit includes a driving integrated circuit electrically connected to the wiring pads.

An embodiment of a display device includes a display pad located outside the display driving circuit; and a circuit board attached to the display pad.

An embodiment of a display device includes a lighting circuit unit between the display area and the inspection unit and located adjacent to the display area.

An embodiment of a display device includes first to fourth data lines connected to the sub-pixels, the fan-out lines include first to fourth fan-out lines, the first data line is connected to the first fan-out line, the second data line is connected to the second fan-out line, the third data line is connected to the third fan-out line, and the fourth data line is connected to the fourth fan-out line.

In an embodiment of a display device, the sub-pixels are arranged in a stripe form in which the sub-pixels are arranged along a plurality of columns and the sub-pixels of the same color are arranged in the same column.

An embodiment of the present invention includes a method of inspecting a display device. The display device includes sub-pixels in a display area, a display driving circuit in a non-display area at a periphery of the display area and located below the display area, crack detection lines in the non-display area, fan-out lines connecting the sub-pixels and the display driving circuit, and an inspection unit between the display area and the display driving circuit, located adjacent to the display driving circuit, and electrically connected to the crack detection lines and the fan-out lines. The method includes: applying a test voltage to the fan-out lines utilizing the inspection unit to inspect whether the fan-out lines are shorted or open; and applying the test voltage to the crack detection lines utilizing the inspection unit to inspect damage to the crack detection lines.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

Figure 1:
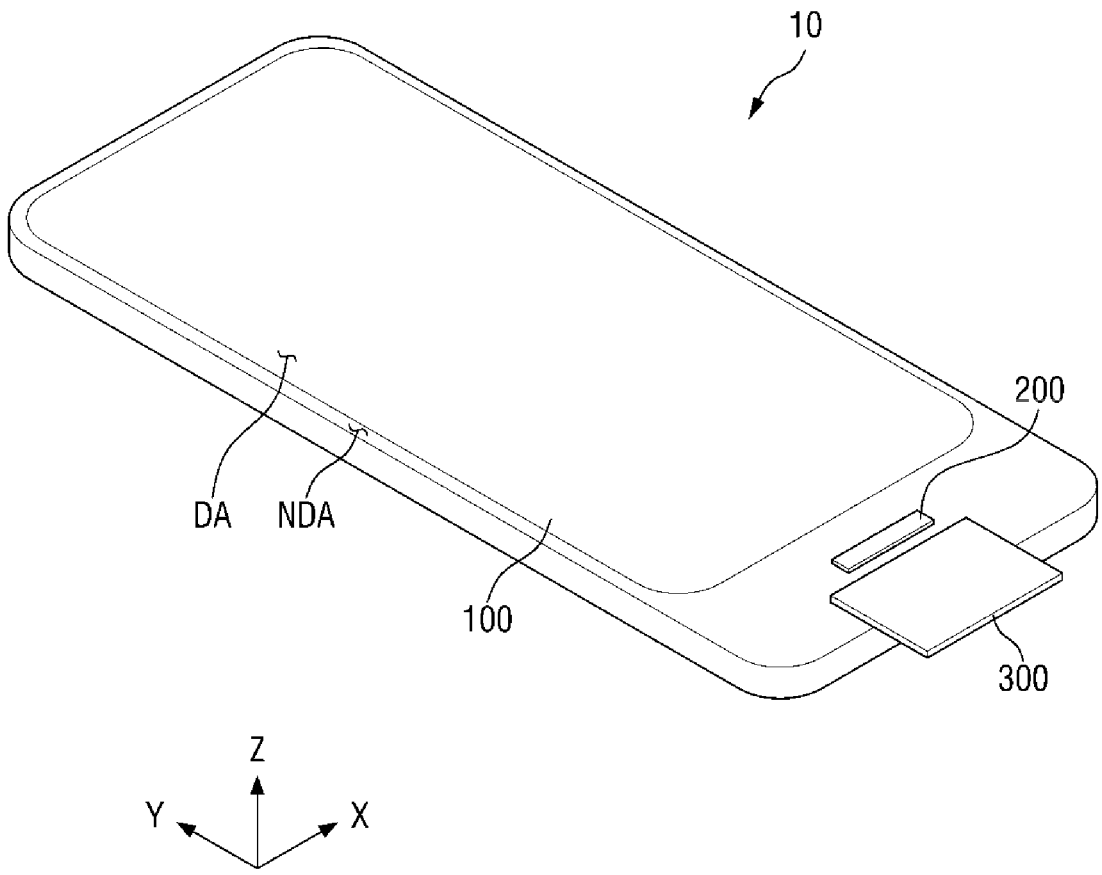
FIG. 1 is a perspective view of a display device according to an embodiment.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Rather, these embodiments are provided so that this disclosure will be thorough and complete and will fully convey the concept of the inventive concept to those skilled in the art, and the inventive concept will only be defined by the appended claims. Like reference numerals refer to like elements throughout the specification.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

As used herein, the terms "use," "using," and "used" may be considered synonymous with the terms "utilize," "utilizing," and "utilized," respectively.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, embodiments of the present invention will be described with reference to the attached drawings.

Figure 2:
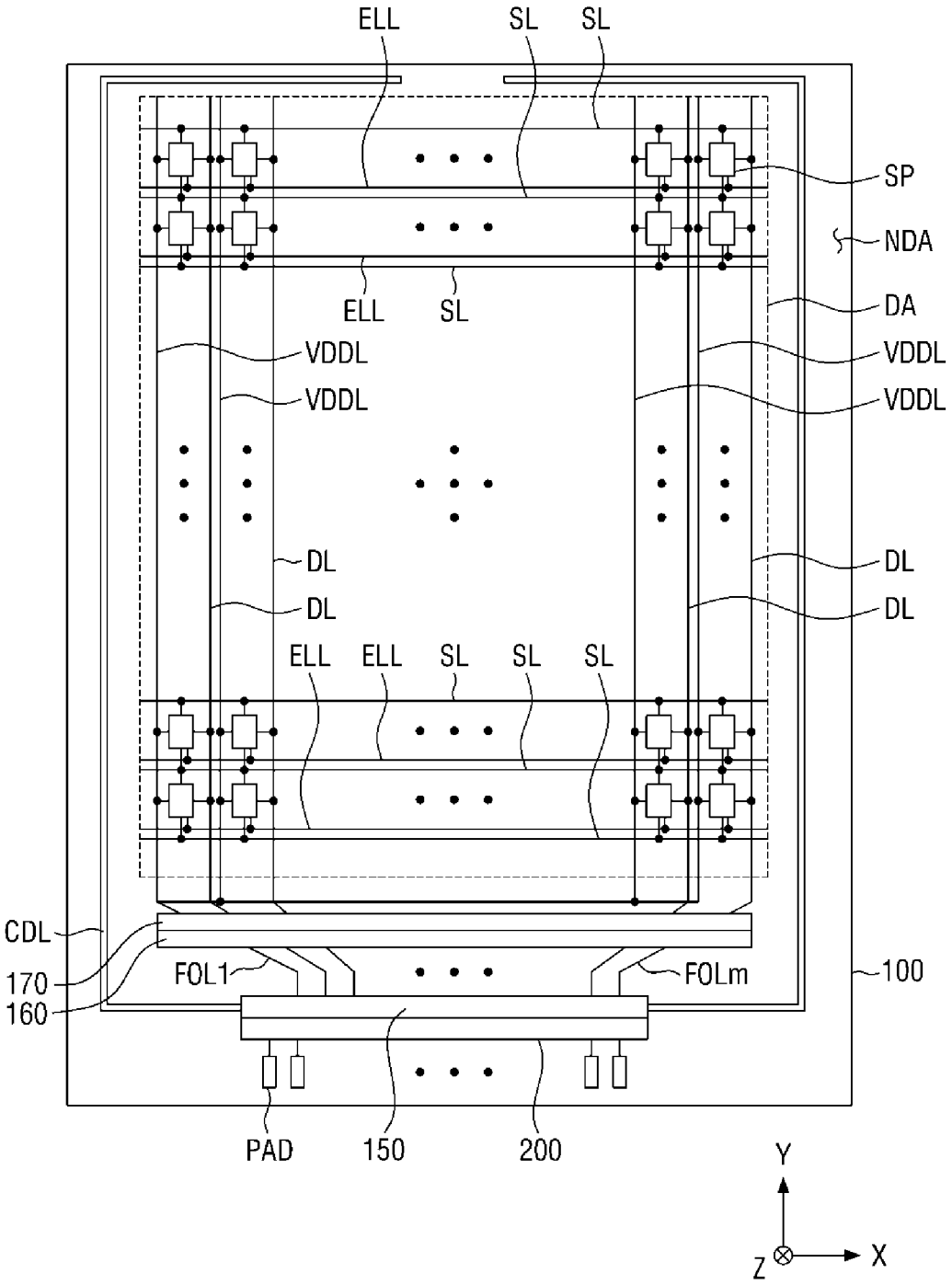
FIG. 2 is a plan view of a display device according to an embodiment.
Figure 3:
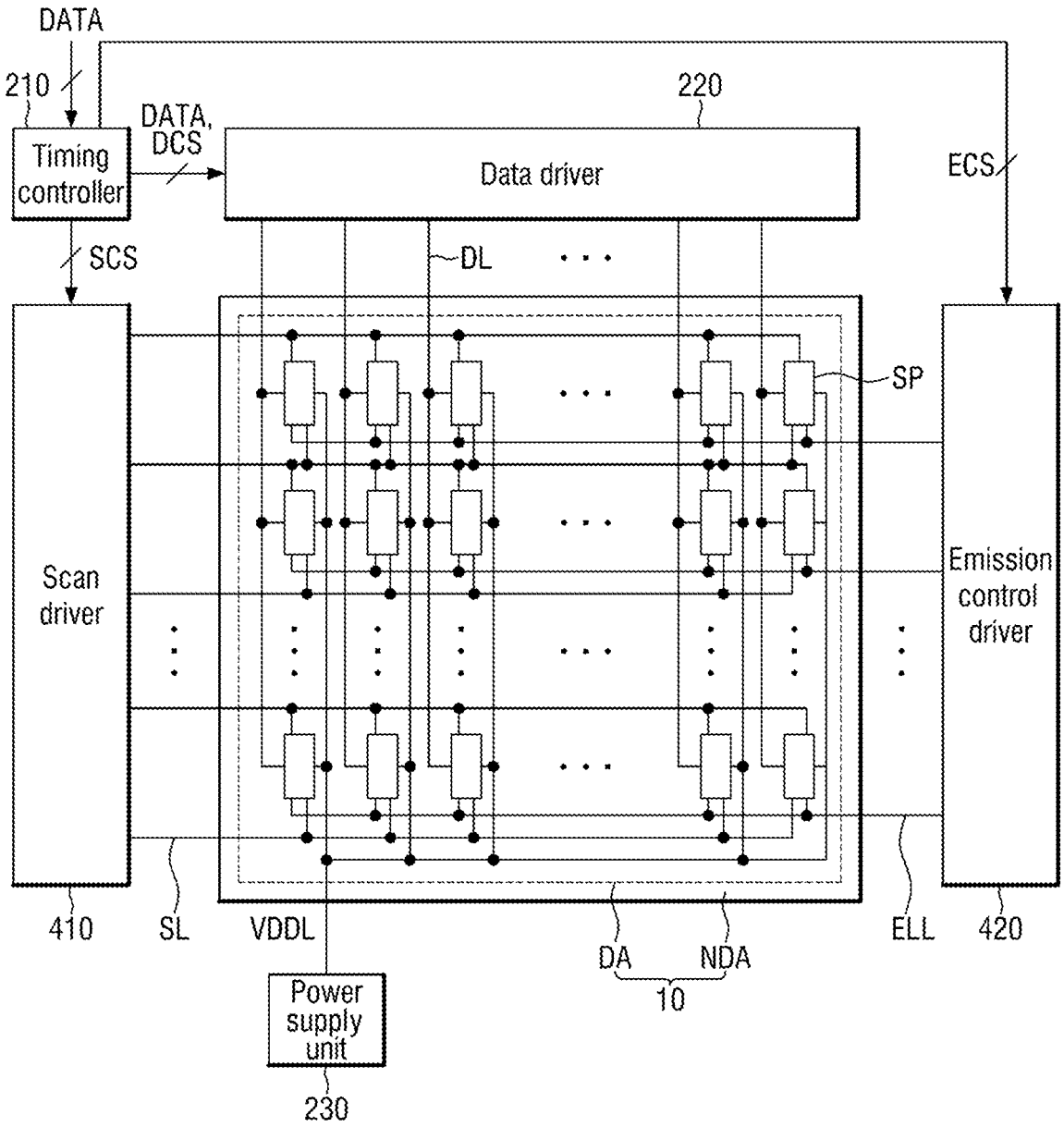
FIG. 3 is a block diagram of a display device according to an embodiment.

FIG. 1 is a perspective view of a display device according to an embodiment, FIG. 2 is a plan view of a display device according to an embodiment, and FIG. 3 is a block diagram of a display device according to an embodiment.

In this specification, the "on", "over", "top", "upper side", or "upper surface" refers to an upward direction, that is, a Z-axis direction, with respect to a display panel 100, and the "beneath", "under", "bottom", "lower side", or "lower surface" refers to a downward direction, that is, a direction opposite to the Z-axis direction, with respect to the display device 10. Further, the "left", "right", "upper", and "lower" refer to directions when the display panel 100 is viewed from the plane. For example, the "left" refers to a direction opposite to the X-axis direction, the "right" refers to the X-axis direction, the "upper" refers to the Y-axis direction, and the "lower" refers to a direction opposite to the Y-axis direction.

Referring to FIGS. 1-3, a display device 10, which is a device for displaying a moving image or a still image, may be used as a display screen of various products such as televisions, notebooks, monitors, billboards, internet of things (IOTs) as well as portable electronic appliances such as mobile phones, smart phones, tablet personal computers (tablet PCs), smart watches, watch phones, mobile communication terminals, electronic notebooks, electronic books, portable multimedia players (PMPs), navigators, and ultra-mobile PCs (UMPCs).

The display device 10 may be a light emitting display device such as an organic light emitting display device using an organic light emitting diode, a quantum dot light emitting display device including a quantum dot light emitting layer, an inorganic light emitting display device including an inorganic semiconductor, a micro light emitting display device using a micro light emitting diode (LED), or a nano light emitting display device using a nano size light emitting diode. Hereinafter, the display device 10 may be primarily described as an organic light emitting display device, but the present invention is not limited thereto.

The display device 10 includes a display panel 100, a display driving circuit 200, and a circuit board 300.

The display panel 100 may have a rectangular planar shape having short sides in the first direction (X-axis direction) and long sides in the second direction (Y-axis direction). The corner where the short side in the first direction (X-axis direction) meets the long side in the second direction (Y-axis direction) may be formed to have a round shape of a predetermined (or set) curvature or have a right angle shape. The planar shape of the display panel 100 is not limited to a rectangular shape, and may be formed in another polygonal shape, circular shape, or elliptical shape. The display panel 100 may be formed to be flat. However, the present invention is not limited thereto, and the display panel 100 may include a curved portion formed at the left and right ends thereof and having a constant curvature or a variable curvature. In addition, the display panel 100 may be flexible which allows it to be bent, warped, folded, or rolled.

The display panel 100 may include a display area DA in which sub-pixels SP are formed to display an image, and a non-display area NDA which is a peripheral area of the display area DA. The display area DA may be provided with scan lines SL, light emitting lines ELL, data lines DL, and first driving voltage line VDDL, which are connected to the sub-pixels SP, in addition to the sub-pixels SP. The scan lines SL and the light emitting lines ELL may be arranged in parallel in the first direction (X-axis direction), and the data lines DL may be arranged in parallel in the second direction (Y-axis direction). The first driving voltage lines VDDL may be arranged in parallel in the second direction (Y-axis direction) in the display area DA. The first driving voltage lines VDDL arranged in parallel in the second direction (Y-axis direction) in the display area DA and may be connected to each other in the non-display area NDA.

Each of the sub-pixels SP may be connected to at least one of the scan lines SL, at least one of the data lines DL, at least one of the light emitting lines ELL, and the first driving voltage line VDDL. Although it is shown in FIG. 2 that each of the sub-pixels SP is connected to two scan lines SL, one data line DL, one light emitting line ELL, and the first driving voltage line VDDL, the present invention is not limited thereto. For example, in some embodiments, each of the sub-pixels SP may be connected to three scan lines SL.

Each of the sub-pixels SP may include a driving transistor, at least one transistor (e.g., one or more of ST1 through ST6), a light emitting element, and a capacitor. The transistor is turned on when a scan signal is applied from the scan line SL, and thus a data voltage of the data line DL may be applied to a gate electrode of the driving transistor DT. The driving transistor DT may supply a driving current to the light emitting element in accordance with the data voltage applied to the gate electrode, thereby emitting light. The driving transistor DT and the at least one transistor (e.g., one or more of ST1 through ST6) may be thin film transistors. The light emitting element may emit light in accordance with the driving current of the driving transistor DT. The light emitting element may be an organic light emitting diode including a first electrode, an organic light emitting layer, and a second electrode. The capacitor may serve to keep the data voltage applied to the gate electrode of the driving transistor DT constant.

The non-display area NDA may be defined as an area from the outside of the display area DA to the edge of the display panel 100. The non-display area NDA may be provided with a scan driving circuit SDC for applying scan signals to the scan lines SL.

A lighting circuit unit (e.g., a lighting circuit) 170 for inspecting whether a pixel is defective, a demultiplexer unit (e.g., a demultiplexer) 160, an inspection unit 150 for inspecting the crack occurrence of the display panel 100 and the failure of a spider wiring, and a spider wiring (hereinafter, referred to as a fan-out line FOL) for transmitting the output of the display driving circuit 200 may be arranged between the data lines DL and the display driving circuit 200.

In some embodiments, odd-numbered fan-out lines FOL1, FOL3 . . . FOLm−1 and even-numbered fan-out lines FOL2, FOL4 . . . FOLm may be arranged at different layers with at least one insulating layer therebetween. For example, the odd-numbered fan-out lines FOL1, FOL3 . . . FOLm−1 may be arranged adjacent to an upper layer, the at least one insulating layer may be formed on the odd-numbered fan-out lines FOL1, FOL3 . . . FOLm−1, and the even-numbered fan-out lines FOL2, FOL4 . . . FOLm may be arranged adjacent to a layer on the least one insulating layer. In this case, the even-numbered fan-out lines FOL2, FOL4 . . . FOLm may be arranged between the odd-numbered fan-out lines FOL1, FOL3 . . . FOLm−1, respectively. As another example, the even-numbered fan-out lines FOL2, FOL4 . . . FOLm may be arranged adjacent to a lower layer, the at least one insulating layer may be formed on the even-numbered fan-out lines FOL2, FOL4 . . . FOLm, and the odd-numbered fan-out lines FOL1, FOL3 . . . FOLm−1 may be arranged adjacent to a layer on the at least one insulating layer. However, the present invention is not limited thereto. In some embodiments, the fan-out lines FOL1 to FOLm may also be arranged on the same layer.

Because the fan-out lines FOL1 to FOLm are arranged like webs at intervals of 5 μm to 10 μm, short or open defects frequently occur due to foreign matter after a process, and thus it is desirable to inspect whether the fan-out lines FOL1 to FOLm are defective.

The demultiplexer unit 160 connects the data lines DL and the fan-out lines FOL1 to FOLm between the fan-out lines FOL1 to FOLm and the data lines DL. The demultiplexer unit 160 transmits a plurality of signals transmitted through the fan-out lines FOL1 to FOLm to the corresponding data lines DL through a plurality of switches.

Display pads PADs connected to the display driving circuit 200 may be arranged in the non-display area NDA. The display driving circuit 200 and the display pads PADs may be arranged at one side edge of the display panel 100. The display pads PAD may be arranged adjacent to one side edge of the display panel 100 as compared with the display driving circuit 200.

The scan driving circuit SDC may be connected to the display driving circuit 200 through a plurality of scan control lines SCL. The scan driving circuit SDC may receive a scan control signal SCS and a light emission control signal ECS from the display driving circuit 200 through the plurality of scan control lines SCL.

As shown in FIG. 3, the scan driving circuit SDC may include a scan driver 410 and a light emission control driver 420.

The scan driver 410 may generate scan signals according to the scan control signal SCS, and may sequentially output the scan signals to the scan lines SL. The light emission control driver 420 may generate light emission control signals according to the light emission control signal ECS, and may sequentially output the light emission control signals to the light emitting lines ELL.

As shown in FIG. 3, the display driving circuit 200 may include a timing controller 210, a data driver 220, and a power supply unit 230.

The timing controller 210 receives digital video data DATA and timing signals from the circuit board 300. The timing controller 210 may generate a scan control signal SCS for controlling the operation timing of the scan driver 410 according to the timing signals, may generate a light emission control signal ECS for controlling the operation time of the light emission control driver 420, and may generate a data control signal DCS for controlling the operation time of the data driver 220. The timing controller 210 may output the scan control signal SCS to the scan driver 410 through the plurality of scan control lines SCL, and may output the light emission control signal ECS to the light emission control driver 420. The timing controller 210 may output the digital video data DATA and the data control signal DCS to the data driver 220.

The data driver 220 converts the digital video data DATA into analog positive polarity and negative polarity data voltages and outputs these data voltages to the data lines DL through the fan-out lines FL. The sub-pixels SP are selected by the scan signals of the scan driving circuit SDC, and the data voltages are supplied to the selected sub-pixels SP.

The power supply unit 230 may generate a first driving voltage and supply the first driving voltage to the first driving voltage line VDDL. Further, the power supply unit 230 may generate a second driving voltage and supply the second driving voltage to a cathode electrode of the organic light emitting diodes of each of the sub-pixels SP. The first driving voltage may be a high-potential voltage for driving the organic light emitting diode, and the second driving voltage may be a low-potential voltage for driving the organic light emitting diode. That is, the first driving voltage may have a higher potential than the second driving voltage.

The display driving circuit 200 may be formed as an integrated circuit (IC), and may be attached onto the display panel 100 by using a chip on glass (COG) method, but the present invention is not limited thereto. In some embodiments, the display driving circuit 200 may be formed as an integrated circuit (IC), and may be attached onto the display panel 100 by using a chip on glass (COG) method, a chip on plastic (COP) method, or an ultrasonic bonding method. For example, the display driving circuit 200 may be attached onto the circuit board 300. Hereinafter, a case where the display driving circuit 200 is formed as an integrated circuit (IC) and is attached onto the display panel 100 by using a chip on glass (COG) method may be described as an example.

In some embodiments, the display driving circuit 200 may include a drive integrated circuit and a plurality of bumps. The drive integrated circuit may be connected to a plurality of wiring pads DP1, DP2, DP3, and DP4 shown in FIG. 10 through the plurality of bumps.

The circuit board 300 may be attached onto the display pads PADs using an anisotropic conductive film. Thus, lead lines of the circuit board 300 may be electrically connected to the pads DP. The circuit board 300 may be a flexible film such as a flexible printed circuit board, a printed circuit board, or a chip on film.

In some embodiments, the lighting inspection of the display panel 100, the crack inspection of the display panel 100, and the inspection of the fan-out lines FOL1 to FOLm may be performed before the circuit board is attached. In the lighting inspection of the display panel 100, the crack inspection of the display panel 100, and the inspection of the fan-out lines FOL1 to FOLm, a circuit board for inspection may be attached to the display pads PADs. The circuit board for inspection may supply signals necessary for the lighting inspection of the display panel 100, the crack inspection of the display panel 100, and the inspection of the fan-out lines FOL1 to FOLm.

A crack detection line CDL may be disposed in the non-display area NDA. The crack detection line CDL may be disposed so as to surround the display area DA, and the crack detection line CDL may be connected to the inspection unit 150. For example, one end and the other end of the crack detection line CDL may be respectively connected to the inspection unit 150. The occurrence of a crack in the display panel 100 may be detected by changing the resistance due to the damage of the crack detection line CDL.

Further, one end of each of the fan-out lines FOL1 to FOLm may be connected to the data lines DL, and the other end of each of the fan-out lines FOL1 to FOLm may be connected to the inspection unit 150. The inspection unit 150 may inspect whether the fan-out lines FOL1 to FOLm are defective due to short or open. In this way, the inspection unit 150 may inspect whether the crack detection line CDL is damaged and whether the fan-out lines FOL1 to FOLm are defective. Whether the crack detection line CDL is damaged and whether the fan-out lines FOL1 to FOLm are defective may be described in more detail later.

Figure 4:
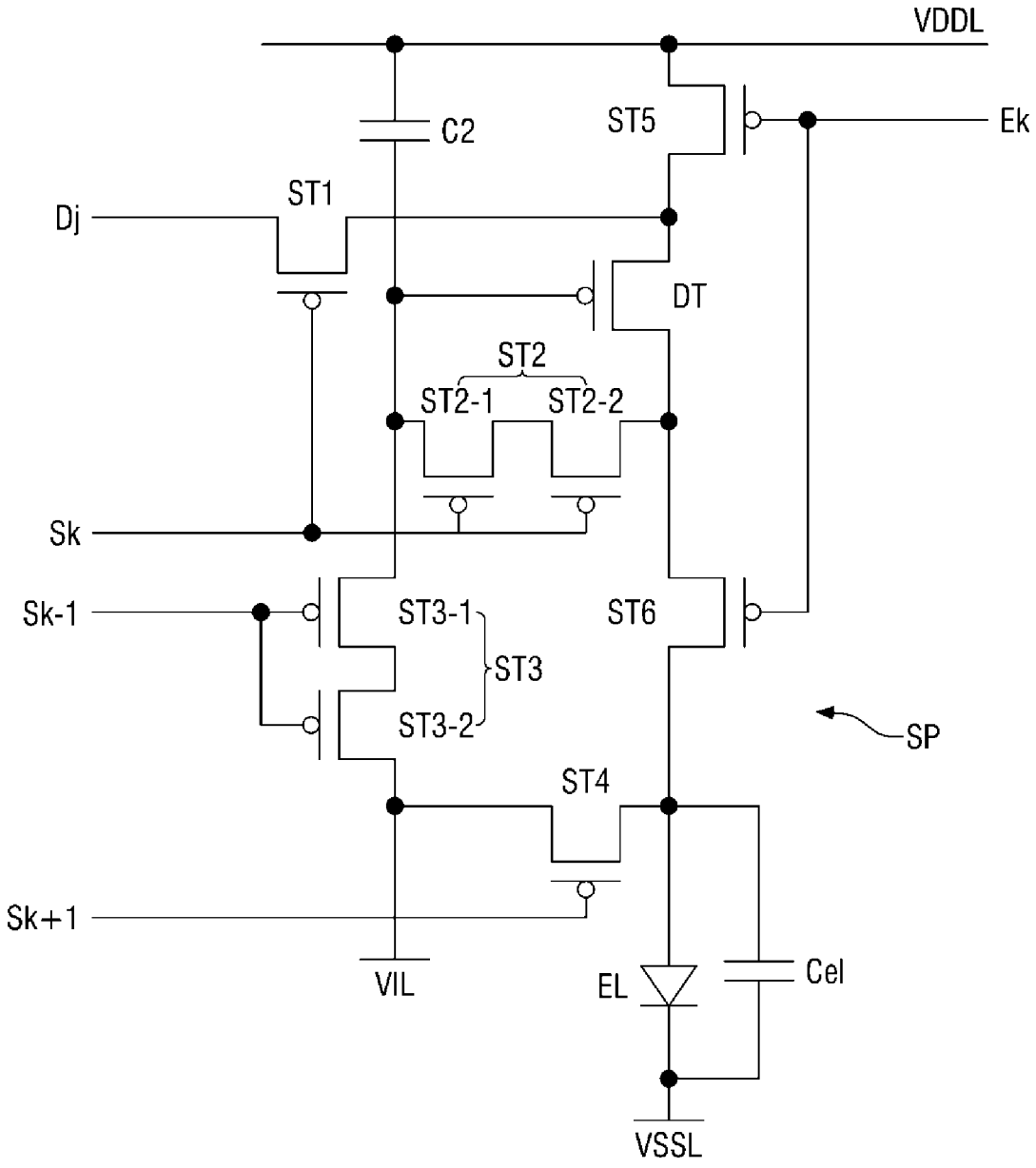
FIG. 4 is a detailed circuit diagram of a sub-pixel according to an embodiment.

FIG. 4 is a detailed circuit diagram of a sub-pixel according to an embodiment.

Referring to FIG. 4, the sub-pixel SP may be connected to a $k-1_{th}$ (k is an integer of 2 or more) scan line Sk−1, a $k_{th}$ scan line Sk, a $k+1_{th}$ scan line Sk+1, and a $j_{th}$ (j is a positive integer) data line Dj. Further, the sub-pixel SP may be connected to a first driving voltage line VDDL for supplying a first driving voltage, an initialization voltage line VIL for supplying an initialization voltage Vini, and a second driving voltage line VSSL for supplying a second driving voltage.

The sub-pixel SP includes a driving transistor DT, a light emitting element EL, switch elements (e.g., ST1 through ST6), and a capacitor (e.g., C2). The switch elements include first to sixth transistors ST1, ST2, ST3, ST4, ST5, and ST6.

The driving transistor DT controls a drain-source current Ids (hereinafter referred to as "driving current") according to the data voltage applied to the gate electrode. The driving current Ids flowing through the channel of the driving transistor DT is proportional to a square of a difference between a gate-source voltage Vsg and a threshold voltage Vth of the driving transistor DT as shown in Equation 1 below.

$$Ids=k'\times(Vsg-Vth)^2 \quad \text{Equation 1}$$

In Equation 1, k' is a proportional coefficient determined by the structure and physical characteristics of the driving transistor DT, Vsg is a gate-source voltage of the driving transistor DT, and Vth is a threshold voltage of a driving transistor.

The light emitting element EL emits light in accordance with the driving current Ids. The light emission amount of the light emitting element EL may be proportional to the drive current Ids.

The light emitting element EL may be an organic light emitting diode including an anode electrode, a cathode electrode, and an organic light emitting layer disposed between the anode electrode and the cathode electrode. Alternatively, the light emitting element EL may be an inorganic light emitting element including an anode electrode, a cathode electrode, and an inorganic semiconductor disposed between the anode electrode and the cathode electrode. Alternatively, the light emitting element EL may be a quantum dot light emitting element including an anode electrode, a cathode electrode, and a quantum dot light emitting layer disposed between the anode electrode and the cathode electrode. Alternatively, the light emitting element EL may be a micro light emitting diode.

The anode electrode of the light emitting element EL may be connected to the first electrode of the fourth transistor ST4 and the second electrode of the sixth transistor ST6, and the cathode electrode thereof may be connected to the second driving voltage line VSSL. A parasitic capacitance Cel may be formed between the anode electrode and cathode electrode of the light emitting element EL.

The first transistor ST1 is turned on by the scan signal of the $k_{th}$ scan line Sk to connect the first electrode of the driving transistor DT to the $j_{th}$ data line Dj. The gate electrode of the first transistor ST1 may be connected to the $k_{th}$ scan line Sk, the first electrode thereof may be connected to the first electrode of the driving transistor DT, and the second electrode thereof may be connected to the $j_{th}$ data line Dj.

The second transistor ST2 may be formed as a dual transistor including a second-first transistor ST2-1 and a second-second transistor ST2-2. The second-first transistor ST2-1 and the second-second transistor ST2-2 are turned on by a scan signal of the $k_{th}$ scan line Sk to connect the gate electrode and second electrode of the driving transistor DT.

That is, when the second-first transistor ST2-1 and the second-second transistor ST2-2 are turned on, the gate electrode and second electrode of the driving transistor DT are connected, and thus the driving transistor DT is driven by a diode. The gate electrode of the second-first transistor ST2-1 may be connected to the $k_{th}$ scan line Sk, the first electrode thereof may be connected to the second electrode of the second-second transistor ST2-2, and the second electrode thereof may be connected to the gate electrode of the driving transistor DT. The gate electrode of the second-second transistor ST2-2 may be connected to the $k_{th}$ scan line Sk, the first electrode thereof may be connected to the second electrode of the driving transistor DT, and the second electrode thereof may be connected to the first electrode of the second-second transistor ST2-2.

The third transistor ST3 may be formed as a dual transistor including a third-first transistor ST3-1 and a third-second transistor ST3-2. The third-first transistor ST3-1 and the third-second transistor ST3-2 are turned on by a scan signal of the $k-1_{th}$ scan line Sk−1 to connect the gate electrode of the driving transistor DT to the initialization voltage line VIL. The gate electrode of the driving transistor DT may be discharged with the initialization voltage of the initialization voltage line VIL. The gate electrode of the third-first transistor ST3-1 may be connected to the $k-1_{th}$ scan line Sk−1, the first electrode thereof may be connected to the gate electrode of the driving transistor DT, and the second electrode thereof may be connected to the first electrode of the third-second transistor ST3-2. The gate electrode of the third-second transistor ST3-2 may be connected to the $k-1_{th}$ scan line Sk−1, the first electrode thereof may be connected to the second electrode of the third-first transistor ST3-1, and the second electrode thereof may be connected to the initialization voltage line VIL.

The fourth transistor ST4 is turned on by a scan signal of the $k+1_{th}$ scan line Sk+1 to connect the anode electrode of the light emitting element EL to the initialization voltage line VIL. The anode electrode of the light emitting element EL may be discharged with the initialization voltage of the initialization voltage line VIL. The gate electrode of the fourth transistor ST4 is connected to the $k+1_{th}$ scan line Sk+1, the first electrode thereof is connected to the anode electrode of the light emitting element EL, and the second electrode thereof is connected to the initialization voltage line VIL.

The fifth transistor ST5 is turned on by a light emission control signal of the $k_{th}$ light emitting line Ek to connect the first electrode of the driving transistor DT to the first driving voltage line VDDL. The gate electrode of the fifth transistor ST5 is connected to the $k_{th}$ light emitting line Ek, the first electrode thereof is connected to the first driving voltage line VDDL, and the second electrode thereof is connected to the first electrode of the driving transistor DT.

The sixth transistor ST6 is connected between the second electrode of the driving transistor DT and the anode electrode of the light emitting element EL. The sixth transistor ST6 is turned on by a light emission control signal of the $k_{th}$ light emitting line Ek to connect the second electrode of the driving transistor DT to the anode electrode of the light emitting element EL. The gate electrode of the sixth transistor ST6 is connected to the $k_{th}$ light emitting line Ek, the first electrode thereof is connected to the second electrode of the driving transistor DT, and the second electrode thereof is connected to the anode electrode of the light emitting element EL. When both the fifth transistor ST5 and the sixth transistor ST6 are turned on, the driving current Ids may be supplied to the light emitting element EL.

The capacitor C2 is formed between the gate electrode of the driving transistor DT and the first driving voltage line VDDL. One electrode of the capacitor C2 may be connected to the gate electrode of the driving transistor DT, and the other electrode thereof may be connected to the first driving voltage line VDDL. The capacitor C2 serves to hold the voltage of the gate electrode of the driving transistor DT for one frame period.

When the first electrode of each of the first to sixth transistors ST1, ST2, ST3, ST4, ST5, and ST6 and the driving transistor DT is a source electrode, the second electrode thereof may be a drain electrode. Alternatively, when the first electrode of each of the first to sixth transistors ST1, ST2, ST3, ST4, ST5, and ST6 and the driving transistor DT is a drain electrode, the second electrode thereof may be a source electrode.

The active layer of each of the first to sixth transistors ST1, ST2, ST3, ST4, ST5, and ST6 and the driving transistor DT may be formed of any one of polysilicon, amorphous silicon, and an oxide semiconductor. When the active layer of each of the first to sixth transistors ST1, ST2, ST3, ST4, ST5, and ST6 and the driving transistor DT may be formed of polysilicon, the process of forming the active layer may be a low-temperature polysilicon (LTPS) process.

Although it is primarily described in FIG. 4 that the first to sixth transistors ST1, ST2, ST3, ST4, ST5, and ST6 and the driving transistor DT are formed of p-type transistors, the present invention is not limited thereto, and they may be formed of n-type transistors. When the first to sixth transistors ST1, ST2, ST3, ST4, ST5, and ST6 and the driving transistor DT are formed of n-type transistors, the timing diagram of FIG. 5 should be modified in accordance with the characteristics of the n-type transistors.

The first driving voltage of the first driving voltage line VDDL, the second driving voltage of the second driving voltage line VSSL, and the initialization voltage of the initialization voltage line Vini may be set in consideration of the characteristics of the driving transistor DT and the characteristics of the light emitting element EL. For example, a voltage difference between the initialization voltage and the data voltage supplied to the source electrode of the driving transistor DT may be set to be smaller than the threshold voltage of the driving transistor DT.

Figure 5:
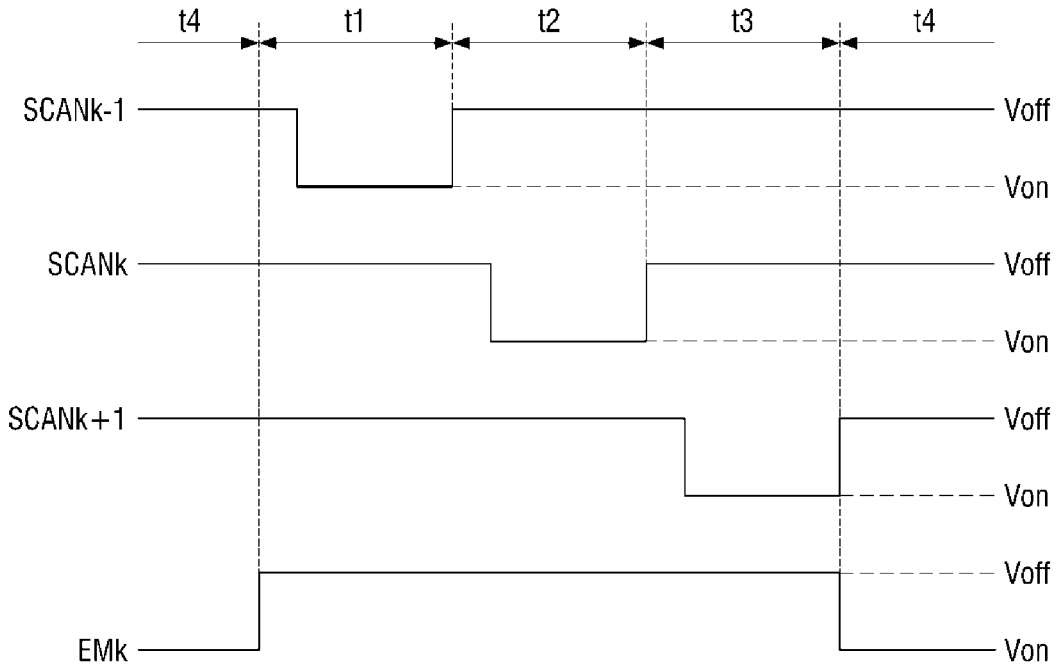
FIG. 5 is a waveform diagram of signals applied to the $k-1_{th}$ scan line, $k_{th}$ scan line, $k+1_{th}$ scan line, and $k_{th}$ light emitting line of FIG. 4.

FIG. 5 is a waveform diagram of signals applied to the $k-1_{th}$ scan line, $k_{th}$ scan line, $k+1_{th}$ scan line, and $k_{th}$ light emitting line of FIG. 4.

Referring to FIG. 5, the $k-1_{th}$ scan signal SCANk−1 applied to the $k-1_{th}$ scan line Sk−1 is a signal for controlling the turn-on and turn-off of the third transistor ST3. The $k_{th}$ scan signal SCANk applied to the $k_{th}$ scan line Sk is a signal for controlling the turn-on and turn-off of each of the first transistor ST1 and the second transistor ST2. The $k+1_{th}$ scan signal SCANk+1 applied to the $k+1_{th}$ scan line Sk+1 is a signal for controlling the turn-on and turn-off of the fourth transistor ST4. The $k_{th}$ light emission signal EMk is a signal for controlling the fifth transistor ST5 and the sixth transistor ST6.

The $k-1_{th}$ scan signal SCANk−1, the $k_{th}$ scan signal SCANk, the $k+1_{th}$ scan signal SCANk+1, and $k_{th}$ light emission signal Emk may be generated at intervals of one frame period. One frame period may be divided into first to fourth periods t1 to t4. The first period t1 is a period for initializing the gate electrode of the driving transistor DT, the second period t2 may be a period for supplying data voltage to the gate electrode of the driving transistor DT and sampling the threshold voltage of the driving transistor DT, the third period t3 is a period for initializing the anode electrode of the light emitting element EL, and the fourth period t4 is a period for emitting light from the light emitting element EL.

The $k-1_{th}$ scan signal SCANk−1, the $k_{th}$ scan signal SCANk, and the $k+1_{th}$ scan signal SCANk+1 may be sequentially output with gate-on voltages Von during the first to third periods t1, t2, and t3. For example, the $k-1_{th}$ scan signal SCANk−1 may have a gate-on voltage Von during the first period t1, and may have a gate-off voltage Voff during residual periods. The $k_{th}$ scan signal SCANk may have a gate-on voltage Von during the second period t2, and may have a gate-off voltage Voff during residual periods. The $k+1_{th}$ scan signal SCANk+1 may have a gate-on voltage Von during the third period t3, and may have a gate-off voltage Voff during residual periods. Although it is illustrated in FIG. 5 that the period during which the $k-1_{th}$ scan signal SCANk−1 has a gate-on voltage Von is shorter than the first period t1, in some embodiments, the period during which the $k-1_{th}$ scan signal SCANk−1 has a gate-on voltage Von may be substantially equal to the first period t1. Further, although it is illustrated in FIG. 5 that the period during which the $k_{th}$ scan signal SCANk has a gate-on voltage Von is shorter than the second period t2, in some embodiments, the period during which the $k_{th}$ scan signal SCANk has a gate-on voltage Von may be substantially equal to the second period t2. Further, although it is illustrated in FIG. 5 that the period during which the $k+1_{th}$ scan signal SCANk+1 has a gate-on voltage Von is shorter than the third period t3, in some embodiments, the period during which the $k+1_{th}$ scan signal SCANk+1 has a gate-on voltage Von may be substantially equal to the third period t3.

The $k_{th}$ light emission signal EMk may have a gate-on voltage Von during the fourth period t4, and may have a gate-off voltage Voff during residual periods.

It is shown in FIG. 5 that each of the first period t1, the second period t2, and the third period t3 is one horizontal period. Because one horizontal period indicates a period during which a data voltage is supplied to each of the sub-pixels SP connected to any scan line of the display panel 100, it may be defined as one horizontal line scan period. The data voltages may be supplied to the data lines DL in synchronization with the gate-on voltages Von of the respective scan signals.

The gate-on voltage corresponds to a turn-on voltage capable of turning on each of the first to sixth transistors ST1, ST2, ST3, ST4, ST5, and ST6. The gate-off voltage corresponds to a turn-off voltage capable of turning off each of the first to sixth transistors ST1, ST2, ST3, ST4, ST5, and ST6.

FIGS. 6-9 are circuit diagrams for explaining a method of driving a first sub-pixel during first to fifth periods of FIG. 5.

Hereinafter, an operation of the sub-pixel SP during the first to fourth periods t1 to t4 may be described in more detail with reference to FIGS. 5-9.

Figure 6:
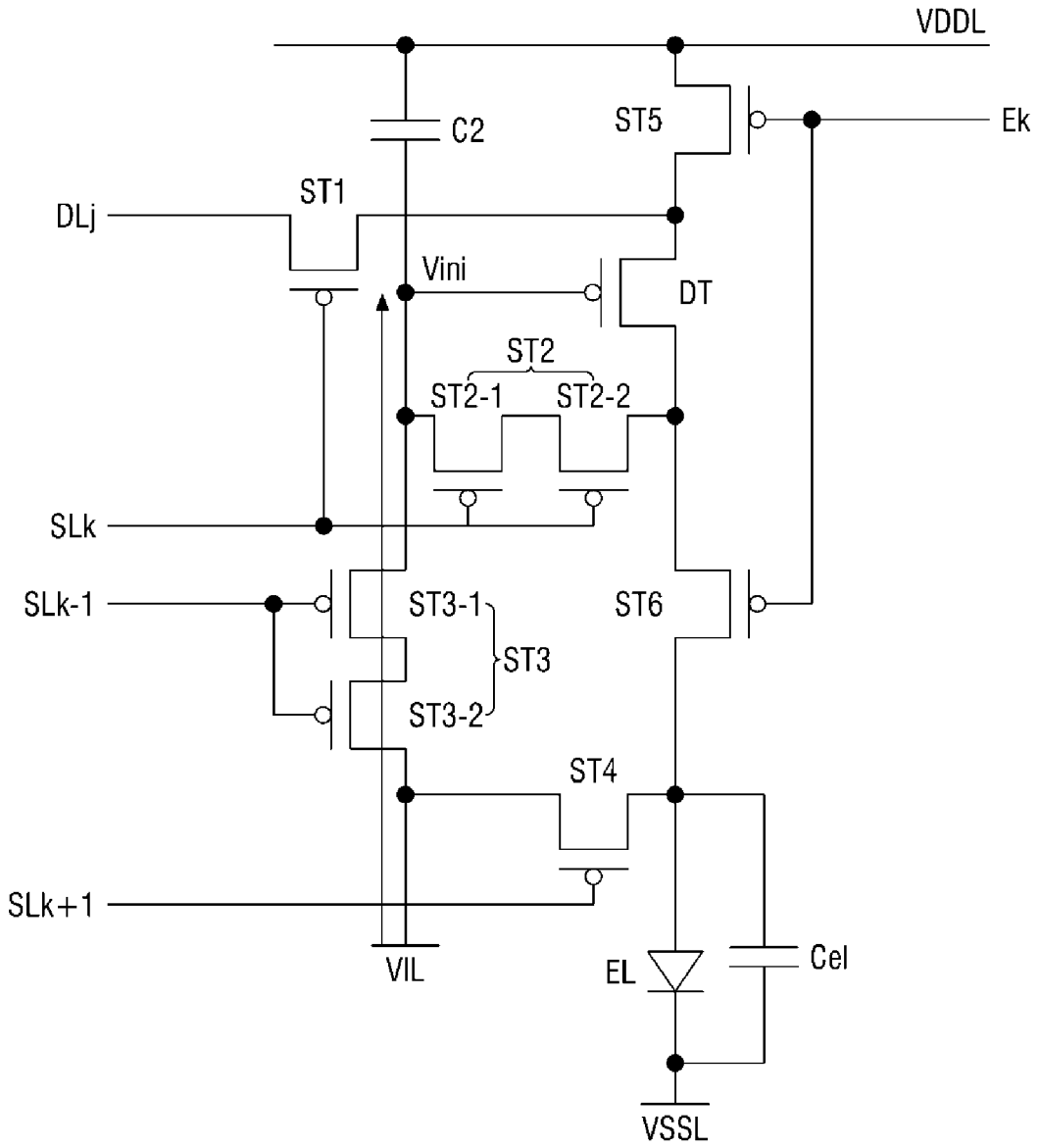
FIGS. 6-9 are circuit diagrams for explaining a method of driving a first sub-pixel during first to fifth periods of FIG. 5.

First, the $k-1_{th}$ scan signal SCANk−1 having a gate-on voltage Von is supplied to the $k-1_{th}$ scan line Sk−1 during the first period t1. During the first period t1, the third transistor ST3 is turned on by the $k-1_{th}$ scan signal SCANk−1 having a gate-on voltage Von as shown in FIG. 6. When the third transistor ST3 is turned on, the gate electrode of the driving transistor DT is initialized by the initialization voltage Vini of the initialization voltage line VIL.

Figure 7:
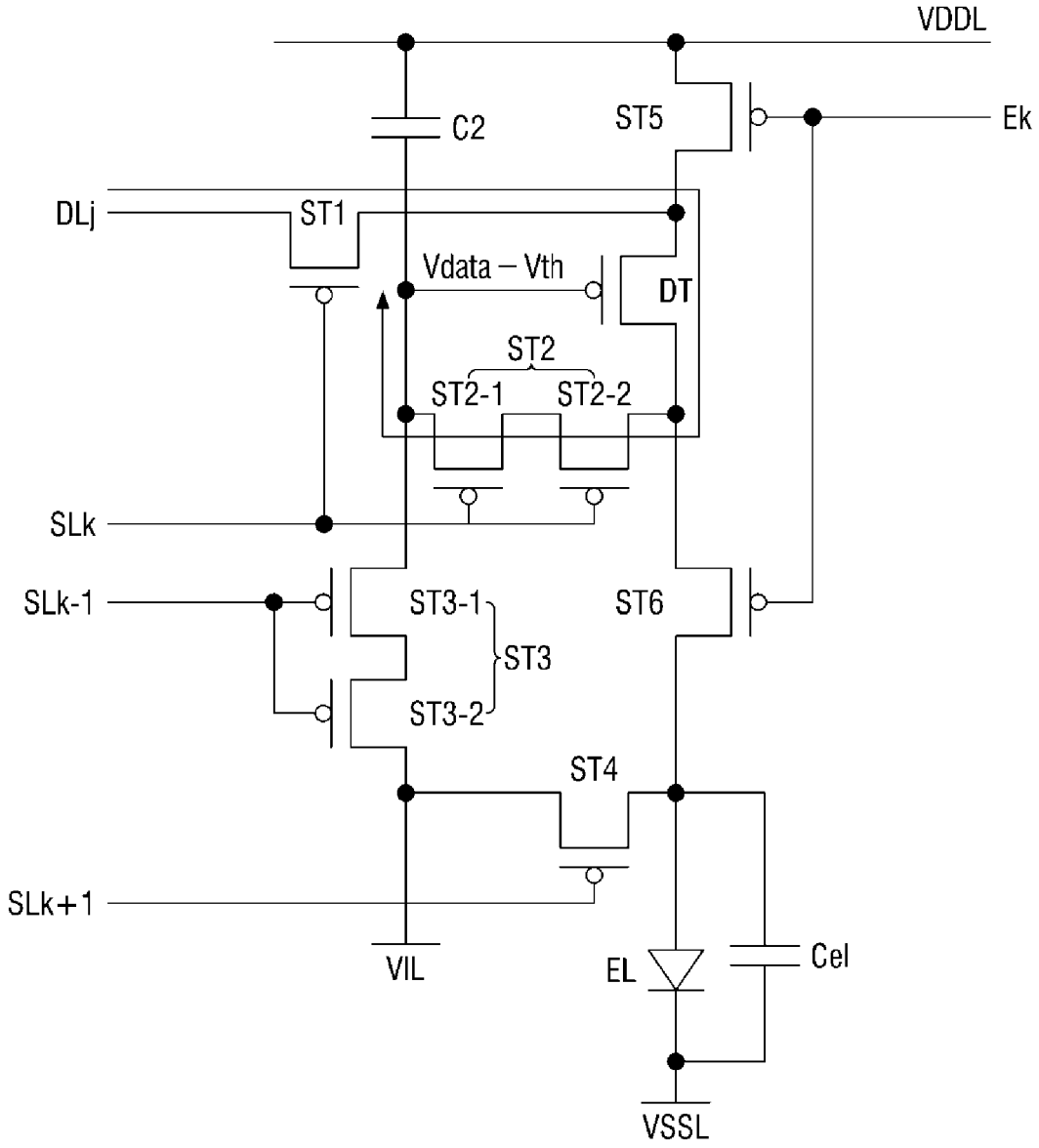

Second, the $k_{th}$ scan signal SCANk having a gate-on voltage Von is supplied to the $k_{th}$ scan line Sk during the second period t2. During the second period t2, each of the first transistor ST1 and the second transistor ST2 is turned on by the $k_{th}$ scan signal SCANk having a gate-on voltage Von as shown in FIG. 7.

When the second transistor ST2 is turned on, the gate electrode and second electrode of the driving transistor DT are connected to each other, and the driving transistor DT is driven as a diode (e.g., the driving transistor DT is diode-connected). When the first transistor ST1 is turned on, a data voltage Vdata is supplied to the first electrode of the driving transistor DT. In this case, because the voltage difference (Vsg=Vdata−Vini) between the gate electrode and the first electrode of the driving transistor DT is larger than the threshold voltage Vth, the driving transistor DT forms a current path until the voltage difference Vsg between the gate electrode and the source electrode reaches the threshold voltage Vth. Thus, the voltage of each of the gate electrode and the second electrode of the driving transistor DT increases up to a differential voltage (Vdata−Vth) between the data voltage Vdata and the threshold voltage Vth of the driving transistor DT. The "differential voltage (Vdata−Vth)" may be stored in the capacitor C2.

Figure 8:
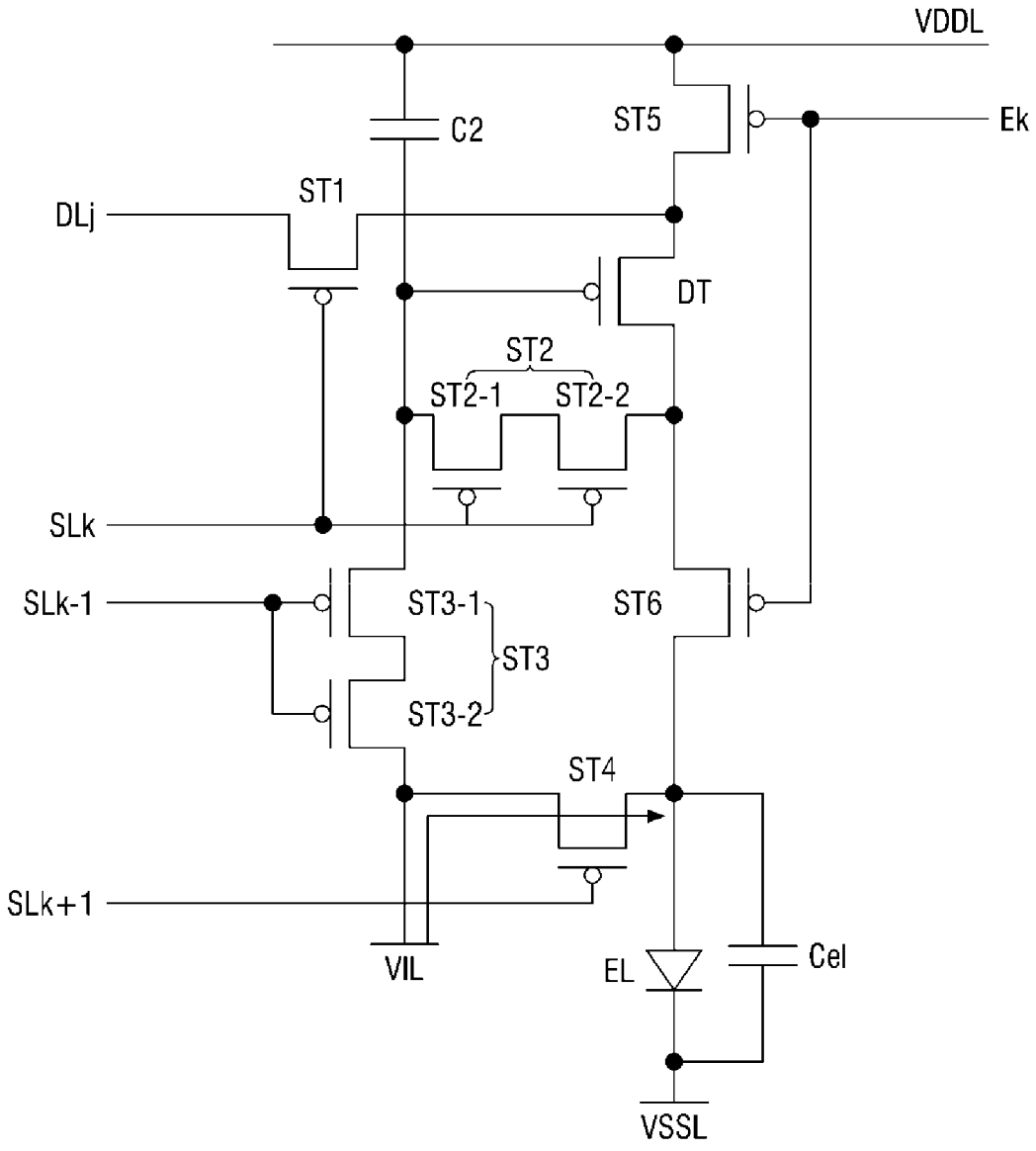

Third, the $k+1_{th}$ scan signal SCANk+1 having a gate-on voltage Von is supplied to the $k+1_{th}$ scan line Sk+1 during the third period t3. During the third period t3, the fourth transistor ST4 is turned on by the $k+1_{th}$ scan signal SCANk+1 having a gate-on voltage Von as shown in FIG. 8. When the fourth transistor ST4 is turned on, the anode electrodes of the light emitting element EL is initialized by the initialization voltage Vini of the initialization voltage line VIL.

Figure 9:
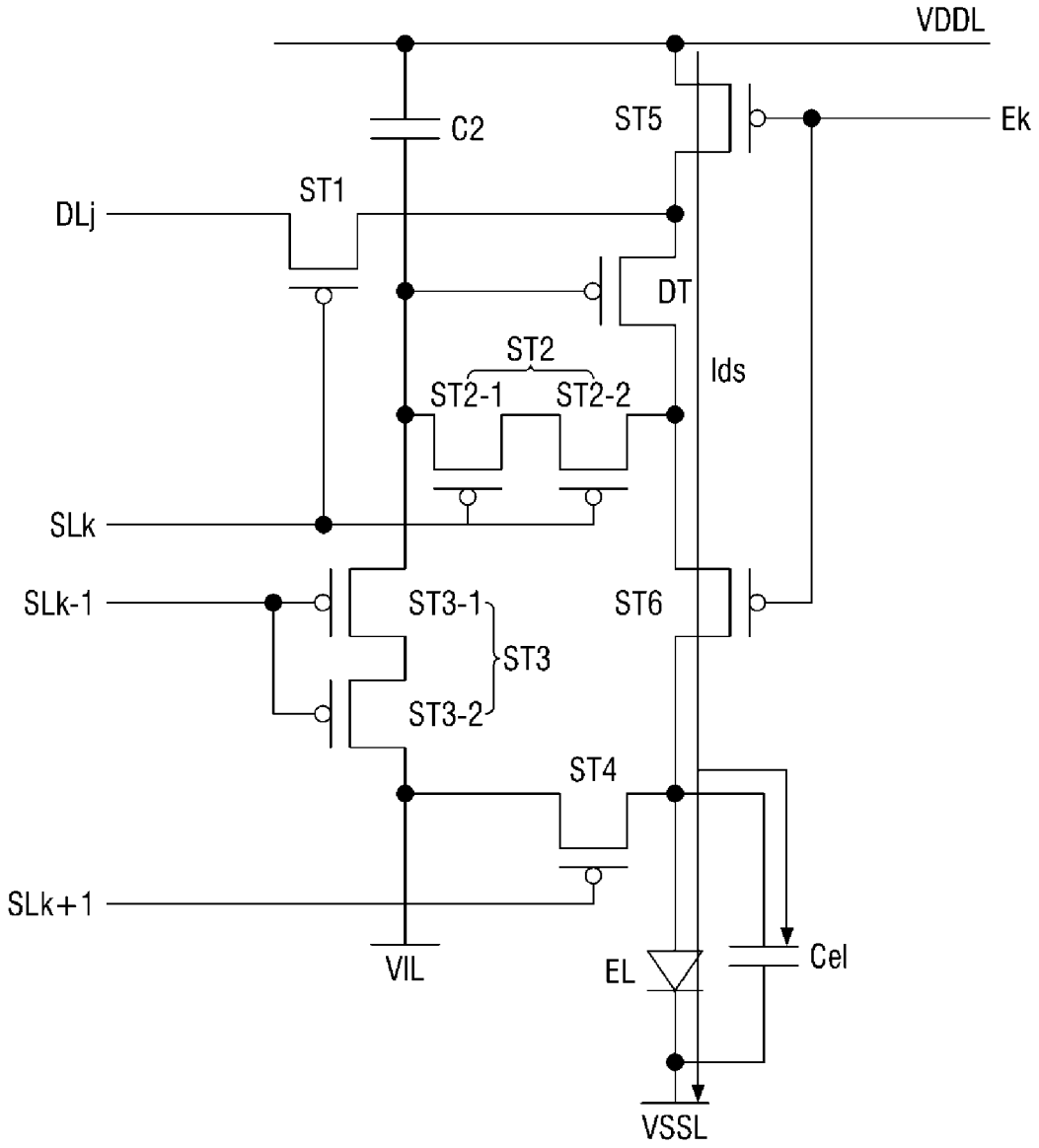

Fourth, the $k_{th}$ light emission signal EMk having a gate-on voltage Von is supplied to the $k_{th}$ light emitting line Ek during the fourth period t4. During the fourth period t4, each of the fifth transistor ST5 and the sixth transistor ST6 is turned on by the $k_{th}$ light emission signal EMk having a gate-on voltage Von as shown in FIG. 9.

When the fifth transistor ST5 is turned on, the first electrode of the driving transistor DT is connected to the first driving voltage line VDDL. When the sixth transistor ST6 is turned on, the second electrode of the driving transistor DT is connected to the anode electrode of the light emitting element EL.

When the fifth transistor ST5 and the sixth transistor ST6 are turned on, the driving current Ids flowing according to the voltage of the gate electrode of the driving transistor DT may be supplied to the light emitting element EL. The driving current Ids may be defined by Equation 2 below.

$$Ids=k'\times(ELVDD-(Vdata-Vth)-Vth)^2 \quad \text{Equation 2}$$

In Equation 2, k' is a proportional coefficient determined by the structure and physical characteristics of the driving transistor DT, Vth is a threshold voltage of the driving transistor DT, ELVDD is a first driving voltage of the first driving voltage line VDDL, and Vdata is a data voltage. The gate voltage of the driving transistor DT is Vdata−Vth, and the voltage of the first electrode is ELVDD. Summarizing Equation 2, Equation 3 is derived.

$$Ids=k'\times(ELVDD-Vdata)^2 \quad \text{Equation 3}$$

Consequently, as shown in Equation 3, the driving current Ids does not depend on the threshold voltage Vth of the driving transistor DT. That is, the threshold voltage Vth of the driving transistor DT is compensated.

Meanwhile, as shown in FIG. 9, the driving current Ids is supplied not only to the light emitting element EL but also to the parasitic capacitance Cel. However, in the case of a dual transistor in which the driving transistor DT is connected in parallel, a high driving current Ids may be supplied, so that the light emitting element EL may be driven at a high luminance, and the charging time of the parasitic capacitance Cel may be reduced.

Figure 10:
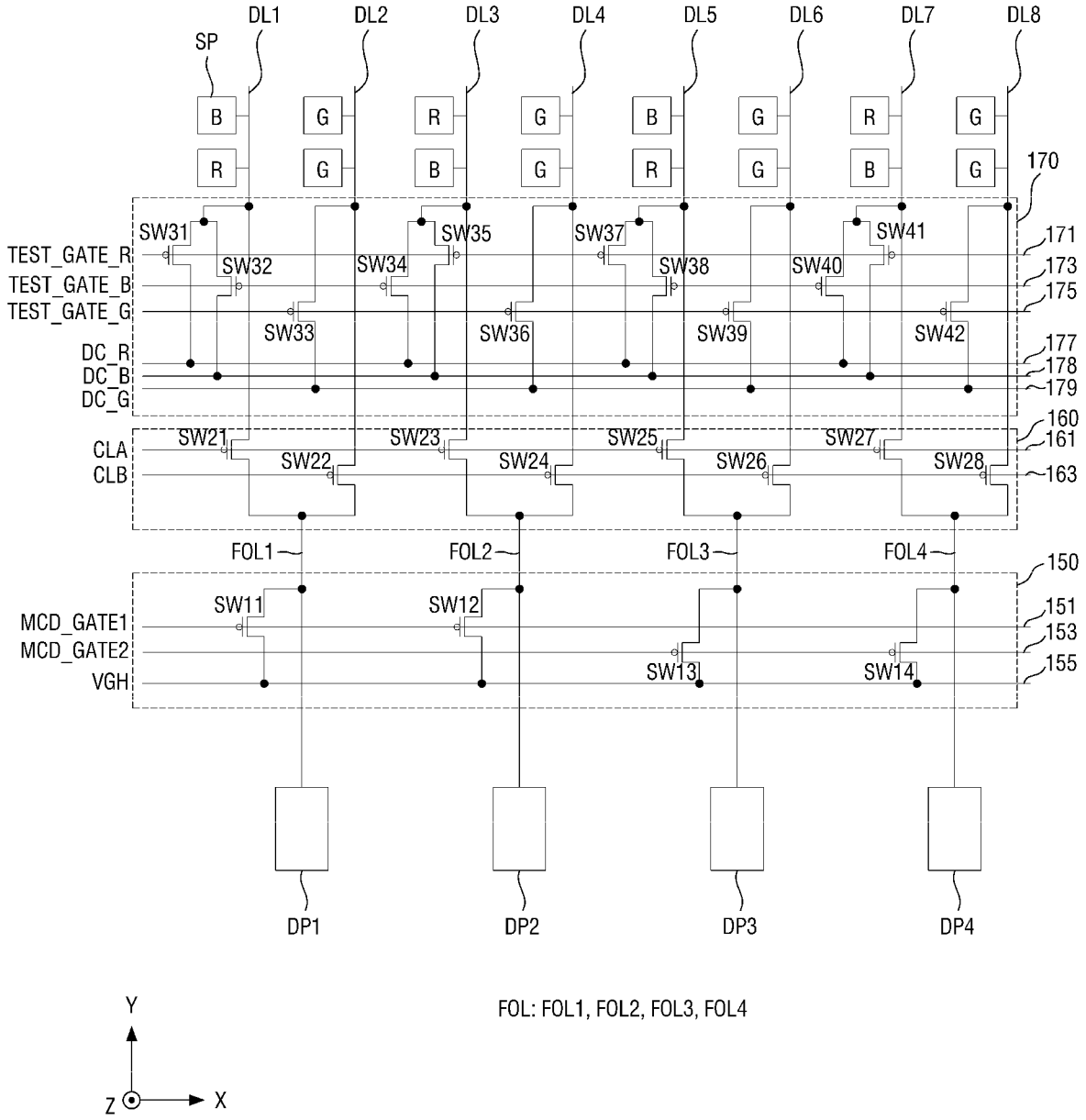
FIG. 10 is a diagram showing a circuit configuration of a display device according to an embodiment.
Figure 11:
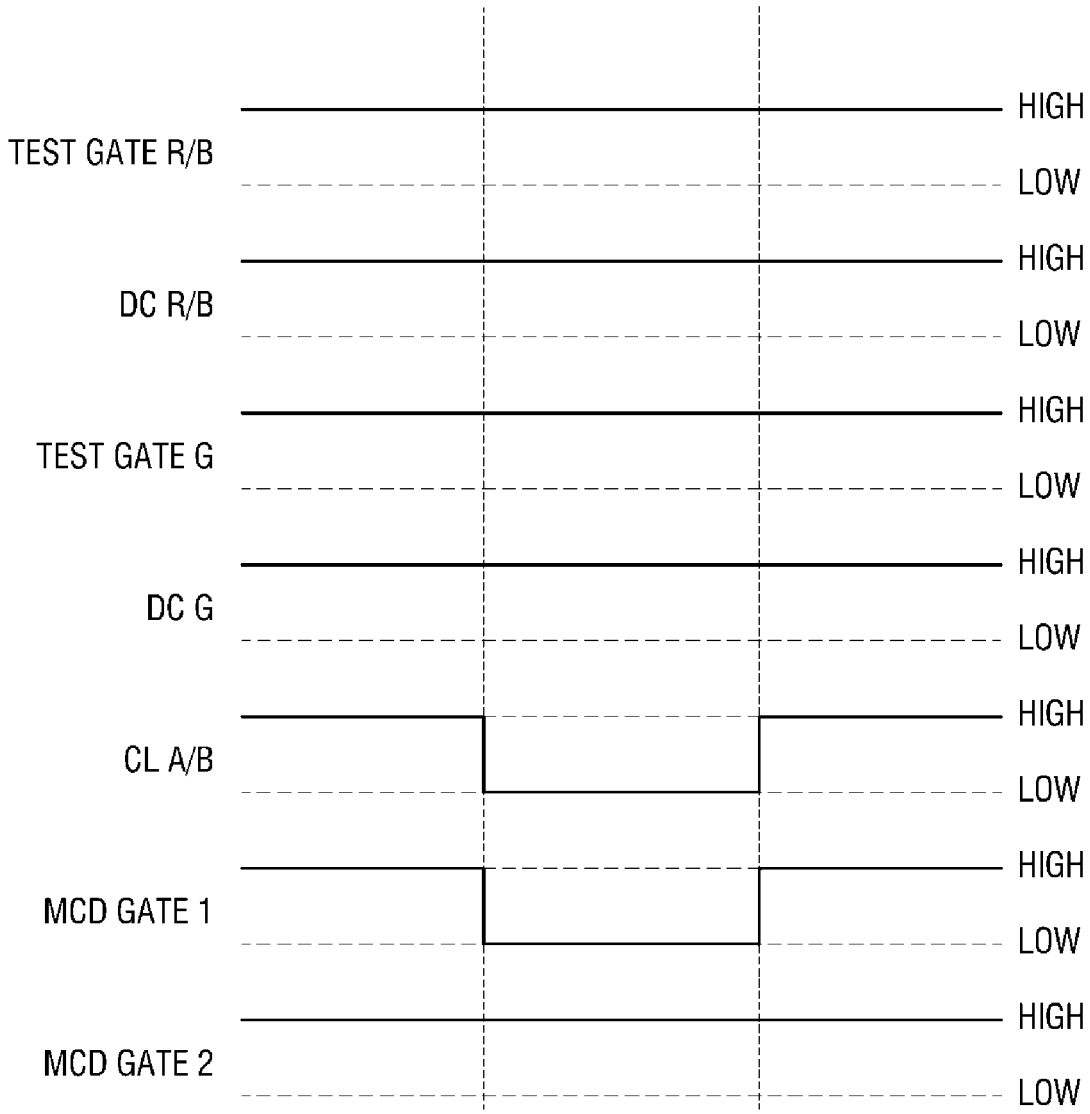
FIGS. 11-12 are timing charts for explaining a fan-out line inspection in a display device according to an embodiment.
Figure 12:
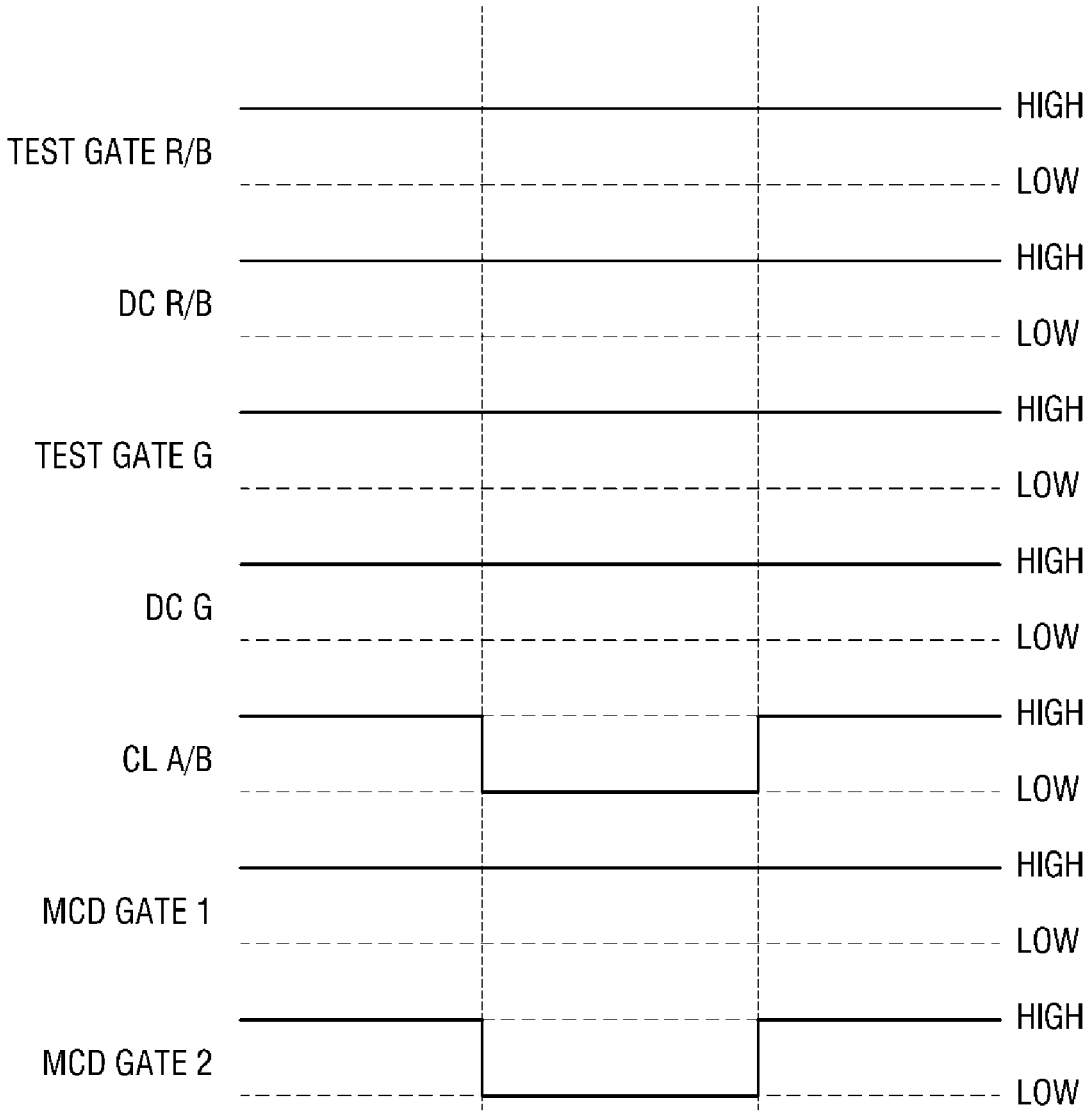
Figure 13:
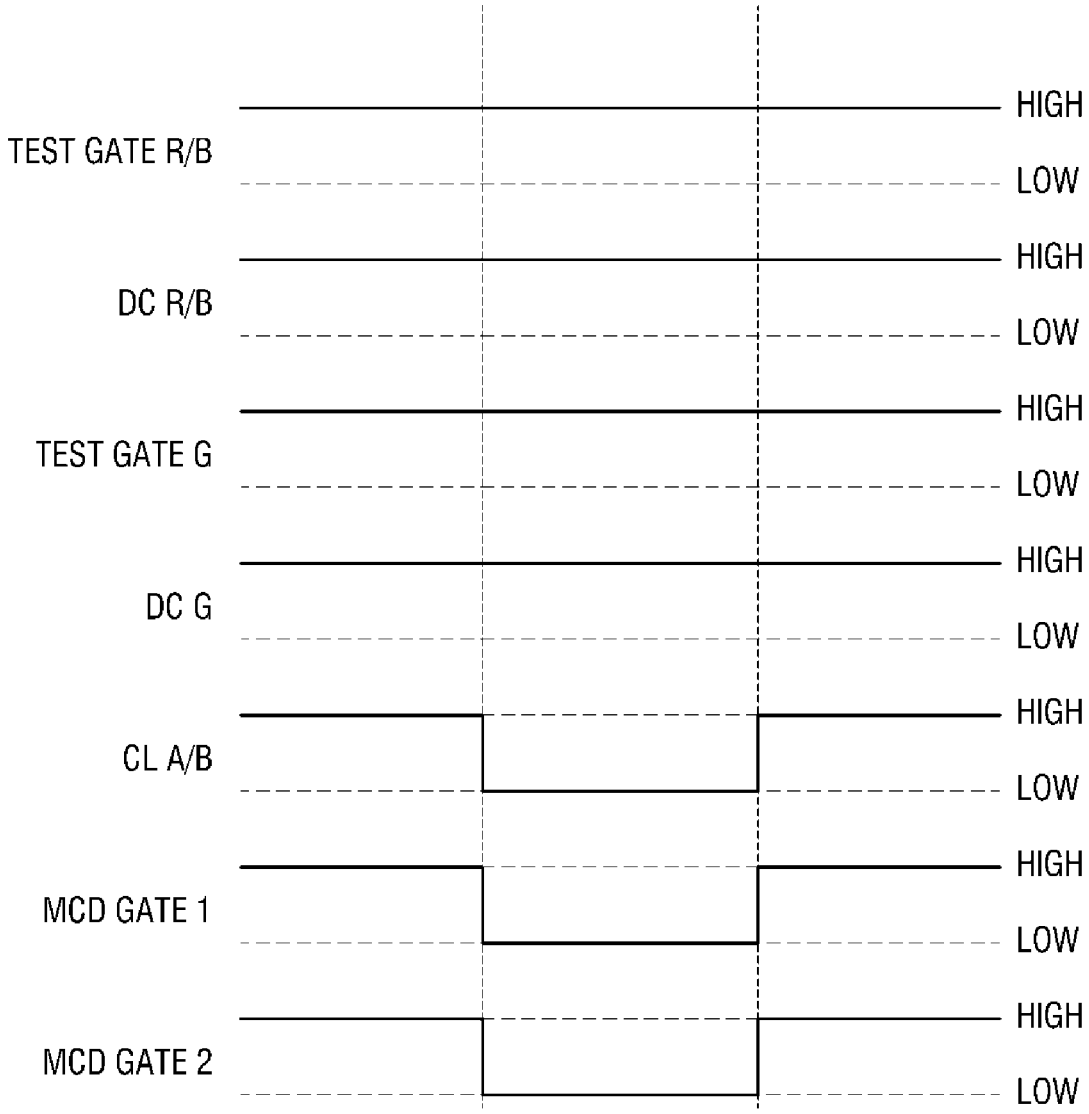
FIG. 13 is a timing chart for explaining a crack inspection in a display device according to an embodiment.

FIG. 10 is a diagram showing a circuit configuration of a display device according to an embodiment, FIGS. 11-12 are timing charts for explaining a fan-out line inspection in a display device according to an embodiment, and FIG. 13 is a timing chart for explaining a crack inspection in a display device according to an embodiment.

Referring to FIG. 10, in some embodiments, the display device may include an inspection unit 150 disposed between sub-pixels SP and wiring pads DP, a demultiplexer unit 160, and a lighting circuit unit 170.

For convenience of explanation, FIG. 10 shows some of the sub-pixels SP arranged in the display device 10, and shows only first to eighth data lines DL1 to DL8 connected to the sub-pixels SP.

In some embodiments, the sub-pixels SP may include red sub-pixels R for emitting red light, blue sub-pixels B for emitting blue light, and green sub-pixels G for emitting green light. The red sub-pixels R and the blue sub-pixels B may be alternately arranged on the same column, and the green sub-pixels G may be arranged in series on a column adjacent to the column on which the red sub-pixels R and the blue sub-pixels B are arranged. In this case, the red sub-pixels R and the blue sub-pixels B may be respectively arranged in the form of a checker board (e.g., a check border) in a diagonal direction with respect to a column on which the green sub-pixels G are arranged. That is, the red sub-pixels R and the blue sub-pixels B may be alternately arranged so as not to be repeatedly arranged on the same column in two neighboring rows, respectively. In some embodiments, data lines DL are arranged in each column.

In some embodiments, the first data line DL1 may be connected to the first column on which the red sub-pixels R and the blue sub-pixels B are alternately arranged, the second data line DL2 may be connected to the second column on which the green sub-pixels G are arranged, the third data line DL3 may be connected to the third column on which the red sub-pixels R and the blue sub-pixels B are alternately arranged in the reverse order to the first column, the fourth data line DL4 may be connected to the fourth column on which the green sub-pixels G are arranged, the fifth data line DL5 may be connected to the fifth column on which the red sub-pixels R and the blue sub-pixels B are alternately arranged in the same order as the first column, the sixth data line DL6 may be connected to the sixth column on which the green sub-pixels G are arranged, the seventh data line DL7 may be connected to the seventh column on which the red sub-pixels R and the blue sub-pixels B are alternately arranged in the reverse order to the first column, and the eighth data line DL8 may be connected to the eighth column on which the green sub-pixels G are arranged.

Although it is described in the embodiment of the present invention that the sub-pixels SP are composed of red sub-pixels R, blue sub-pixels B, and green sub-pixels G, in some embodiments, the sub-pixels SP may further include colors other than red, green, and blue.

The wiring pads DP may be located in an area where the display driving circuit 200 is disposed (e.g., the display driving circuit 200 is shown in FIG. 2), and a driving integrated circuit may be connected to the wiring pads DP through a plurality of bumps. The wiring pads DP may include first to fourth wiring pads DP1 to DP4.

The first to fourth wiring pads DP1 to DP4 may be provided with first to fourth fan-out lines FOL1 to FOL4 connected to the first to eighth data lines DL1 to DL8. Illustratively, the first fan-out line FOL1 may connect the first wiring pad DP1 to the first data line DL1 and the second data line DL2, the second fan-out line FOL2 may connect the second wiring pad DP2 to the third data line DL3 and the fourth data line DL4, the third fan-out line FOL3 may connect the third wiring pad DP3 to the fifth data line DL5 and the sixth data line DL6, and the fourth fan-out line FOL4 may connect the fourth wiring pad DP4 to the seventh data line DL7 and the eighth data line DL8.

The first to fourth fan-out lines FOL1 to FOL4 may extend in the second direction (Y-axis direction), and may be arranged to be spaced apart from each other in the first direction (X-axis direction).

In some embodiments, the first and third fan-out lines FOL1 and FOL3 and the second and fourth fan-out lines FOL2 and FOL4 may be arranged at different layers with at least one insulating layer therebetween. For example, the first and third fan-out lines FOL1 and FOL3 may be arranged adjacent to an upper layer, the at least one insulating layer may be formed on the first and third fan-out lines FOL1 and FOL3, and the second and fourth fan-out lines FOL2 and FOL4 may be arranged adjacent to a layer on the least one insulating layer. In this case, the second and fourth fan-out lines FOL2 and FOL4 may be arranged between the first and third fan-out lines FOL1 and FOL3, respectively. As another example, the second and fourth fan-out lines FOL2 and FOL4 may be arranged adjacent to a lower layer, the at least one insulating layer may be formed on the second and fourth fan-out lines FOL2 and FOL4, and the first and third fan-out lines FOL1 and FOL3 may be arranged adjacent to a layer on the least one insulating layer.

The inspection unit 150, the demultiplexer unit 160, and the lighting circuit unit 170 may be sequentially arranged between the sub-pixels SP and the first to fourth wiring pads DP1 to DP4.

In some embodiments, the inspection unit 150 may include a first control line 151, a second control line 153, a data voltage line 155, and switches.

The first control line 151, the second control line 153 and the data voltage line 155 may extend in the first direction (X-axis direction), and may be spaced apart from each other in the second direction (Y-axis direction).

The switches of the inspection unit 150 may include a first switch SW11 connected to the first fan-out line FOL1, a second switch SW12 connected to the second fan-out line FOL2, a third switch SW13 connected to the third fan-out line FOL3, and a fourth switch SW14 connected to the fourth fan-out line FOL4.

Specifically, in the first switch SW11, a gate may be connected to the first control line 151 for supplying a first inspection control signal MCD_GATE1, a first terminal may be connected to the first fan-out line FOL1, and a second terminal may be connected to the data voltage line 155 for supplying a black data voltage VGH. The first switch SW11 may be turned on by the first inspection control signal MCD_GATE1 to connect the data voltage line 155 to the first fan-out line FOL1.

In the second switch SW12, a gate may be connected to the first control line 151 for supplying a first inspection control signal MCD_GATE1, a first terminal may be connected to the second fan-out line FOL2, and a second terminal may be connected to the data voltage line 155 for supplying a black data voltage VGH. The second switch SW12 may be turned on by the first inspection control signal MCD_GATE1 to connect the data voltage line 155 to the second fan-out line FOL2.

In the third switch SW13, a gate may be connected to the second control line 153 for supplying a second inspection control signal MCD_GATE2, a first terminal may be connected to the third fan-out line FOL3, and a second terminal may be connected to the data voltage line 155 for supplying a black data voltage VGH. The third switch SW13 may be turned on by the second inspection control signal MCD_GATE2 to connect the data voltage line 155 to the third fan-out line FOL3.

In the fourth switch SW14, a gate may be connected to the second control line 153 for supplying a second inspection control signal MCD_GATE2, a first terminal may be connected to the fourth fan-out line FOL4, and a second terminal may be connected to the data voltage line 155 for supplying a black data voltage VGH. The fourth switch SW14 may be turned on by the second inspection control signal MCD_GATE2 to connect the data voltage line 155 to the fourth fan-out line FOL4.

In some embodiments, the demultiplexer unit 160 transmits the black data voltages VGH transmitted through the first to fourth fan-out lines FOL1 to FOL4 to the corresponding data lines DL through the plurality of switches. The demultiplexer unit 160 may include a third control line 161, a fourth control line 163, and switches.

The third control line 161 and the fourth control line 163 may extend in the first direction (X-axis direction), and may be spaced apart from each other in the second direction (Y-axis direction).

The switches of the inspection unit 150 may include a fifth switch SW21 and a sixth switch SW22 which are connected to the first fan-out line FOL1, a seventh switch SW23 and an eighth switch SW24 which are connected to the second fan-out line FOL2, a ninth switch SW25 and a tenth switch SW26 which are connected to the third fan-out line FOL3, and an eleventh switch SW27 and a twelfth switch SW28 which are connected to the fourth fan-out line FOL4.

Specifically, in the fifth switch SW21, a gate may be connected to the third control line 161 for supplying a first demultiplexer control signal CLA, a first terminal may be connected to the first fan-out line FOL1, and a second terminal may be connected to the first data line DL1. The fifth switch SW21 may be turned on by the first demultiplexer control signal CLA to connect the first fan-out line FOL1 to the first data line DL1.

In the sixth switch SW22, a gate may be connected to the fourth control line 163 for supplying a second demultiplexer control signal CLB, a first terminal may be connected to the first fan-out line FOL1, and a second terminal may be connected to the second data line DL2. The sixth switch SW22 may be turned on by the second demultiplexer control signal CLB to connect the first fan-out line FOL1 to the second data line DL2.

In the seventh switch SW23, a gate may be connected to the third control line 161 for supplying a first demultiplexer control signal CLA, a first terminal may be connected to the second fan-out line FOL2, and a second terminal may be connected to the third data line DL3. The seventh switch SW23 may be turned on by the first demultiplexer control signal CLA to connect the second fan-out line FOL2 to the third data line DL3.

In the eighth switch SW24, a gate may be connected to the fourth control line 163 for supplying a second demultiplexer control signal CLB, a first terminal may be connected to the second fan-out line FOL2, and a second terminal may be connected to the fourth data line DL4. The eighth switch SW24 may be turned on by the second demultiplexer control signal CLB to connect the second fan-out line FOL2 to the fourth data line DL4.

In the ninth switch SW25, a gate may be connected to the third control line 161 for supplying a first demultiplexer control signal CLA, a first terminal may be connected to the third fan-out line FOL3, and a second terminal may be connected to the fifth data line DL5. The ninth switch SW25 may be turned on by the first demultiplexer control signal CLA to connect the third fan-out line FOL3 to the fifth data line DL5.

In the tenth switch SW26, a gate may be connected to the fourth control line 163 for supplying a second demultiplexer control signal CLB, a first terminal may be connected to the third fan-out line FOL3, and a second terminal may be connected to the sixth data line DL6. The tenth switch SW26 may be turned on by the second demultiplexer control signal CLB to connect the third fan-out line FOL3 to the sixth data line DL6.

In the eleventh switch SW27, a gate may be connected to the third control line 161 for supplying a first demultiplexer control signal CLA, a first terminal may be connected to the fourth fan-out line FOL4, and a second terminal may be connected to the seventh data line DL7. The eleventh switch SW27 may be turned on by the first demultiplexer control signal CLA to connect the fourth fan-out line FOL4 to the seventh data line DL7.

In the twelfth switch SW28, a gate may be connected to the fourth control line 163 for supplying a second demultiplexer control signal CLB, a first terminal may be connected to the fourth fan-out line FOL4, and a second terminal may be connected to the eighth data line DL8. The twelfth switch SW28 may be turned on by the second demultiplexer control signal CLB to connect the fourth fan-out line FOL4 to the eighth data line DL8.

Although it is illustrated in FIG. 10 that two switches are arranged corresponding to one fan-out line FOL, the present invention is not limited thereto, and in some embodiments, three switches may be arranged corresponding to one fan-out line FOL. In this case, one fan-out line FOL may be connected to three or more data lines DL.

In some embodiments, the lighting circuit unit 170 includes a fifth control line 171, a sixth control line 173, a seventh control line 175, a first lighting inspection signal line 177, a second lighting inspection signal line 178, a third lighting inspection signal line 179, and switches. The fifth control line 171, the sixth control line 173, the seventh control line 175, the first lighting inspection signal line 177, the second lighting inspection signal line 178, and the third lighting inspection signal line 179 may extend in the first direction (X-axis direction), and may be spaced apart from each other in the second direction (Y-axis direction).

The switches of the lighting circuit unit 170 may include a thirteenth switch SW31 and a fourteenth switch SW32 which are connected to the first data line DL1, a fifteenth switch SW33 which is connected to the second data line D2, a sixteenth switch SW34 and a seventeenth switch SW35 which are connected to the third data line DL3, an eighteenth switch SW36 which is connected to the fourth data line D4, a nineteenth switch SW37 and a twentieth switch SW38 which are connected to the fifth data line DL5, a twenty-first switch SW39 which is connected to the sixth data line D6, a twenty-second switch SW40 and a twenty-third switch SW41 which are connected to the seventh data line DL7, and a twenty-fourth switch SW42 which is connected to the eighth data line D8.

Specifically, in the thirteenth switch SW31, a gate may be connected to the fifth control line 171 for supplying a first lighting inspection control signal TEST_GATE_R, a first terminal may be connected to the first lighting inspection signal line 177 for supplying a first lighting inspection signal DC_R, and a second terminal may be connected to the first data line DL1. The thirteenth switch SW31 may be turned on by the first lighting inspection control signal TEST_GATE_R to connect the first lighting inspection signal line 177 to the first data line DL1.

In the fourteenth switch SW32, a gate may be connected to the sixth control line 173 for supplying a second lighting inspection control signal TEST_GATE_B, a first terminal may be connected to the second lighting inspection signal line 178 for supplying a second lighting inspection signal DC_B, and a second terminal may be connected to the first data line DL1. The fourteenth switch SW32 may be turned on by the second lighting inspection control signal TEST_GATE_B to connect the second lighting inspection signal line 178 to the first data line DL1.

In the fifteenth switch SW33, a gate may be connected to the seventh control line 175 for supplying a third lighting inspection control signal TEST_GATE_G, a first terminal may be connected to the third lighting inspection signal line 179 for supplying a third lighting inspection signal DC_G, and a second terminal may be connected to the second data line DL2. The fifteen switch SW33 may be turned on by the third lighting inspection control signal TEST_GATE_G to connect the third lighting inspection signal line 179 to the second data line DL2.

In the sixteenth switch SW34, a gate may be connected to the sixth control line 173 for supplying a second lighting inspection control signal TEST_GATE_B, a first terminal may be connected to the first lighting inspection signal line 177 for supplying a first lighting inspection signal DC_R, and a second terminal may be connected to the first data line DL1. The sixteenth switch SW34 may be turned on by the second lighting inspection control signal TEST_GATE_B to connect the first lighting inspection signal line 177 to the third data line DL3.

In the seventeenth switch SW35, a gate may be connected to the fifth control line 171 for supplying a first lighting inspection control signal TEST_GATE_R, a first terminal may be connected to the second lighting inspection signal line 178 for supplying a second lighting inspection signal DC_B, and a second terminal may be connected to the third data line DL3. The seventeenth switch SW35 may be turned on by the first lighting inspection control signal TEST_GATE_R to connect the second lighting inspection signal line 178 to the third data line DL3.

In the eighteenth switch SW36, a gate may be connected to the seventh control line 175 for supplying a third lighting inspection control signal TEST_GATE_G, a first terminal may be connected to the third lighting inspection signal line 179 for supplying a third lighting inspection signal DC_G, and a second terminal may be connected to the fourth data line DL4. The eighteenth switch SW36 may be turned on by the third lighting inspection control signal TEST_GATE_G to connect the third lighting inspection signal line 179 to the fourth data line DL4.

In the nineteenth switch SW37, a gate may be connected to the fifth control line 171 for supplying a first lighting inspection control signal TEST_GATE_R, a first terminal may be connected to the first lighting inspection signal line 177 for supplying a first lighting inspection signal DC_R, and a second terminal may be connected to the fifth data line DL5. The nineteenth switch SW37 may be turned on by the first lighting inspection control signal TEST_GATE_R to connect the first lighting inspection signal line 177 to the fifth data line DL5.

In the twentieth switch SW38, a gate may be connected to the sixth control line 173 for supplying a second lighting inspection control signal TEST_GATE_B, a first terminal may be connected to the second lighting inspection signal line 178 for supplying a second lighting inspection signal DC_B, and a second terminal may be connected to the fifth data line DL5. The twentieth switch SW38 may be turned on by the second lighting inspection control signal TEST_GATE_B to connect the second lighting inspection signal line 178 to the fifth data line DL5.

In the twenty-first switch SW39, a gate may be connected to the seventh control line 175 for supplying a third lighting inspection control signal TEST_GATE_G, a first terminal may be connected to the third lighting inspection signal line 179 for supplying a third lighting inspection signal DC_G, and a second terminal may be connected to the sixth data line DL6. The twenty-first switch SW39 may be turned on by the third lighting inspection control signal TEST_GATE_G to connect the third lighting inspection signal line 179 to the sixth data line DL6.

In the twenty-second switch SW40, a gate may be connected to the sixth control line 173 for supplying a second lighting inspection control signal TEST_GATE_B, a first terminal may be connected to the first lighting inspection signal line 177 for supplying a first lighting inspection signal DC_R, and a second terminal may be connected to the seventh data line DL7. The twenty-second switch SW40 may be turned on by the second lighting inspection control signal TEST_GATE_B to connect the first lighting inspection signal line 177 to the seventh data line DL7.

In the twenty-third switch SW41, a gate may be connected to the fifth control line 171 for supplying a first lighting inspection control signal TEST_GATE_R, a first terminal may be connected to the second lighting inspection signal line 178 for supplying a second lighting inspection signal DC_B, and a second terminal may be connected to the seventh data line DL7. The twenty-third switch SW41 may be turned on by the first lighting inspection control signal TEST_GATE_R to connect the second lighting inspection signal line 178 to the seventh data line DL7.

In the twenty-fourth switch SW42, a gate may be connected to the seventh control line 175 for supplying a third lighting inspection control signal TEST_GATE_G, a first terminal may be connected to the third lighting inspection signal line 179 for supplying a third lighting inspection signal DC_G, and a second terminal may be connected to the eighth data line DL8. The twenty-fourth switch SW42 may be turned on by the third lighting inspection control signal TEST_GATE_G to connect the third lighting inspection signal line 179 to the eighth data line DL8.

The first to fourth switches SW11 to SW14, the fifth to twelfth switches SW21 to SW28, and the thirteenth to twenty-fourth switches SW31 to SW42 may be implemented as transistors. In this case, the gate, first terminal and second terminal of each of the first to fourth switches SW11 to SW14, the fifth to twelfth switches SW21 to SW28, and the thirteenth to twenty-fourth switches SW31 to SW42 may correspond to a gate electrode, a first electrode and a second electrode of the transistor, respectively, and each of the first electrode and the second electrode may be a source electrode or a drain electrode.

Explaining the inspection of the fan-out lines FOL with reference to FIG. 10 together with FIGS. 11-12, the detection of defects between adjacent fan-out lines (FOL1 and FOL3, FOL2 and FOL4, etc.) of the same layer may be performed by the inspection unit 150.

The lighting circuit unit 170 may be inactive during the inspection of the fan-out lines FOL. For example, high-level lighting inspection control signals TEST_GATE_R/G/B and lighting inspection signals DC_R/G/B may be applied to the lighting circuit unit 170.

Referring to FIG. 11, the inspection unit 150 may be activated during the inspection of the fan-out lines FOL. For example, a low-level first inspection control signal MCD_GATE1 is applied to the gates of the first and second switches SW11 and SW12, and thus the first and second switches SW11 and SW12 are turned on. Accordingly, the first fan-out line FOL1 and the second fan-out line FOL2 may be connected to the data voltage line 155.

The black data voltage VGH may be input to the data voltage line 155. However, the present invention is not limited thereto, and data voltages of different gradations may be input to the data voltage line 155. The first and second switches SW11 and SW12 are turned on, and thus the black data voltage VGH may be applied to the first fan-out line FOL1 and the second fan-out line FOL2.

Further, a high-level second inspection control signal MCD_GATE2 is applied to the gates of the third and fourth switches SW13 and SW14, and thus the third and fourth switches SW13 and SW14 maintain a turn-off state. Accordingly, the black data voltage VGH is not applied to the third fan-out line FOL3 and the fourth fan-out line FOL4. Thus, different signals from each other may be applied to the first fan-out line FOL1 and the third fan-out line FOL3 adjacent to the same layer. That is, the black data voltage VGH is applied to the first fan-out line FOL1, and the black data voltage VGH is not applied to the third fan-out line FOL3. Further, different signals from each other may be applied to the second fan-out line FOL2 and the fourth fan-out line FOL4 adjacent to the same layer. That is, the black data voltage VGH is applied to the second fan-out line FOL2, and the black data voltage VGH is not applied to the fourth fan-out line FOL4.

The demultiplexer unit 160 may be activated during the inspection of the fan-out lines FOL. For example, a low-level first demultiplexer control signal CLA and a low-level second demultiplexer control signal CLB are applied to the gates of the fifth to twelfth switches SW21 to SW28, and thus the fifth to twelfth switches SW21 to SW28 are turned on.

The first fan-out line FOL1 may be connected to the first data line DL1 and the second data line DL2 by the turn-on of the fifth switch SW21 and the sixth switch SW22, the second fan-out line FOL2 may be connected to the third data line DL3 and the fourth data line DL4 by the turn-on of the seventh switch SW23 and the eighth switch SW24, the third fan-out line FOL3 may be connected to the fifth data line DL5 and the sixth data line DL6 by the turn-on of the ninth switch SW25 and the tenth switch SW26, and the fourth fan-out line FOL4 may be connected to the seventh data line DL7 and the eighth data line DL8 by the turn-on of the eleventh switch SW27 and the twelfth switch SW28.

Accordingly, black is displayed in the sub-pixels SP connected to the first data line DL1 and the second data line DL2 connected to the first fan-out line FOL1, black is displayed in the sub-pixels SP connected to the third data line DL3 and the fourth data line DL4 connected to the second fan-out line FOL2, white is displayed in the sub-pixels SP connected to the fifth data line DL5 and the sixth data line DL6 connected to the third fan-out line FOL3, and white is displayed in the sub-pixels SP connected to the seventh data line DL7 and the eighth data line DL8 connected to the fourth fan-out line FOL4.

Because voltages of different gradations are applied to the first fan-out line FOL1 and the third fan-out line FOL3 which are adjacent to the same layer, whether or not the first fan-out line FOL1 and the third fan-out line FOL3 are defective may be determined through the lighting states of the sub-pixels SP connected to the first fan-out line FOL1 and the third fan-out line FOL3. For example, when the first fan-out line FOL1 and the third fan-out line FOL3 are shorted (e.g., electrically shorted), the sub-pixel SP connected to the third fan-out line FOL3 displays black or dark lines. Therefore, it is possible to easily determine whether or not the first fan-out line FOL1 and the third fan-out line FOL3 are shorted. When the first fan-out line FOL1 is open (e.g., electrically open or disconnected), the sub-pixel SP connected to the first fan-out line FOL1 displays white, Therefore, it is possible to easily determine whether or not the first fan-out line FOL1 is open.

Because voltages of different gradations are applied to the second fan-out line FOL2 and the fourth fan-out line FOL4 which are adjacent to the same layer, whether or not the second fan-out line FOL2 and the fourth fan-out line FOL4 are defective may be determined through the lighting states of the sub-pixels SP connected to the second fan-out line FOL2 and the fourth fan-out line FOL4. For example, when the second fan-out line FOL2 and the fourth fan-out line FOL4 are shorted, the sub-pixel SP connected to the fourth fan-out line FOL4 displays black or dark lines. Therefore, it is possible to easily determine whether or not the second fan-out line FOL2 and the fourth fan-out line FOL4 are shorted. When the second fan-out line FOL2 is open, the sub-pixel SP connected to the second fan-out line FOL2 displays white. Therefore, it is possible to easily determine whether or not the second fan-out line FOL2 is open.

Referring to FIG. 12, the inspection unit 150 may be activated during the inspection of the fan-out lines FOL. For example, a low-level second inspection control signal MCD_GATE2 is applied to the gates of the third and fourth switches SW13 and SW14, and thus the third and fourth switches SW13 and SW14 are turned on. Accordingly, the third fan-out line FOL3 and the fourth fan-out line FOL4 may be connected to the data voltage line 155.

The black data voltage VGH may be input to the data voltage line 155. However, the present invention is not limited thereto, and data voltages of different gradations may be input to the data voltage line 155. The third and fourth switches SW13 and SW14 are turned on, and thus the black data voltage VGH may be applied to the third fan-out line FOL3 and the fourth fan-out line FOL4.

Further, a high-level first inspection control signal MCD_GATE1 is applied to the gates of the first and second switches SW11 and SW12, and thus the first and second switches SW11 and SW12 maintain a turn-off state. Accordingly, the black data voltage VGH is not applied to the first fan-out line FOL1 and the second fan-out line FOL2. Thus, different signals from each other may be applied to the first fan-out line FOL1 and the third fan-out line FOL3 adjacent to the same layer. That is, the black data voltage VGH is not applied to the first fan-out line FOL1, and the black data voltage VGH is applied to the third fan-out line FOL3. Further, different signals from each other may be applied to the second fan-out line FOL2 and the fourth fan-out line FOL4 adjacent to the same layer. That is, the black data voltage VGH is not applied to the second fan-out line FOL2, and the black data voltage VGH is applied to the fourth fan-out line FOL4.

The demultiplexer unit 160 may be activated during the inspection of the fan-out lines FOL. For example, a low-level first demultiplexer control signal CLA and a low-level second demultiplexer control signal CLB are applied to the gates of the fifth to twelfth switches SW21 to SW28, and thus the fifth to twelfth switches SW21 to SW28 are turned on.

The first fan-out line FOL1 may be connected to the first data line DL1 and the second data line DL2 by the turn-on of the fifth switch SW21 and the sixth switch SW22, the second fan-out line FOL2 may be connected to the third data line DL3 and the fourth data line DL4 by the turn-on of the seventh switch SW23 and the eighth switch SW24, the third fan-out line FOL3 may be connected to the fifth data line DL5 and the sixth data line DL6 by the turn-on of the ninth switch SW25 and the tenth switch SW26, and the fourth fan-out line FOL4 may be connected to the seventh data line DL7 and the eighth data line DL8 by the turn-on of the eleventh switch SW27 and the twelfth switch SW28.

Accordingly, white is displayed in the sub-pixels SP connected to the first data line DL1 and the second data line DL2 connected to the first fan-out line FOL1, white is displayed in the sub-pixels SP connected to the third data line DL3 and the fourth data line DL4 connected to the second fan-out line FOL2, black is displayed in the sub-pixels SP connected to the fifth data line DL5 and the sixth data line DL6 connected to the third fan-out line FOL3, and black is displayed in the sub-pixels SP connected to the seventh data line DL7 and the eighth data line DL8 connected to the fourth fan-out line FOL4.

Because voltages of different gradations are applied to the first fan-out line FOL1 and the third fan-out line FOL3 which are adjacent to the same layer, whether or not the first fan-out line FOL1 and the third fan-out line FOL3 are defective may be determined through the lighting states of the sub-pixels SP connected to the first fan-out line FOL1 and the third fan-out line FOL3. For example, when the first fan-out line FOL1 and the third fan-out line FOL3 are shorted, the sub-pixel SP connected to the third fan-out line FOL3 displays black or dark lines. Therefore, it is possible to easily determine whether or not the first fan-out line FOL1 and the third fan-out line FOL3 are shorted. When the third fan-out line FOL3 is open, the sub-pixel SP connected to the third fan-out line FOL3 displays white. Therefore, it is possible to easily determine whether or not the first fan-out line FOL1 or the third fan-out line FOL3 is open.

Because voltages of different gradations are applied to the second fan-out line FOL2 and the fourth fan-out line FOL4 which are adjacent to the same layer, whether or not the second fan-out line FOL2 and the fourth fan-out line FOL4 are defective may be determined through the lighting states of the sub-pixels SP connected to the second fan-out line FOL2 and the fourth fan-out line FOL4. For example, when the second fan-out line FOL2 and the fourth fan-out line FOL4 are shorted, the sub-pixel SP connected to the fourth fan-out line FOL4 displays black or dark lines. Therefore, it is possible to easily determine whether or not the second fan-out line FOL2 and the fourth fan-out line FOL4 are shorted. When the fourth fan-out line FOL4 is open, the sub-pixel SP connected to the fourth fan-out line FOL4 displays white. Therefore, it is possible to easily determine whether or not the fourth fan-out line FOL4 is open.

Referring to FIG. 13, the lighting circuit unit 170 may be inactive during the inspection of the fan-out lines FOL. For example, high-level lighting inspection control signals TEST_GATE_R/G/B and lighting inspection signals DC_R/G/B are applied to the lighting circuit unit 170.

The demultiplexer unit 160 may be activated during crack inspection. For example, a low-level first demultiplexer control signal CLA and a low-level second demultiplexer control signal CLB are applied to the gates of the fifth to twelfth switches SW21 to SW28, and thus the fifth to twelfth switches SW21 to SW28 are turned on.

The inspection unit 150 may be activated during crack inspection. For example, a low-level first inspection control signal MCD_GATE1 and a low-level second inspection control signal CLB are applied to the gates of the first to third switches SW11 to SW14, and thus the first to third switches SW11 to SW14 are turned on. Accordingly, the first to fourth fan-out lines FOL1 to FOL4 may be connected to the data voltage line 155.

A test voltage may be input to the data voltage line 155. For example, the test voltage may be the black data voltage VGH, and may be a voltage allowing the sub-pixels R, G, and B to display lowest gradation. The test voltage may circulate the crack detection line CDL of FIG. 2 and input to the first to fourth fan-out lines FOL1 to FOL4. In this case, when there is no damage to the crack detection line CDL, the voltages applied to the first to fourth fan-out lines FOL1 to FOL4 may be substantially equal to the test voltage. For example, when the test voltage is the black data voltage VGH, the sub-pixels SP connected to the first to fourth fan-out lines FOL1 to FOL4 may display black. When the crack detection line CDL is damaged, the resistance of the crack detection line CDL may increase. Therefore, the voltage circulating the crack detection line CDL and applied to the first to fourth fan-out lines FOL1 to FOL4 may be lower than the test voltage. For example, when the test voltage is the black data voltage VGH and a crack has occurred in the display panel 100 damaging the crack detection line CDL, bright lines may be visually recognized in the sub-pixels SP connected to the first through fourth fan-out lines FOL1 through FOL4. It is possible to easily determine whether a crack occurs in the display panel 100 through the bright lines. In other words, the bright lines indicate that a crack has occurred in the display panel 100.

As described above, according to the present embodiment, it is possible to perform a defect inspection of the fan-out lines FOL and a crack inspection of the display panel 100 through one inspection unit 150. Thus, because it is not required to provide a circuit unit for the defect inspection of the fan-out lines FOL and a circuit unit for the crack inspection of the display panel 100, the dead space of the display device 10 can be effectively reduced.

Figure 14:
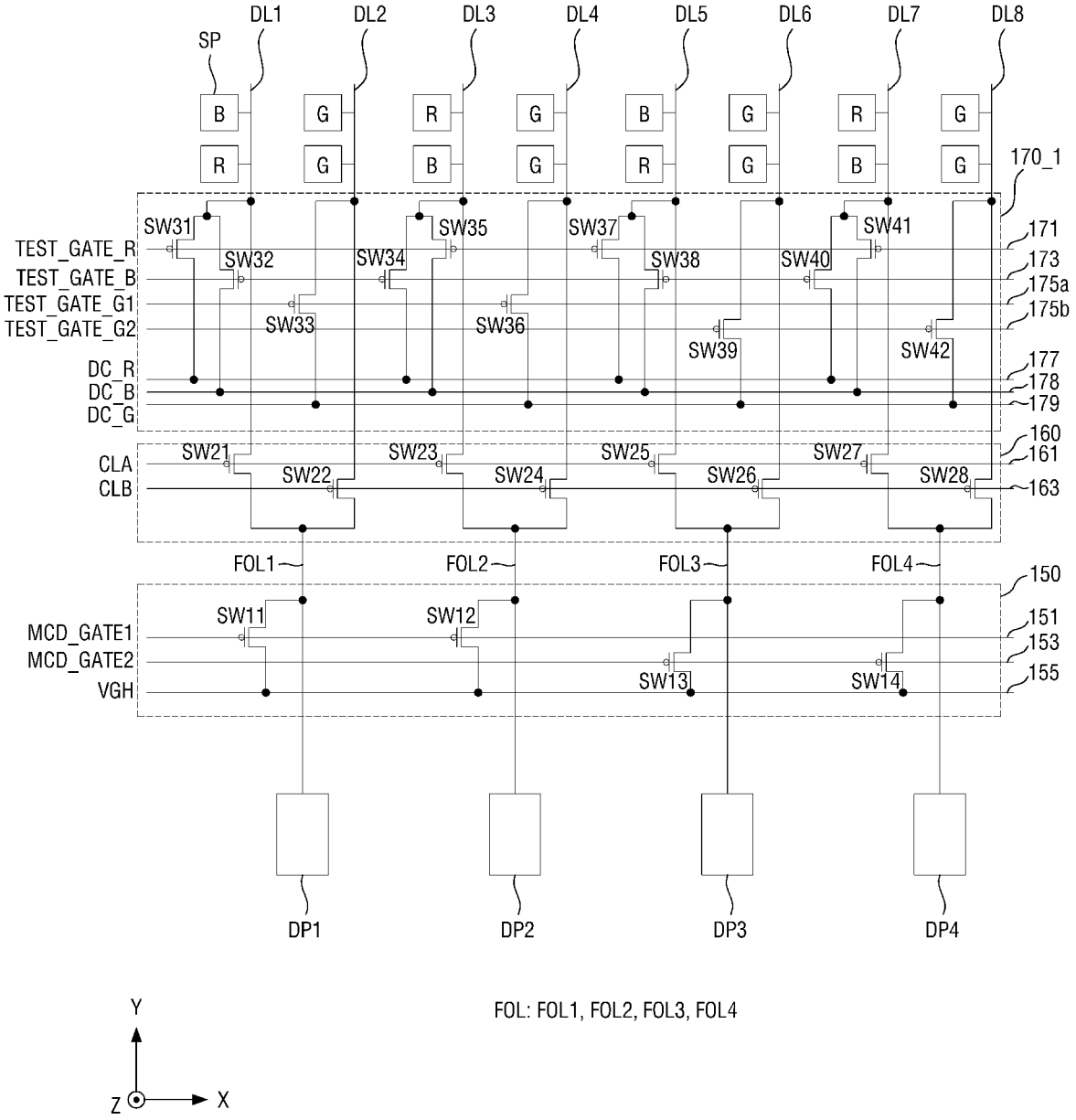
FIG. 14 is a diagram showing a circuit configuration of a display device according to an embodiment.
Figure 15:
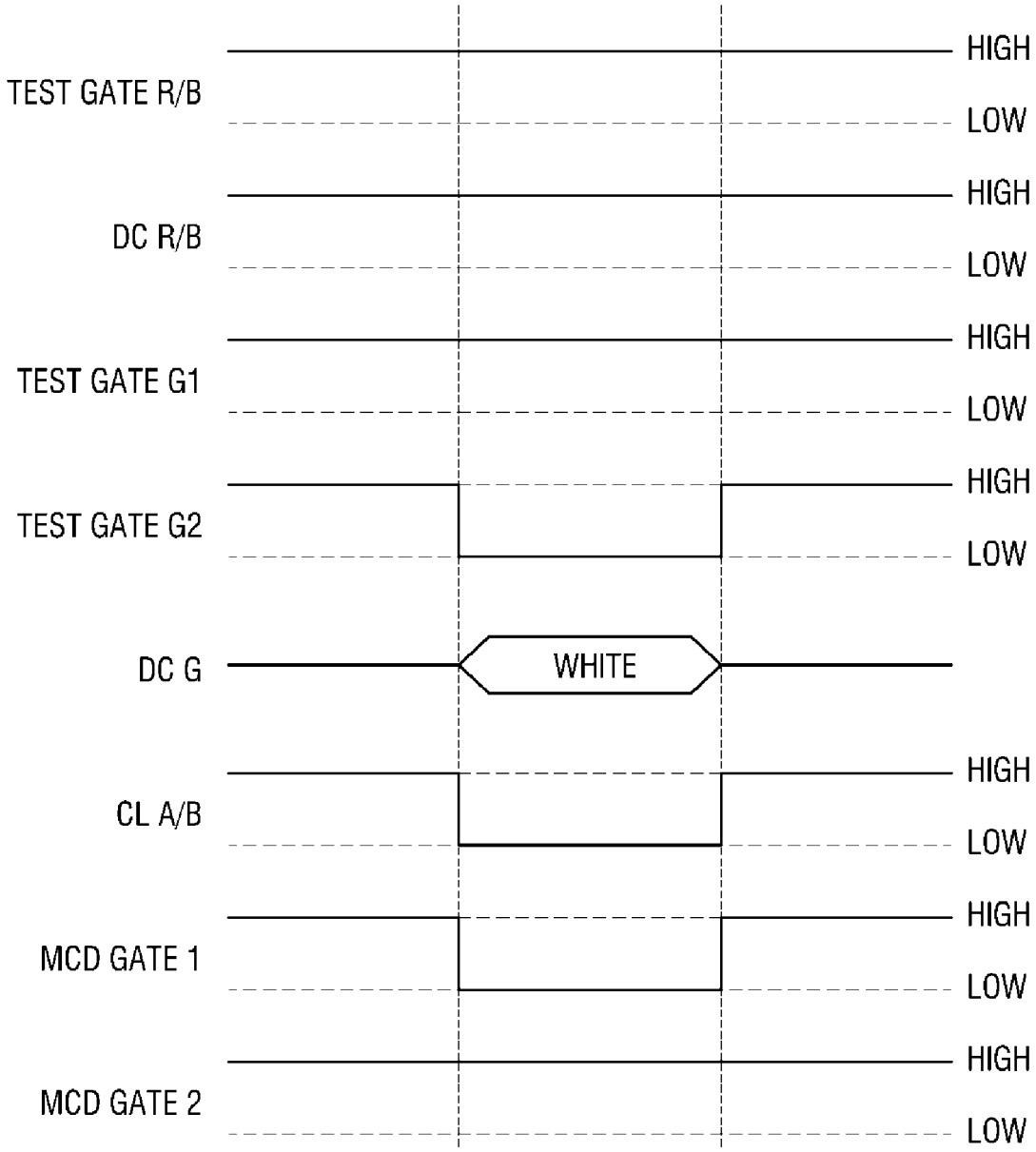
FIGS. 15-16 are timing charts for explaining a fan-out line inspection in a display device according to an embodiment.
Figure 16:
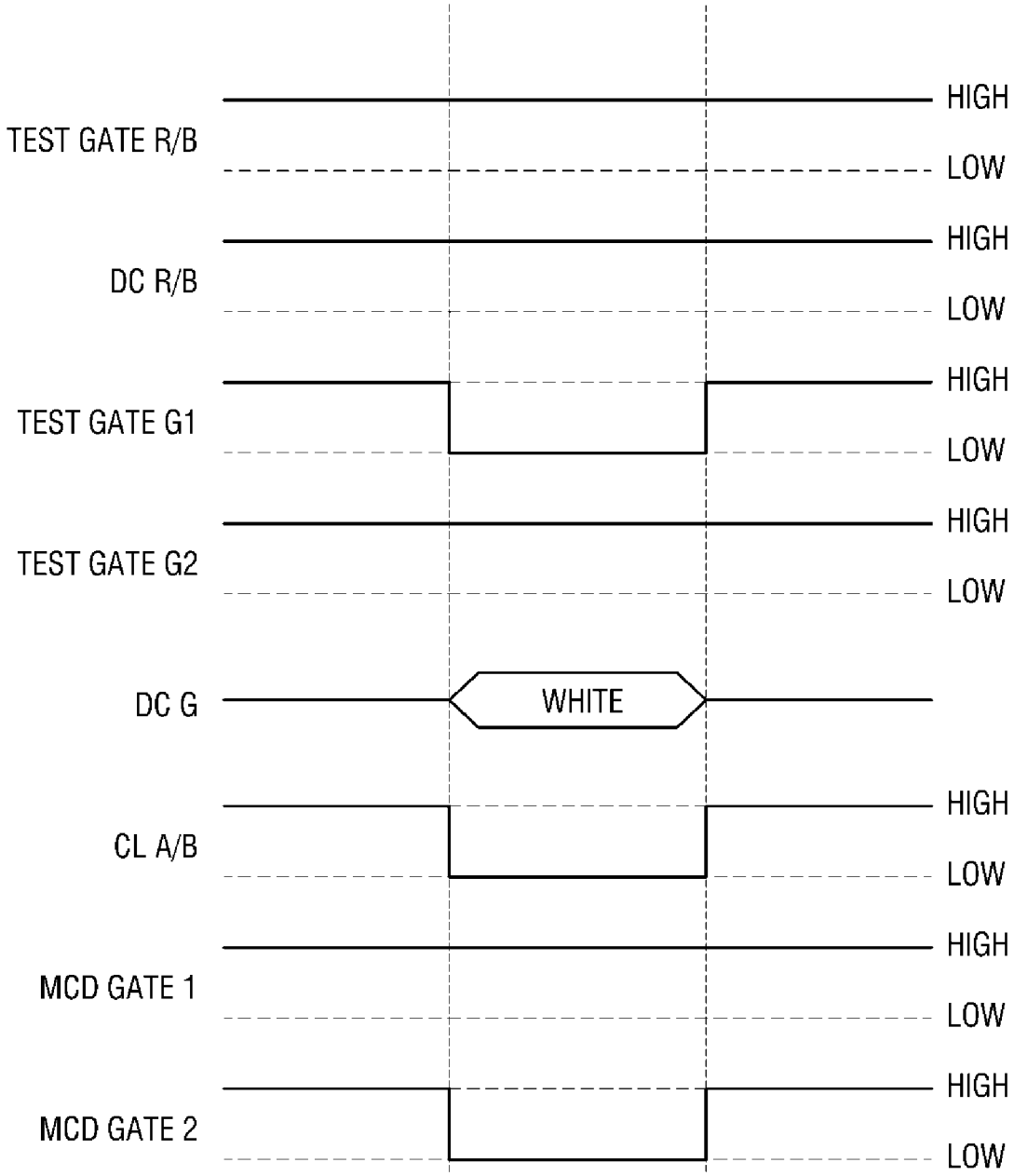
Figure 17:
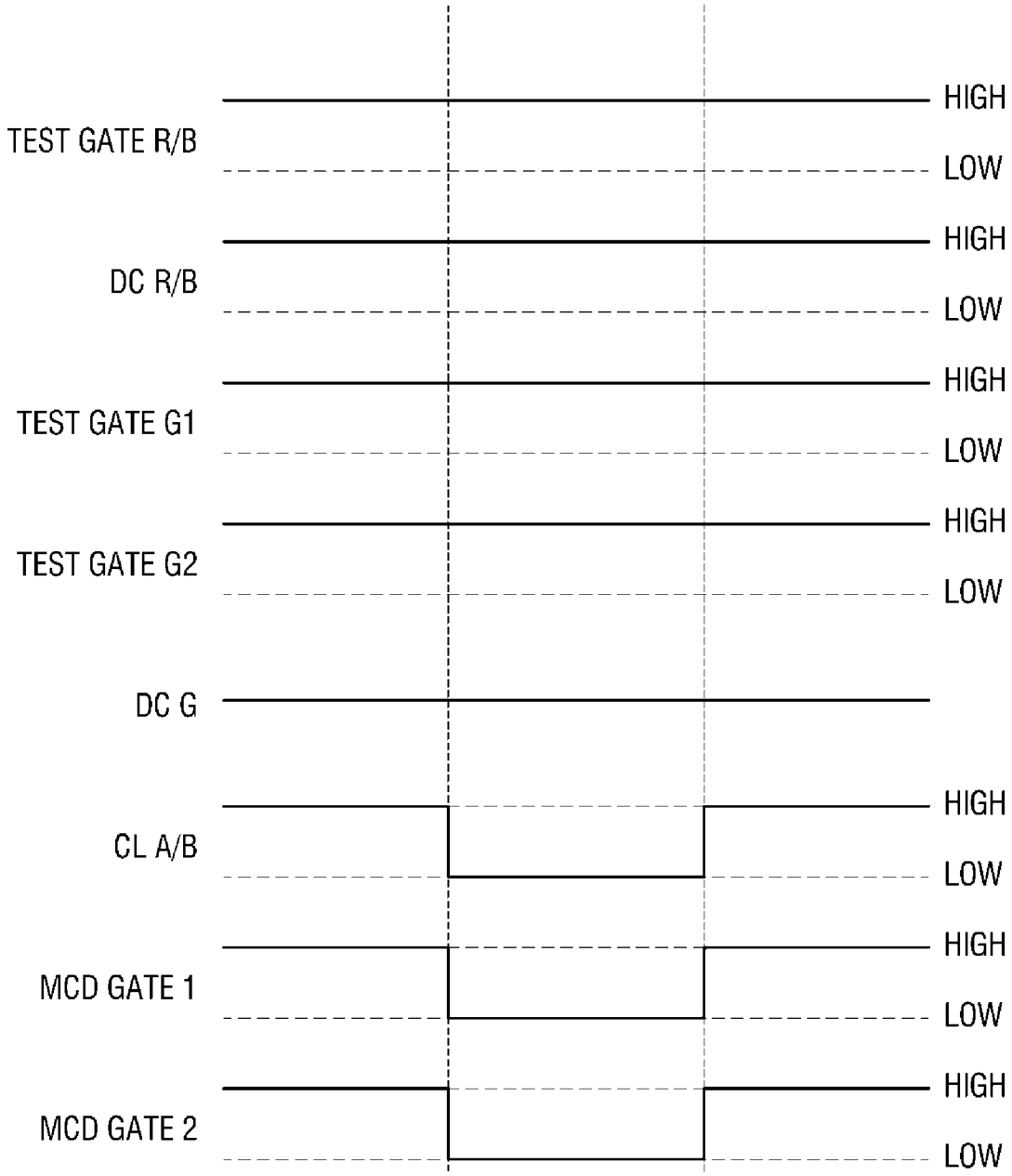
FIG. 17 is a timing chart for explaining a crack inspection in a display device according to an embodiment.

FIG. 14 is a diagram showing a circuit configuration of a display device according to an embodiment, FIGS. 15-16 are timing charts for explaining a fan-out line inspection in a display device according to an embodiment, and FIG. 17 is a timing chart for explaining a crack inspection in a display device according to an embodiment. The embodiment of FIGS. 14-17 is different from the embodiment of FIGS. 10-13 in that the seventh control line of a lighting circuit unit 170_1 includes a seventh-ath control line 175*a* and a seventh-bth control line 175*b*. A description redundant to that of the embodiment of FIGS. 10-13 may be omitted, and differences may be primarily described.

Referring to FIGS. 14-17, in some embodiment, a lighting circuit unit 170_1 may include a fifth control line 171, a sixth control line 173, a seventh-ath control line 175*a*, a seventh-bth control line 175*b*, a first lighting inspection signal line 177, a second lighting inspection signal line 178, a third lighting inspection signal line 179, and switches. The fifth control line 171, the sixth control line 173, the seventh-ath control line 175*a*, the seventh-bth control line 175*b*, the first lighting inspection signal line 177, the second lighting inspection signal line 178, and the third lighting inspection signal line 179 may extend in the first direction (X-axis direction), and may be spaced apart from each other in the second direction (Y-axis direction).

The switches of the lighting circuit unit 170_1 may include a thirteenth SW31 and a fourteenth SW32 which are connected to the first data line DL1, a fifteenth switch SW33 connected to the second data line DL2, a sixteenth switch SW34 and a seventeenth switch SW35 which are connected to the third data line DL3, an eighteenth switch SW36 connected to the fourth data line DL4, a nineteenth switch SW37 and a twentieth switch SW38 which are connected to the fifth data line DL5, a twenty-first switch SW39 connected to the sixth data line DL6, a twenty-second switch SW40 and a twenty-third switch SW41 which are connected to the seventh data line DL7, and a twenty-fourth switch SW42 connected to the eighth data line DL8. Because the connection structure of the thirteenth switch SW31, the fourteenth switch SW32, the sixteenth switch SW34, the seventeenth switch SW35, the nineteenth switch SW37, the twentieth switch SW38, the twenty-second switch SW40, and the twenty-third switch SW41 is the same as that of the embodiment of FIG. 10, a redundant description may be omitted.

In the fifteenth switch SW33, a gate may be connected to the seventh-ath control line 175*a* for supplying a third-first lighting inspection control signal TEST_GATE_G1, a first terminal may be connected to the third lighting inspection signal line 179 for supplying a third lighting inspection signal DC_G, and a second terminal may be connected to the second data line DL2. The fifteenth switch SW33 may be turned on by the third-first lighting inspection control signal TEST_GATE_G1 to connect the third lighting inspection signal line 179 and the second data line DL2.

In the eighteenth switch SW36, a gate may be connected to the seventh-ath control line 175*a* for supplying a third-first lighting inspection control signal TEST_GATE_G1, a first terminal may be connected to the third lighting inspection signal line 179 for supplying a third lighting inspection signal DC_G, and a second terminal may be connected to the fourth data line DL4. The eighteenth switch SW36 may be turned on by the third-first lighting inspection control signal TEST_GATE_G1 to connect the third lighting inspection signal line 179 and the fourth data line DL4.

In the twenty-first switch SW39, a gate may be connected to the seventh-bth control line 175*b* for supplying a third-second lighting inspection control signal TEST_GATE_G2, a first terminal may be connected to the third lighting inspection signal line 179 for supplying a third lighting inspection signal DC_G, and a second terminal may be connected to the sixth data line DL6. The twenty first switch SW39 may be turned on by the third-second lighting inspection control signal TEST_GATE_G2 to connect the third lighting inspection signal line 179 and the sixth data line DL6.

In the twenty-fourth switch SW42, a gate may be connected to the seventh-bth control line 175*b* for supplying a third-second lighting inspection control signal TEST_GATE_G2, a first terminal may be connected to the third lighting inspection signal line 179 for supplying a third lighting inspection signal DC_G, and a second terminal may be connected to the eighth data line DL8. The twenty-fourth switch SW42 may be turned on by the third-second lighting inspection control signal TEST_GATE_G2 to connect the third lighting inspection signal line 179 and the eighth data line DL8.

As described above, the fifteenth and eighteenth switches SW33 and SW36 may be turned on by the third-first lighting control signal TEST_GATE_G1, and the twenty-first and twenty-fourth switches SW39 and SW42 may be turned on by the third-second lighting inspection control signal TEST_GATE_G2.

Explaining the inspection of the fan-out lines FOL with reference to FIG. 14 together with FIGS. 15-16, the detection of defects between adjacent fan-out lines (FOL1 and FOL3, FOL2 and FOL4, etc.) of the same layer may be performed by the inspection unit 150.

The lighting circuit unit 170_1 may be activated during the inspection of the fan-out lines FOL. For example, a low-level third-first lighting control signal TEST_GATE_G1 and a low-level third-second lighting inspection control signal TEST_GATE_G2 may be applied to the seventh-ath control line 175*a* and the seventh-bth control line 175*b*. For example, referring to FIG. 15, the low-level third-second lighting inspection control signal TEST_GATE_G2 is applied to the gates of the twenty-first and twenty-fourth switches SW39 and SW42, and thus the twenty-first and twenty-fourth switches SW39 and SW42 are turned on. Accordingly, the sixth data line DL6 and the eighth data line DL8 may be connected to the third lighting inspection signal line 179.

The third lighting inspection signal DC_G applied to the third lighting inspection signal line 179 may be a white data voltage. However, the present invention is not limited thereto, and the third lighting inspection signal DC_G may be a data voltage of different gradation that can be distinguished from a black data voltage.

The demultiplexer unit 160 may be activated during the inspection of the fan-out lines FOL. For example, a low-level first demultiplexer control signal CLA and a low-level second demultiplexer control signal CLB are applied to the gates of the fifth to twelfth switches SW21 to SW28, and thus the fifth to twelfth switches SW21 to SW28 are turned on.

The inspection unit 150 may be activated during the inspection of the fan-out lines FOL. For example, a low-level first inspection control signal MCD_GATE1 is applied to the gates of the first and second switches SW11 and SW12, and thus the first and second switches SW11 and SW12 are turned on. Accordingly, the first fan-out line FOL1 and the second fan-out line FOL2 may be connected to the data voltage line 155.

Accordingly, black is displayed in the sub-pixels SP connected to the first data line DL1 and the second data line DL2 connected to the first fan-out line FOL1, black is displayed in the sub-pixels SP connected to the third data line DL3 and the fourth data line DL4 connected to the second fan-out line FOL2, white is displayed in the sub-pixels SP connected to the fifth data line DL5 and the sixth data line DL6 connected to the third fan-out line FOL3, and white is displayed in the sub-pixels SP connected to the seventh data line DL7 and the eighth data line DL8 connected to the fourth fan-out line FOL4.

Further, a white data voltage is applied to the sixth data line DL6 and the eighth data line DL8 by the third lighting inspection signal DC_G applied to the third lighting inspection signal line 179. Accordingly, the luminance of the sub-pixels SP connected to the sixth data line DL6 and the eighth data line DL8 may be adjusted during the defect inspection. Thus, when the first fan-out line FOL1 and third fan-out line FOL3 adjacent to the same layer are shorted, dark lines generated in the sub-pixel SP connected to the third fan-out line FOL3 may be easily distinguished, and when the second fan-out line FOL2 and the fourth fan-out line FOL4 adjacent to the same layer are shorted, dark lines generated in the sub-pixel SP connected to the fourth fan-out line FOL4 may be easily distinguished.

Referring to FIG. 16, the low-level third-first lighting inspection control signal TEST_GATE_G1 is applied to the gates of the fifteenth and eighteenth switches SW33 and SW36, and thus the fifteenth and eighteenth switches SW33 and SW36 are turned on. Accordingly, the second data line DL2 and the fourth data line DL4 may be connected to the third lighting inspection signal line 179.

The low-level second inspection control signal MCD_GATE2 is applied to the gates of the third and fourth switches SW13 and SW14, and thus the third and fourth switches SW13 and SW14 are turned on. Accordingly, the third fan-out line FOL3 and the fourth fan-out line FOL4 may be connected to the data voltage line 155.

Accordingly, white is displayed in the sub-pixels SP connected to the first data line DL1 and second data line DL2 connected to the first fan-out line FOL1, white is displayed in the sub-pixels SP connected to the third data line DL3 and fourth data line DL4 connected to the second fan-out line FOL2, black is displayed in the sub-pixels SP connected to the fifth data line DL5 and sixth data line DL6 connected to the third fan-out line FOL3, and black is displayed in the sub-pixels SP connected to the seventh data line DL7 and eighth data line DL8 connected to the fourth fan-out line FOL4.

Further, a white data voltage is applied to the second data line DL2 and the fourth data line DL4 by the third lighting inspection signal DC_G applied to the third lighting inspection signal line 179. Accordingly, the luminance of the sub-pixels SP connected to the second data line DL2 and the fourth data line DL4 may be adjusted during the defect inspection. Thus, when the first fan-out line FOL1 and the third fan-out line FOL3 adjacent to the same layer are shorted, dark lines generated in the sub-pixel SP connected to the first fan-out line FOL1 may be easily distinguished, and when the second fan-out line FOL2 and the fourth fan-out line FOL4 adjacent to the same layer are shorted, dark lines generated in the sub-pixel SP connected to the second fan-out line FOL2 may be easily distinguished.

Referring to FIG. 17, the lighting circuit unit 170_1 may be inactive during the crack inspection. For example, a high-level third lighting inspection control signal TEST_GATE_G1 and a high-level third lighting inspection control signal TEST_GATE_G2 may be applied to the seventh-ath control line 175*a* and the seventh-bth control line 175*b*. Because other contents of the crack inspection are the same as those in FIG. 13, a redundant description may be omitted.

Figure 18:
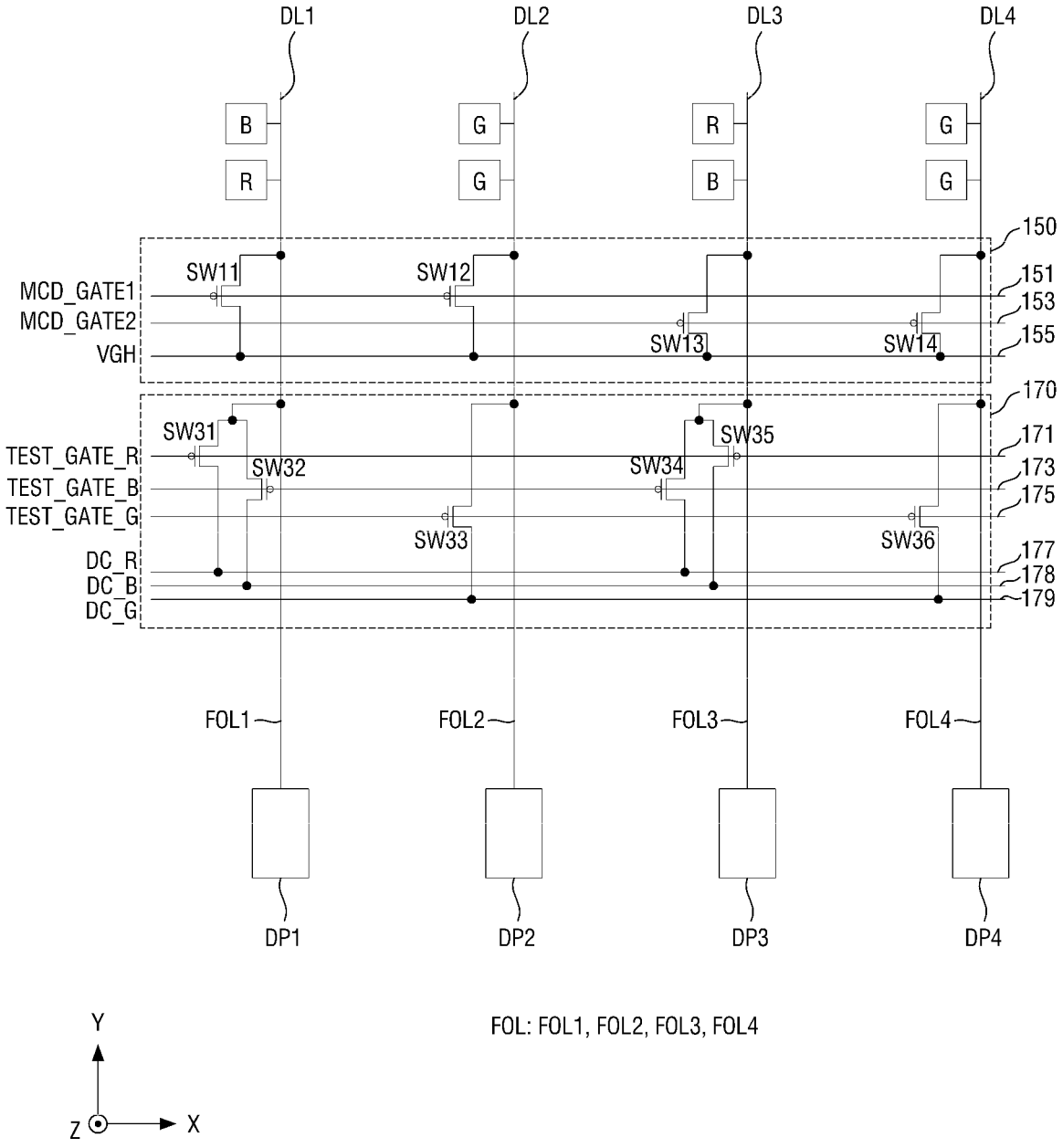
FIG. 18 is a diagram showing a circuit configuration of a display device according to an embodiment.
Figure 19:
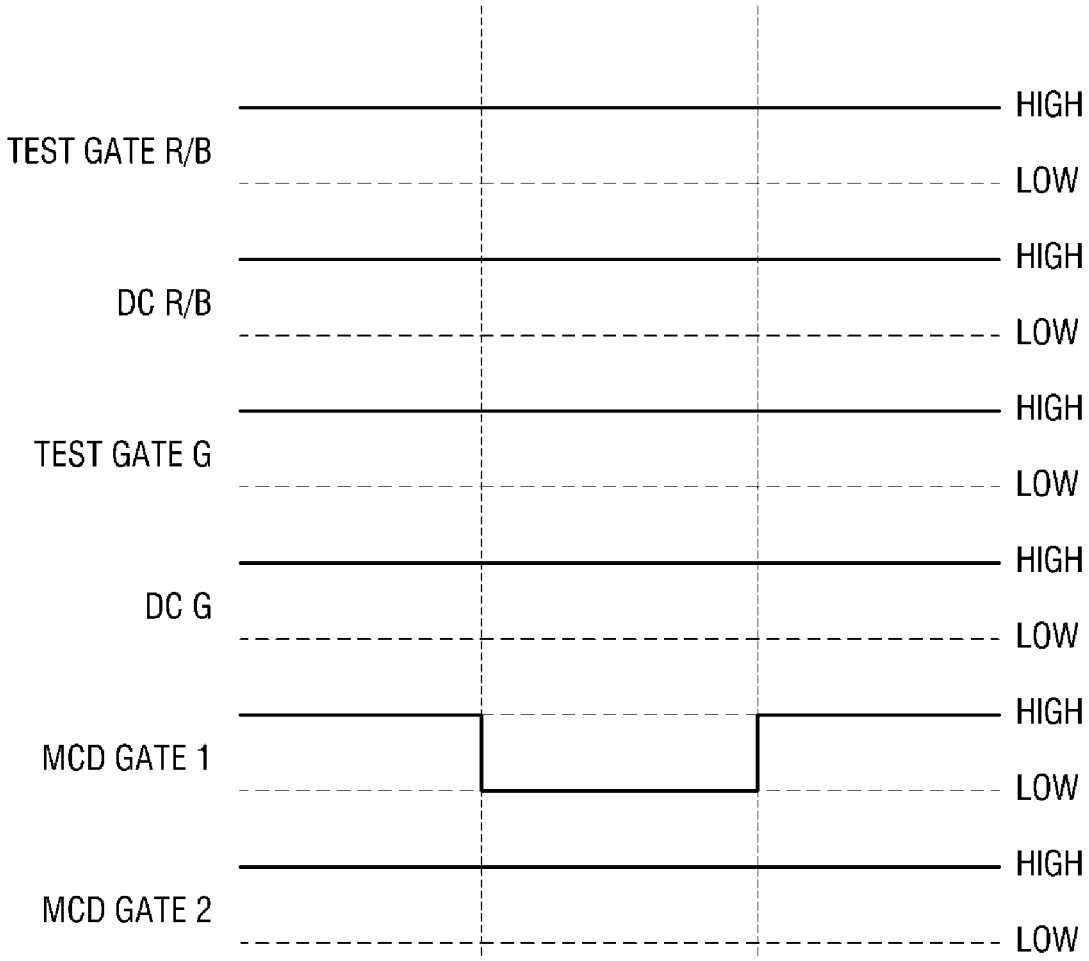
FIGS. 19-20 are timing charts for explaining a fan-out line inspection in a display device according to an embodiment.
Figure 20:
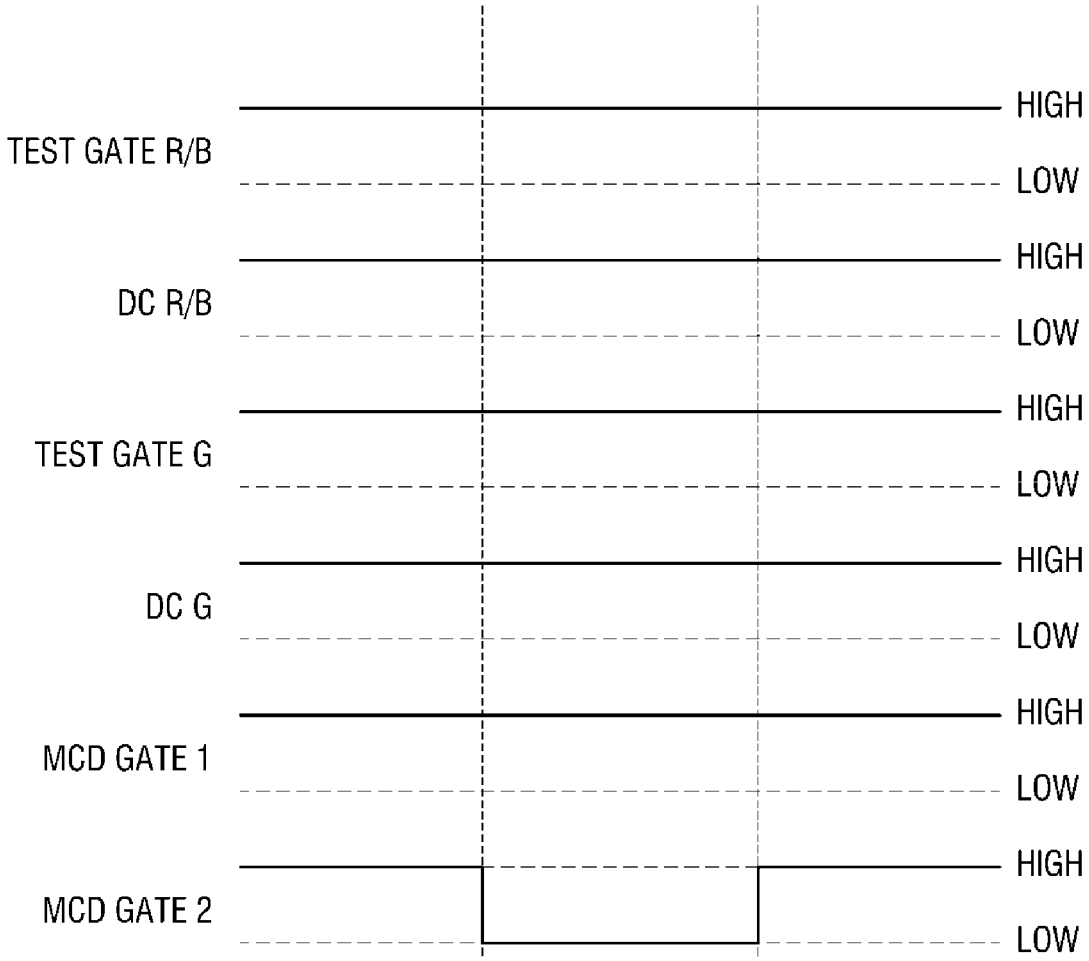
Figure 21:
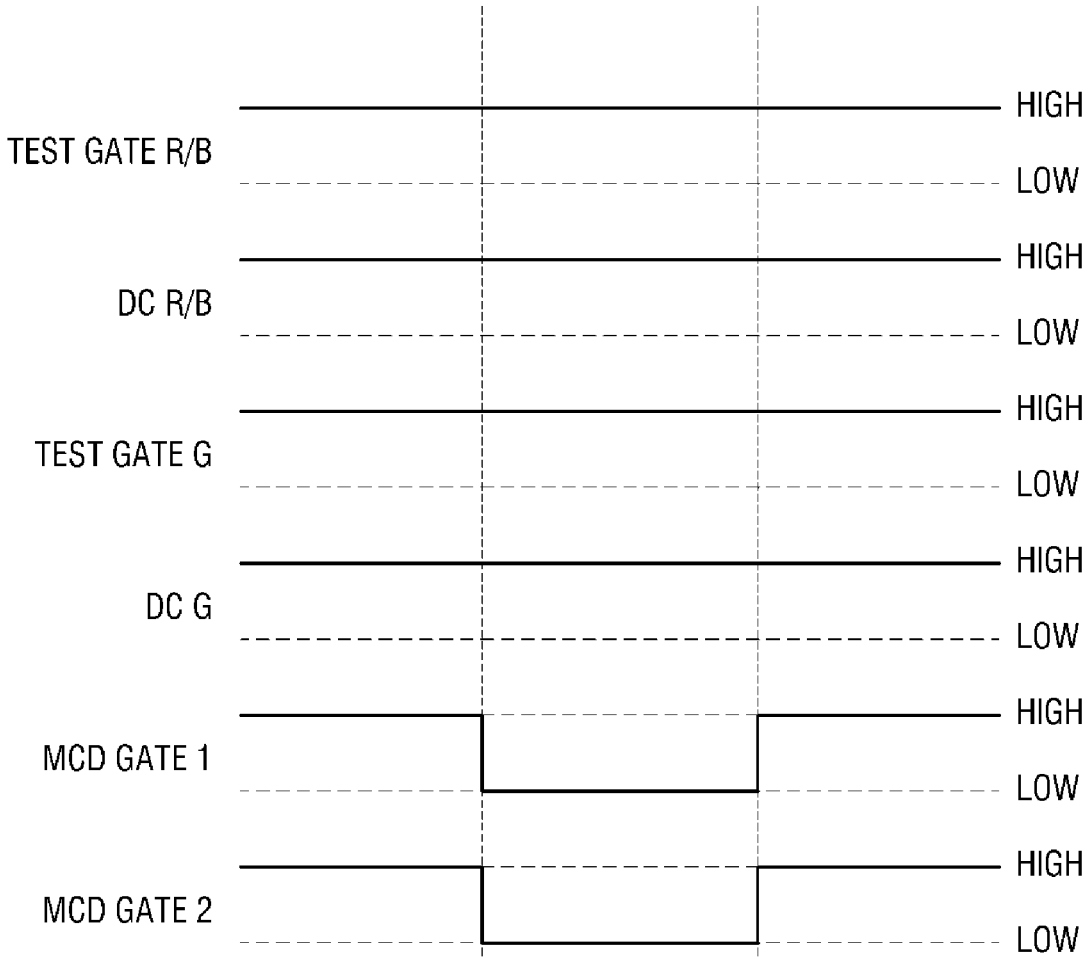
FIG. 21 is a timing chart for explaining a crack inspection in a display device according to an embodiment.

FIG. 18 is a diagram showing a circuit configuration of a display device according to an embodiment, FIGS. 19-20 are timing charts for explaining a fan-out line inspection in a display device according to an embodiment, and FIG. 21 is a timing chart for explaining a crack inspection in a display device according to an embodiment. The embodiment of FIGS. 18-21 is different from the embodiment of FIGS. 10-13 in that the demultiplexer unit ('160' in FIG. 10) is omitted. A description redundant to that of the embodiment of FIGS. 10-13 may be omitted, and differences may be primarily described.

Referring to FIG. 18, an inspection unit 150 and a lighting circuit unit 170 may be disposed between the sub-pixels SP and the wiring pads DP1, DP2, DP3, and DP4. Illustratively, the inspection unit 150 may be disposed adjacent to the sub-pixels SP, and the lighting circuit unit 170 may be disposed between the inspection unit 150 and the wiring pads DP1, DP2, DP3, and DP4.

Because the connection relationship between the inspection unit 150 and the lighting circuit unit 170 is the same as that of FIG. 10, a redundant description may be omitted.

In the embodiment of FIG. 18, the demultiplexer unit ('160' in FIG. 10) is omitted, and thus the fan-out lines FOL1, FOL2, FOL3, and FOL4 are connected one to one with the data lines DL1, DL2, DL3, and DL4. Illustratively, the first fan-out line FOL1 may connect the first wiring pad DP1 and the first data line DL1, the second fan-out line FOL2 may connect the second wiring pad DP2 and the second data line DL2, the third fan-out line FOL3 may connect the third wiring pad DP3 and the third data line DL3, and the fourth fan-out line FOL4 may connect the fourth wiring pad DP4 and the fourth data line DL4.

Referring to FIG. 19, during the inspection of the fan-out lines FOL, a low-level first inspection control signal MCD_GATE1 may be applied to the gates of the first and second switches SW11 and SW12 to turn on the first and second switches SW11 and SW12, and thus a black data voltage VGH may be applied to the first fan-out line FOL1 and the second fan-out line FOL2.

During the inspection of the fan-out lines FOL, a high-level second inspection control signal MCD_GATE2 may be applied to the gates of the third and fourth switches SW13 and SW14, and thus a black data voltage VGH may not be applied to the third fan-out line FOL3 and the fourth fan-out line FOL4.

Accordingly, black is displayed in the sub-pixel SP connected to the first data line DL1 connected to the first fan-out line FOL1 and the pixel SP connected to the second data line DL1 connected to the second fan-out line FOL2, and white is displayed in the sub-pixel SP connected to the third data line DL3 connected to the third fan-out line FOL3 and the pixel SP connected to the fourth data line DL4 connected to the third fan-out line FOL3.

When the first fan-out line FOL1 and the third fan-out line FOL3 are shorted, the sub-pixel SP connected to the third fan-out line FOL3 displays black or dark lines. Therefore, it is possible to easily determine whether or not the first fan-out line FOL1 and the third fan-out line FOL3 are shorted. When the first fan-out line FOL1 is open, the sub-pixel SP connected to the first fan-out line FOL1 displays white. Therefore, it is possible to easily determine whether or not the first fan-out line FOL1 is open.

When the second fan-out line FOL2 and the fourth fan-out line FOL4 are shorted, the sub-pixel SP connected to the fourth fan-out line FOL4 displays black or dark lines. Therefore, it is possible to easily determine whether or not the second fan-out line FOL2 and the fourth fan-out line FOL4 are shorted. When the second fan-out line FOL2 is open, the sub-pixel SP connected to the second fan-out line FOL2 displays white. Therefore, it is possible to easily determine whether or not the second fan-out line FOL2 is open.

Referring to FIG. 20, during the inspection of the fan-out lines FOL, a low-level second inspection control signal MCD_GATE2 may be applied to the gates of the third and fourth switches SW13 and SW14 to turn on the third and fourth switches SW13 and SW14, and thus a black data voltage VGH may be applied to the third fan-out line FOL3 and the fourth fan-out line FOL4.

During the inspection of the fan-out lines FOL, a high-level first inspection control signal MCD_GATE1 may be applied to the gates of the first and second switches SW11 and SW12, and thus a black data voltage VGH may not be applied to the first fan-out line FOL1 and the second fan-out line FOL2.

Accordingly, white is displayed in the sub-pixel SP connected to the first data line DL1 connected to the first fan-out line FOL1 and the pixel SP connected to the second data line DL2 connected to the second fan-out line FOL2, and black is displayed in the sub-pixel SP connected to the third data line DL3 connected to the third fan-out line FOL3 and the pixel SP connected to the fourth data line DL4 connected to the fourth fan-out line FOL4.

When the first fan-out line FOL1 and the third fan-out line FOL3 are shorted, the sub-pixel SP connected to the third fan-out line FOL3 displays black or dark lines. Therefore, it is possible to easily determine whether or not the first fan-out line FOL1 and the third fan-out line FOL3 are shorted. When the third fan-out line FOL3 is open, the sub-pixel SP connected to the third fan-out line FOL3 displays white. Therefore, it is possible to easily determine whether or not the third fan-out line FOL3 is open.

When the second fan-out line FOL2 and the fourth fan-out line FOL4 are shorted, the sub-pixel SP connected to the second fan-out line FOL2 displays black or dark lines. Therefore, it is possible to easily determine whether or not the second fan-out line FOL2 and the fourth fan-out line FOL4 are shorted. When the fourth fan-out line FOL4 is open, the sub-pixel SP connected to the fourth fan-out line FOL4 displays white. Therefore, it is possible to easily determine whether or not the fourth fan-out line FOL4 is open.

Referring to FIG. 21, the lighting circuit unit 170 may be inactive during the crack inspection. For example, high-level lighting inspection control signals TEST_GATE_R/G/B and high-level lighting inspection signals DC_R/G/B may be applied to the lighting circuit unit 170. Because the contents of the crack inspection are the same as those in FIG. 13 except that the demultiplexer unit ('160' in FIG. 10) is omitted, a redundant description may be omitted.

Figure 22:
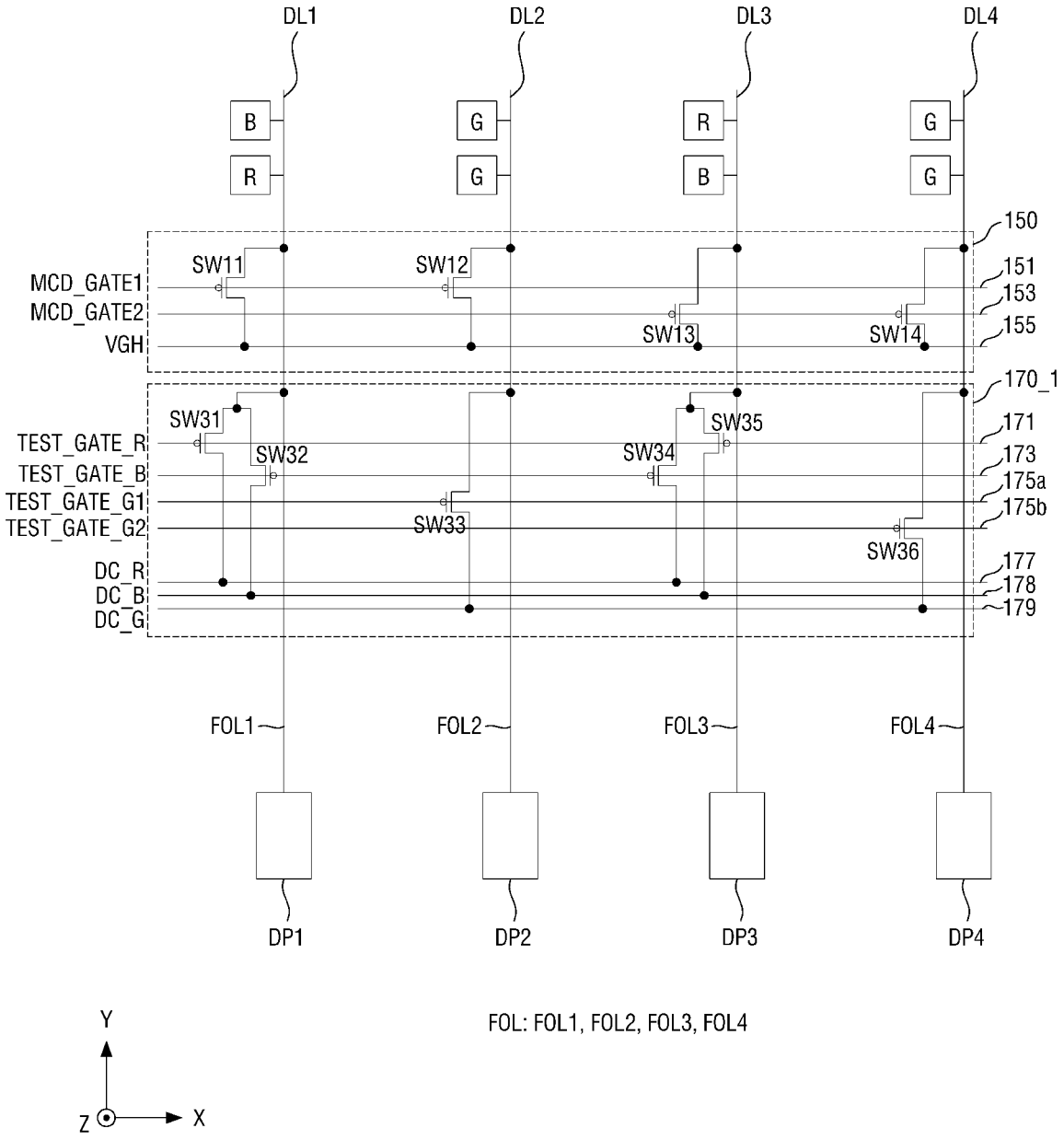
FIG. 22 is a diagram showing a circuit configuration of a display device according to an embodiment.
Figure 23:
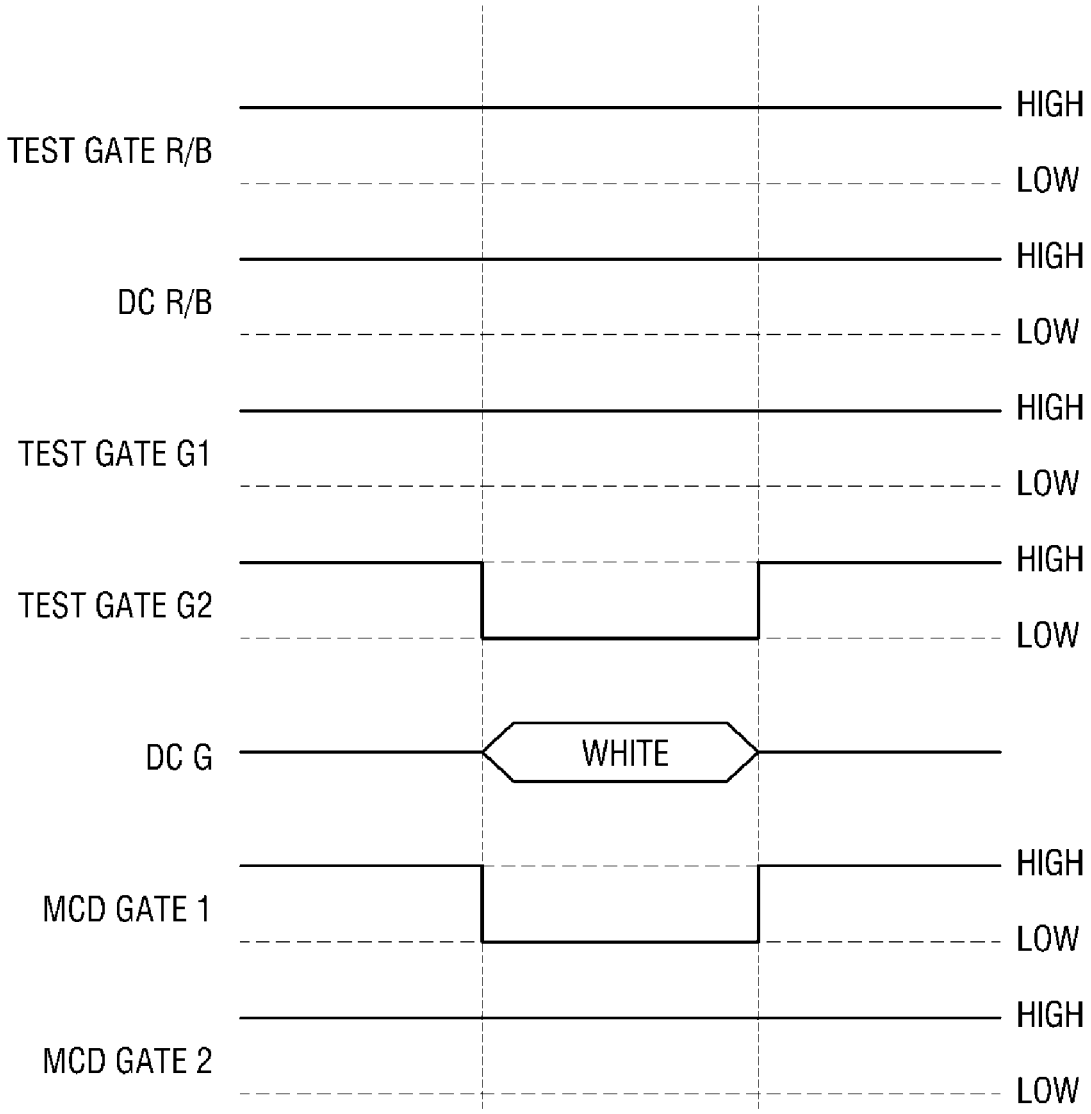
FIGS. 23-24 are timing charts for explaining a fan-out line inspection in a display device according to an embodiment.
Figure 24:
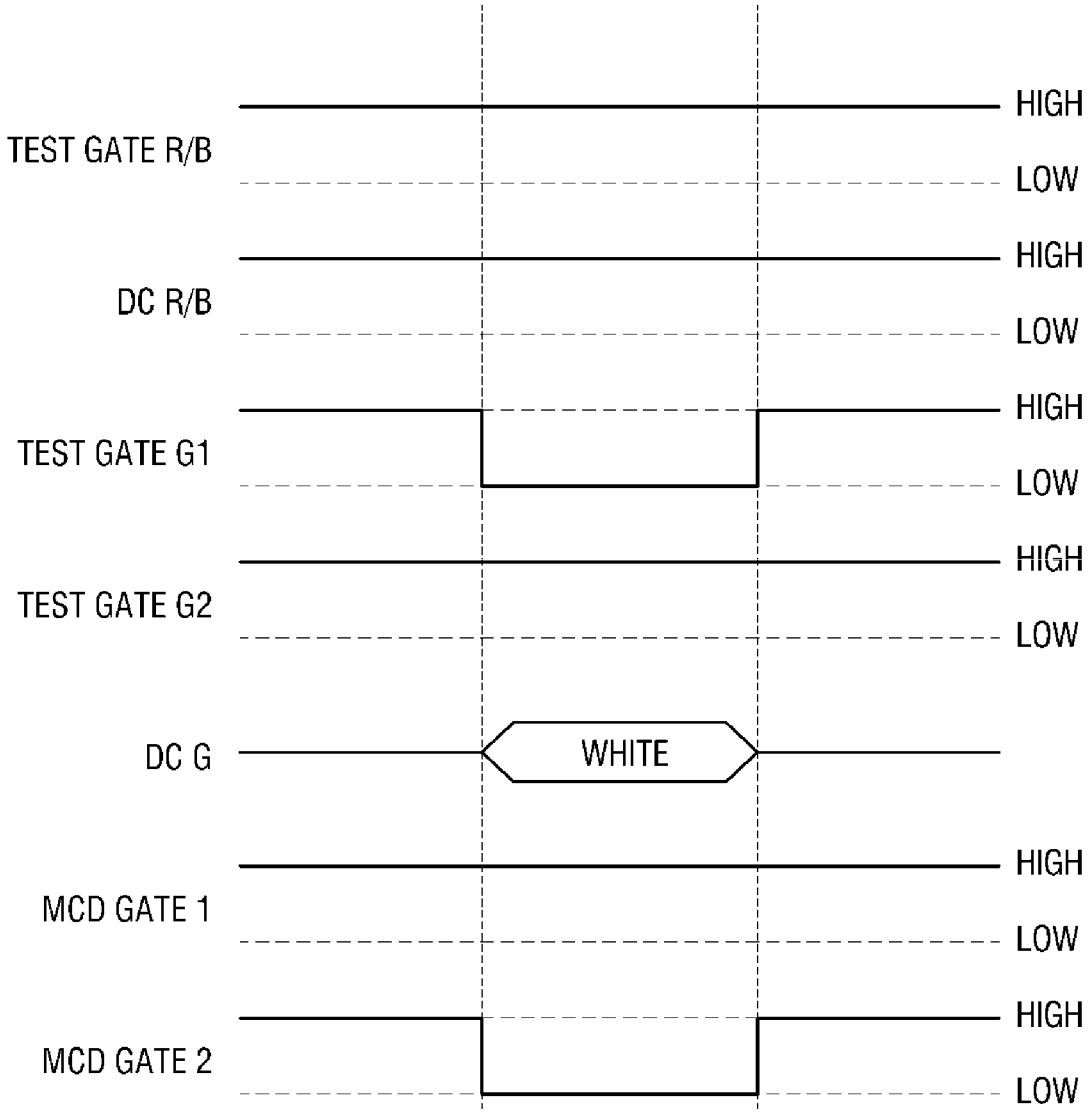
Figure 25:
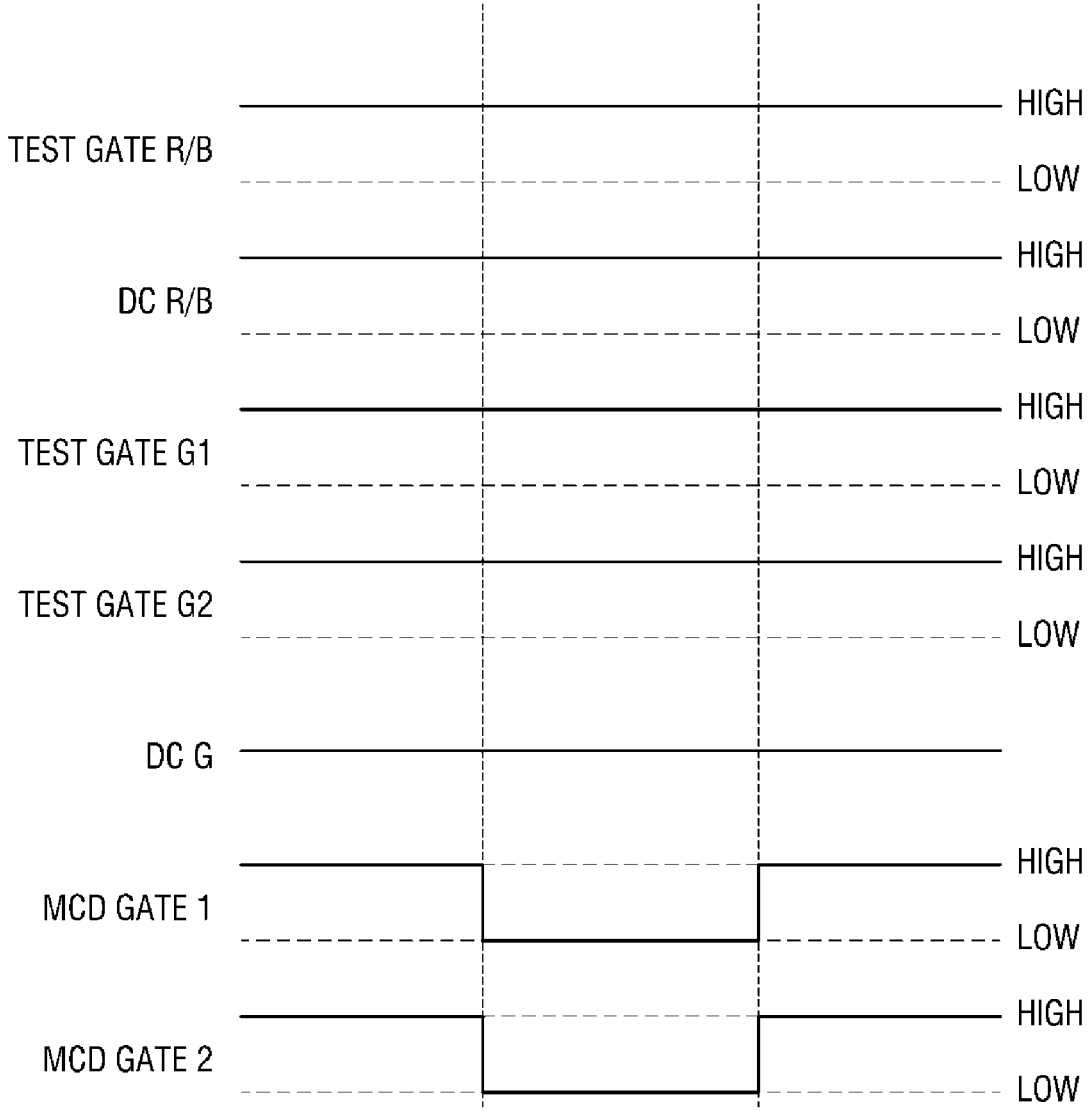
FIG. 25 is a timing chart for explaining a crack inspection in a display device according to an embodiment.

FIG. 22 is a diagram showing a circuit configuration of a display device according to an embodiment, FIGS. 23-24 are timing charts for explaining a fan-out line inspection in a display device according to an embodiment, and FIG. 25 is a timing chart for explaining a crack inspection in a display device according to an embodiment. The embodiment of FIGS. 22-25 is different from the embodiment of FIGS. 18-21 in that the seventh control line of a lighting circuit unit 170_1 includes a seventh-ath control line 175*a* and a seventh-bth control line 175*b*. A description redundant to that of the embodiment of FIGS. 18-21 may be omitted, and differences may be primarily described.

Referring to FIGS. 22-24, in some embodiment, a lighting circuit unit 170_1 may include a fifth control line 171, a sixth control line 173, a seventh-ath control line 175*a*, a seventh-bth control line 175*b*, a first lighting inspection signal line 177, a second lighting inspection signal line 178, a third lighting inspection signal line 179, and switches. The fifth control line 171, the sixth control line 173, the seventh-ath control line 175*a*, the seventh-bth control line 175*b*, the first lighting inspection signal line 177, the second lighting inspection signal line 178, and the third lighting inspection signal line 179 may extend in the first direction (X-axis direction), and may be spaced apart from each other in the second direction (Y-axis direction).

The switches of the lighting circuit unit 170_1 may include a thirteenth SW31 and a fourteenth SW32 which are connected to the first data line DL1, a fifteenth switch SW33 connected to the second data line DL2, a sixteenth switch SW34 and a seventeenth switch SW35 which are connected to the third data line DL3, and an eighteenth switch SW36 connected to the fourth data line DL4.

Because the connection structure of the thirteenth switch SW31, the fourteenth switch SW32, the sixteenth switch SW34, and the seventeenth switch SW35 is the same as that of the embodiment of FIG. 10, a redundant description may be omitted.

In the fifteenth switch SW33, a gate may be connected to the seventh-ath control line 175*a* for supplying a third-first lighting inspection control signal TEST_GATE_G1, a first terminal may be connected to the third lighting inspection signal line 179 for supplying a third lighting inspection signal DC_G, and a second terminal may be connected to the second data line DL2. The fifteenth switch SW33 may be turned on by the third-first lighting inspection control signal TEST_GATE_G1 to connect the third lighting inspection signal line 179 and the second data line DL2.

In the eighteenth switch SW36, a gate may be connected to the seventh-bth control line 175*b* for supplying a third-second lighting inspection control signal TEST_GATE_G2, a first terminal may be connected to the third lighting inspection signal line 179 for supplying a third lighting inspection signal DC_G, and a second terminal may be connected to the fourth data line DL4. The eighteenth switch SW36 may be turned on by the third-second lighting inspection control signal TEST_GATE_G2 to connect the third lighting inspection signal line 179 and the fourth data line DL4.

As described above, the fifteenth switch SW33 may be turned on by the third-first lighting control signal TEST_GATE_G1, and the eighteenth switch SW36 may be turned on by the third-second lighting inspection control signal TEST_GATE_G2.

Explaining the inspection of the fan-out lines FOL with reference to FIG. 22 together with FIGS. 23-24, the detection of defects between adjacent fan-out lines (FOL1 and FOL3, FOL2 and FOL4, etc.) of the same layer may be performed by the inspection unit 150.

The lighting circuit unit 170_1 may be activated during the inspection of the fan-out lines FOL. For example, a low-level third-first lighting control signal TEST_GATE_G1 and a low-level third-second lighting inspection control signal TEST_GATE_G2 may be applied to the seventh-ath control line 175*a* and the seventh-bth control line 175*b*.

Referring to FIG. 23, during the inspection of the fan-out lines FOL, a low-level third-second lighting inspection control signal TEST_GATE_G2 may be applied to the gate of the eighteenth switch SW36, and thus the eighteenth switch SW36 is turned on. Accordingly, the fourth data line DL4 may be connected to the third lighting inspection signal line 179.

The third lighting inspection signal DC_G applied to the third lighting inspection signal line 179 may be a white data voltage. However, the present invention is not limited thereto, and the third lighting inspection signal DC_G may be a data voltage of different gradation that can be distinguished from a black data voltage.

During the inspection of the fan-out lines FOL, a low-level first inspection control signal MCD_GATE1 may be applied to the gates of the first and second switches SW11 and SW12 to turn on the first and second switches SW11 and SW12, and thus a black data voltage VGH may be applied to the first fan-out line FOL1 and the second fan-out line FOL2.

During the inspection of the fan-out lines FOL, a high-level second inspection control signal MCD_GATE2 may be applied to the gates of the third and fourth switches SW13 and SW14, and thus a black data voltage VGH may not be applied to the third fan-out line FOL3 and the fourth fan-out line FOL4.

Accordingly, white is displayed in the sub-pixel SP connected to the first data line DL1 connected to the first fan-out line FOL1 and the pixel SP connected to the second data line DL2 connected to the second fan-out line FOL2, and white is displayed in the sub-pixel SP connected to the third data line DL3 connected to the third fan-out line FOL3 and the pixel SP connected to the fourth data line DL4 connected to the third fan-out line FOL3.

Further, a white data voltage is applied to the fourth data line DL4 by the third lighting inspection signal DC_G applied to the third lighting inspection signal line 179. Accordingly, the luminance of the sub-pixels SP connected to the fourth data line DL4 may be adjusted during the defect inspection. When the second fan-out line FOL2 and the fourth fan-out line FOL4 adjacent to the same layer are shorted, dark lines generated in the sub-pixel SP connected to the fourth fan-out line FOL4 may be easily distinguished.

Referring to FIG. 24, the low-level third-first lighting inspection control signal TEST_GATE_G1 is applied to the gate of the fifteenth switch SW33, and thus the fifteenth switch SW33 is turned on. Accordingly, the second data line DL2 may be connected to the third lighting inspection signal line 179.

During the inspection of the fan-out lines FOL, the low-level second inspection control signal MCD_GATE2 is applied to the gates of the third and fourth switches SW13 and SW14 to turn on the third and fourth switches SW13 and SW14, and thus a black data voltage may be applied to the third fan-out line FOL3 and the fourth fan-out line FOL4.

During the inspection of the fan-out lines FOL, the high-level first inspection control signal MCD_GATE1 is applied to the gates of the first and second switches SW11 and SW12, and thus a black data voltage may be applied to the first fan-out line FOL1 and the second fan-out line FOL2.

Accordingly, white is displayed in the sub-pixel SP connected to the first data line DL1 connected to the first fan-out line FOL1 and the sub-pixel SP connected to the second data line DL2 connected to the second fan-out line FOL2, and black is displayed in the sub-pixel SP connected to the third data line DL3 connected to the third fan-out line FOL3 and the sub-pixel SP connected to the fourth data line DL4 connected to the fourth fan-out line FOL4.

Further, a white data voltage is applied to the second data line DL2 by the third lighting inspection signal DC_G applied to the third lighting inspection signal line 179. Accordingly, the luminance of the sub-pixel SP connected to the second data line DL2 may be adjusted during the defect inspection. Thus, when the second fan-out line FOL2 and the fourth fan-out line FOL4 adjacent to the same layer are shorted, dark lines generated in the sub-pixel SP connected to the second fan-out line FOL2 may be easily distinguished.

Referring to FIG. 25, the lighting circuit unit 170_1 may be inactive during the crack inspection. For example, a high-level third-first lighting inspection control signal TEST_GATE_G1 and a high-level third-second lighting inspection control signal TEST_GATE_G2 may be applied to the seventh-ath control line 175*a* and the seventh-bth control line 175*b*. Because the contents of the crack inspection are the same as those in FIG. 13, a redundant description may be omitted.

Figure 26:
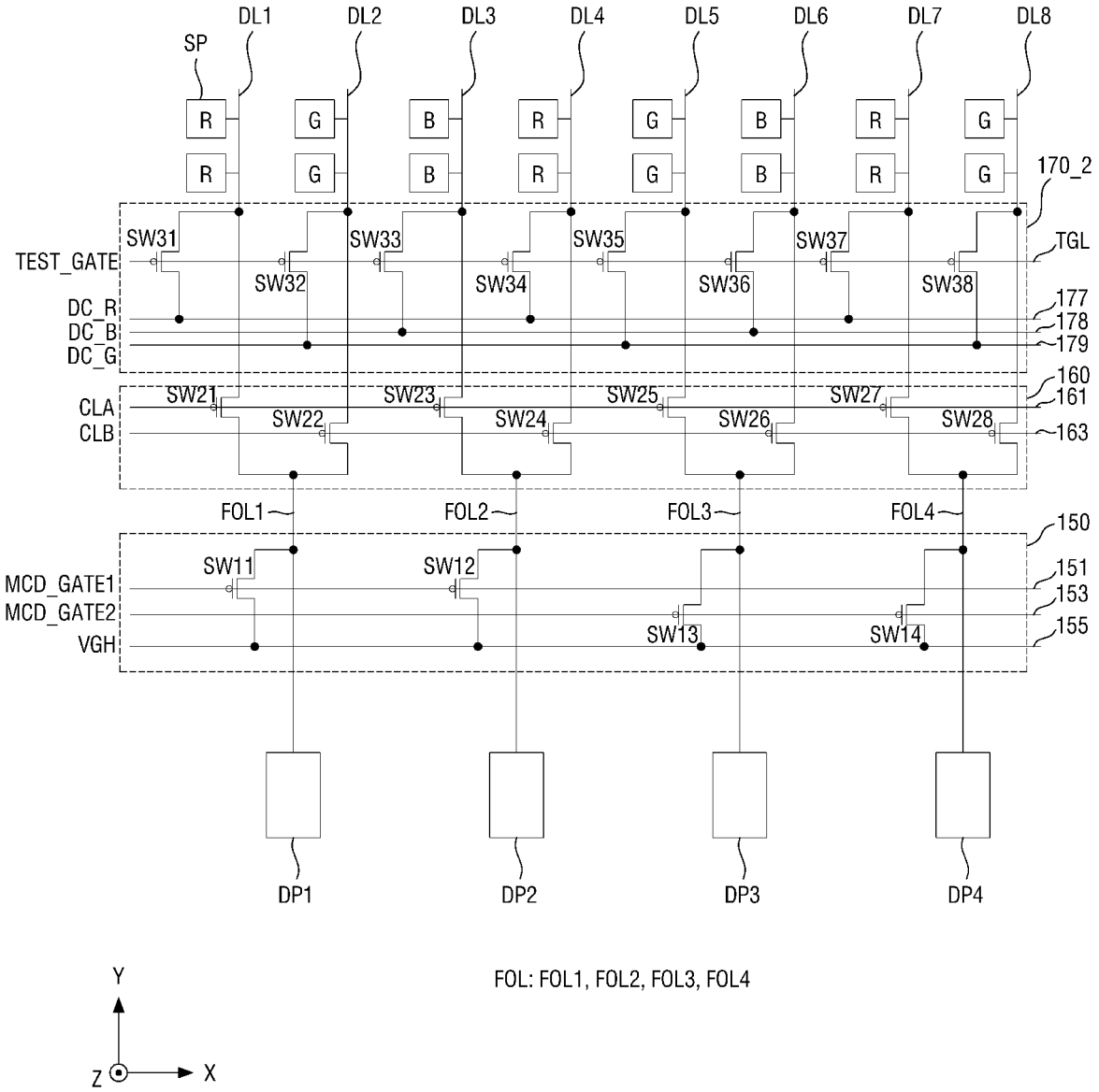
FIG. 26 is a diagram showing a circuit configuration of a display device according to an embodiment.
Figure 27:
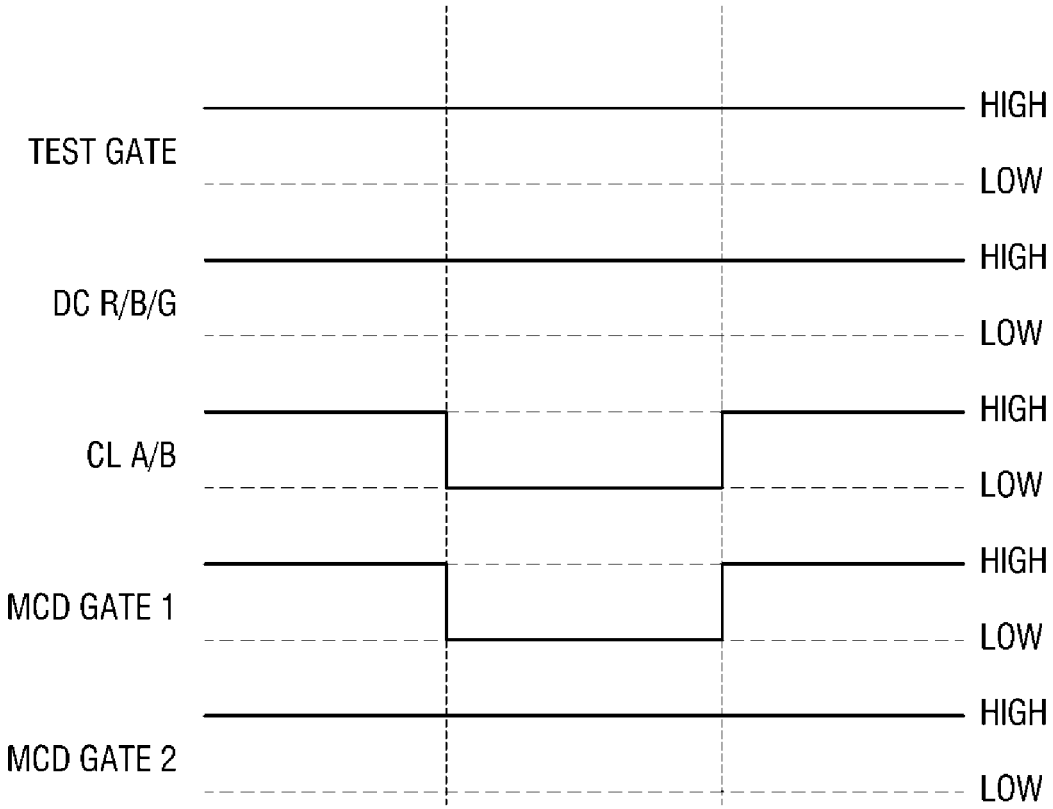
FIGS. 27-28 are timing charts for explaining a fan-out line inspection in a display device according to an embodiment.
Figure 28:
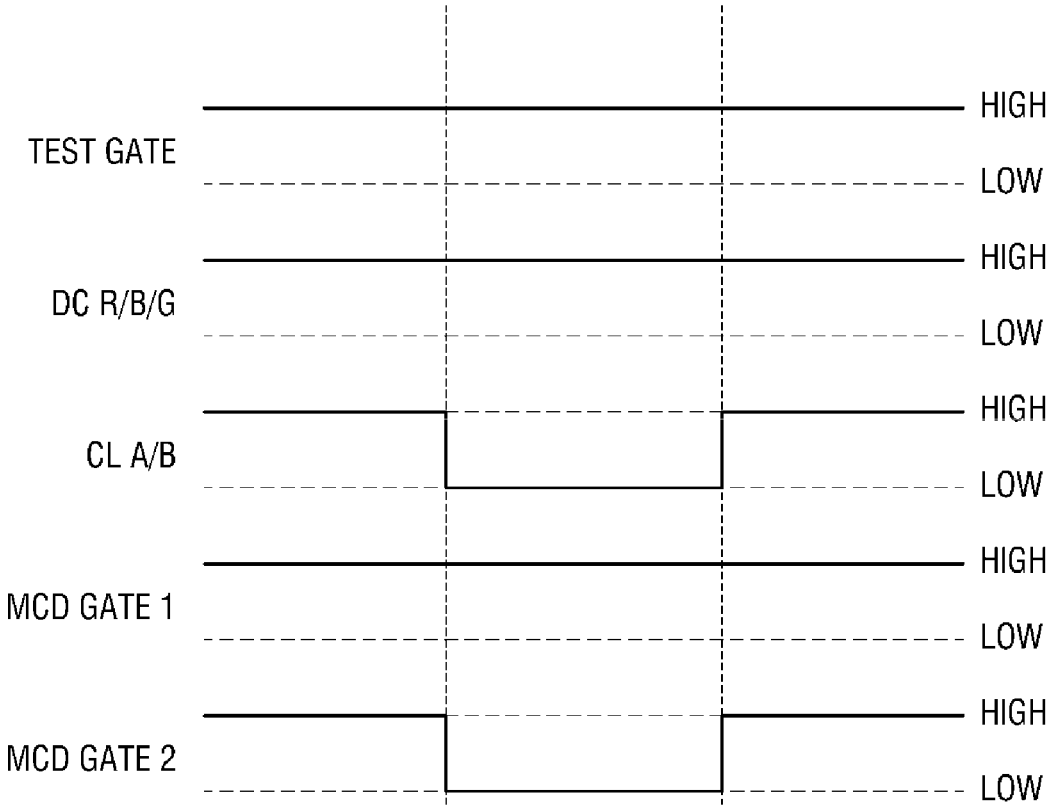
Figure 29:
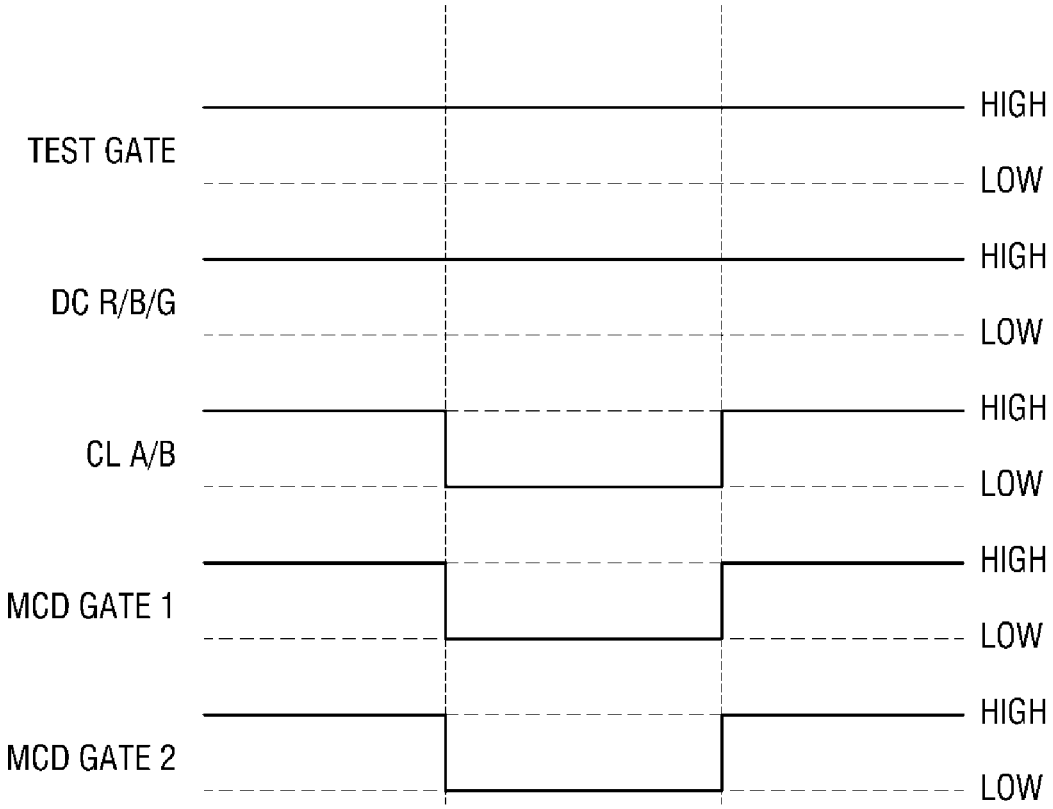
FIG. 29 is a timing chart for explaining a crack inspection in a display device according to an embodiment.

FIG. 26 is a diagram showing a circuit configuration of a display device according to an embodiment, FIGS. 27-28 are timing charts for explaining a fan-out line inspection in a display device according to an embodiment, and FIG. 29 is a timing chart for explaining a crack inspection in a display device according to an embodiment. The embodiment of FIGS. 26-29 is different from the embodiment of FIGS. 10-13 in that sub-pixels are arranged in a stripe form, and a lighting circuit unit 170_2 includes a lighting inspection control line TGL. A description redundant to that of the embodiment of FIGS. 10-13 may be omitted, and differences may be primarily described.

Referring to FIG. 26, in some embodiments, the sub-pixels SP may include red sub-pixels R for emitting red light, blue sub-pixels B for emitting blue light, and green sub-pixels G for emitting green light. The red sub-pixels R, the blue sub-pixels B, and the green sub-pixels G may be arranged in a stripe form in which the sub-pixels are serially arranged in different columns. Illustratively, the red sub-pixels R may be arranged in the first column, the green sub-pixels G may be arranged in the second column, and the blue sub-pixels B may be arranged in the third column. The first to third columns may be repeated in the first direction (X-axis direction). The data lines DL are arranged in each of the columns.

In some embodiments, the first data line DL1 may be connected to the first column in which the red sub-pixels R are arranged, the second data line DL2 may be connected to the second column in which the green sub-pixels G are arranged, the third data line DL3 may be connected to the third column in which the blue sub-pixels B are arranged, the fourth data line DL4 may be connected to the fourth column in which the red sub-pixels R are arranged, the fifth data line DL5 may be connected to the fifth column in which the green sub-pixels G are arranged, the sixth data line DL6 may be connected to the third column in which the blue sub-pixels B are arranged, the seventh data line DL7 may be connected to the seventh column in which the red sub-pixels R are arranged, and the eighth data line DL8 may be connected to the eighth column in which the green sub-pixels G are arranged.

Although it is described in the embodiment of the present invention that the sub-pixels SP may include red sub-pixels R, blue sub-pixels B, and green sub-pixels G, the sub-pixels SP may further include sub-pixels of other colors in addition to the sub-pixels of red, green, and blue.

In some embodiments, a lighting circuit unit 170_2 may include a lighting inspection control line TGL, a first lighting inspection signal line 177, a second lighting inspection signal line 178, a third lighting inspection signal line 179, and switches. The lighting inspection control line TGL, the first lighting inspection signal line 177, the second lighting inspection signal line 178, and the third lighting inspection signal line 179 may extend in the first direction (X-axis direction), and may be spaced apart from each other in the second direction (Y-axis direction).

The switches of the lighting circuit unit 170_2 may include a thirteenth SW31 connected to the first data line DL1, a fourteenth switch SW32 connected to the second data line DL2, a fifteenth switch SW33 connected to the third data line DL3, a sixteenth switch SW34 connected to the fourth data line DL4, a seventeenth switch SW35 connected to the fifth data line DL5, an eighteenth switch SW36 connected to the sixth data line DL6, a nineteenth switch SW37 connected to the seventh data line DL7, and a twentieth switch SW28 connected to the eighth data line DL8.

Specifically, in the thirteenth switch SW31, a gate may be connected to the lighting inspection control line TGL for supplying a lighting inspection control signal TEST_GATE, a first terminal may be connected to the first lighting inspection signal line 177 for supplying a first lighting inspection signal DC_R, and a second terminal may be connected to the first data line DL1. The thirteenth switch SW31 is turned on by the lighting inspection control signal TEST_GATE to connect the first lighting inspection signal line 177 and the first data line DL1.

In the fourteenth switch SW32, a gate may be connected to the lighting inspection control line TGL for supplying a lighting inspection control signal TEST_GATE, a first terminal may be connected to the third lighting inspection signal line 179 for supplying a third lighting inspection signal DC_C, and a second terminal may be connected to the second data line DL2. The fourteenth switch SW32 is turned on by the lighting inspection control signal TEST_GATE to connect the third lighting inspection signal line 179 and the second data line DL2.

In the fifteenth switch SW33, a gate may be connected to the lighting inspection control line TGL for supplying a lighting inspection control signal TEST_GATE, a first terminal may be connected to the second lighting inspection signal line 178 for supplying a second lighting inspection signal DC_B, and a second terminal may be connected to the third data line DL3. The fifteenth switch SW33 is turned on by the lighting inspection control signal TEST_GATE to connect the second lighting inspection signal line 178 and the third data line DL3.

In the sixteenth switch SW34, a gate may be connected to the lighting inspection control line TGL for supplying a lighting inspection control signal TEST_GATE, a first terminal may be connected to the first lighting inspection signal line 177 for supplying a first lighting inspection signal DC_R, and a second terminal may be connected to the fourth data line DL4. The sixteenth switch SW34 is turned on by the lighting inspection control signal TEST_GATE to connect the first lighting inspection signal line 177 and the fourth data line DL4.

In the seventeenth switch SW35, a gate may be connected to the lighting inspection control line TGL for supplying a lighting inspection control signal TEST_GATE, a first terminal may be connected to the third lighting inspection signal line 179 for supplying a third lighting inspection signal DC_G, and a second terminal may be connected to the fifth data line DL5. The seventeenth switch SW35 is turned on by the lighting inspection control signal TEST_GATE to connect the third lighting inspection signal line 179 and the fifth data line DL5.

In the eighteenth switch SW36, a gate may be connected to the lighting inspection control line TGL for supplying a lighting inspection control signal TEST_GATE, a first terminal may be connected to the second lighting inspection signal line 178 for supplying a second lighting inspection signal DC_B, and a second terminal may be connected to the sixth data line DL6. The eighteenth switch SW36 is turned on by the lighting inspection control signal TEST_GATE to connect the second lighting inspection signal line 178 and the sixth data line DL6.

In the nineteenth switch SW37, a gate may be connected to the lighting inspection control line TGL for supplying a lighting inspection control signal TEST_GATE, a first terminal may be connected to the first lighting inspection signal line 177 for supplying a first lighting inspection signal DC_R, and a second terminal may be connected to the seventh data line DL7. The nineteenth switch SW37 is turned on by the lighting inspection control signal TEST_GATE to connect the first lighting inspection signal line 177 and the seventh data line DL7.

In the twentieth switch SW38, a gate may be connected to the lighting inspection control line TGL for supplying a lighting inspection control signal TEST_GATE, a first terminal may be connected to the third lighting inspection signal line 179 for supplying a third lighting inspection signal DC_G, and a second terminal may be connected to the eighth data line DL8. The twentieth switch SW38 is turned on by the lighting inspection control signal TEST_GATE to connect the third lighting inspection signal line 179 and the eighth data line DL8.

As described above, when the sub-pixels SP are arranged in a stripe form, there is an advantage that the configuration of the lighting inspection circuit unit 170_2 is simplified. Because the configuration of the demultiplexer unit 160 and the configuration of the inspection unit 150 are the same as those of FIG. 10, a redundant description may be omitted.

Referring to FIGS. 27-29, the lighting circuit unit 170_2 may be inactive during the inspection of the fan-out lines FOL and the inspection of crack. For example, high-level lighting inspection control signals TEST_GATE and lighting inspection signals DC_R/G/B may be applied to the lighting inspection circuit unit 170_2. Because the contents of the inspection of the fan-out lines FOL and the inspection of crack are the same as those of FIGS. 11-13, a redundant description may be omitted.

Figure 30:
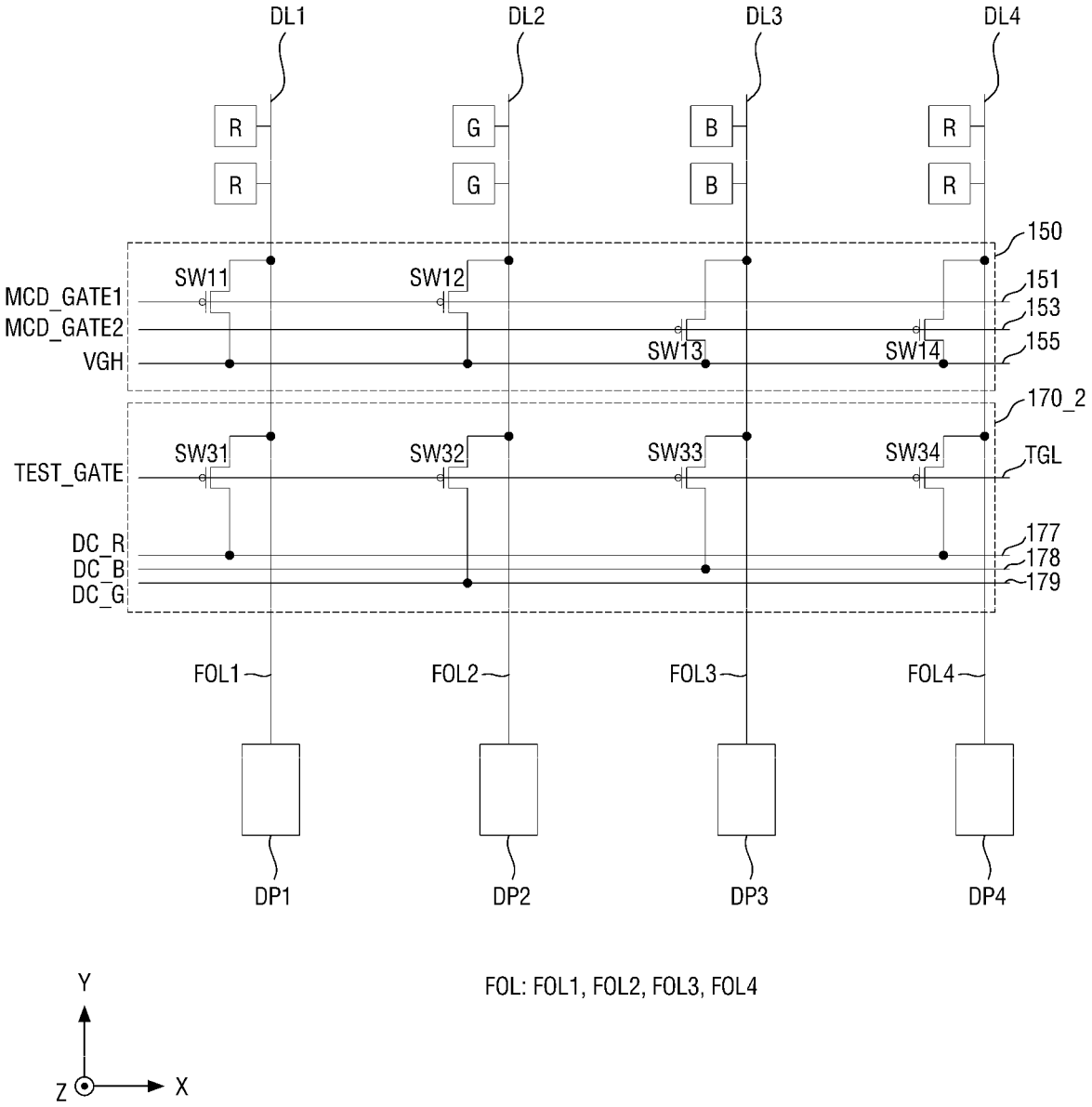
FIG. 30 is a diagram showing a circuit configuration of a display device according to an embodiment.
Figure 31:
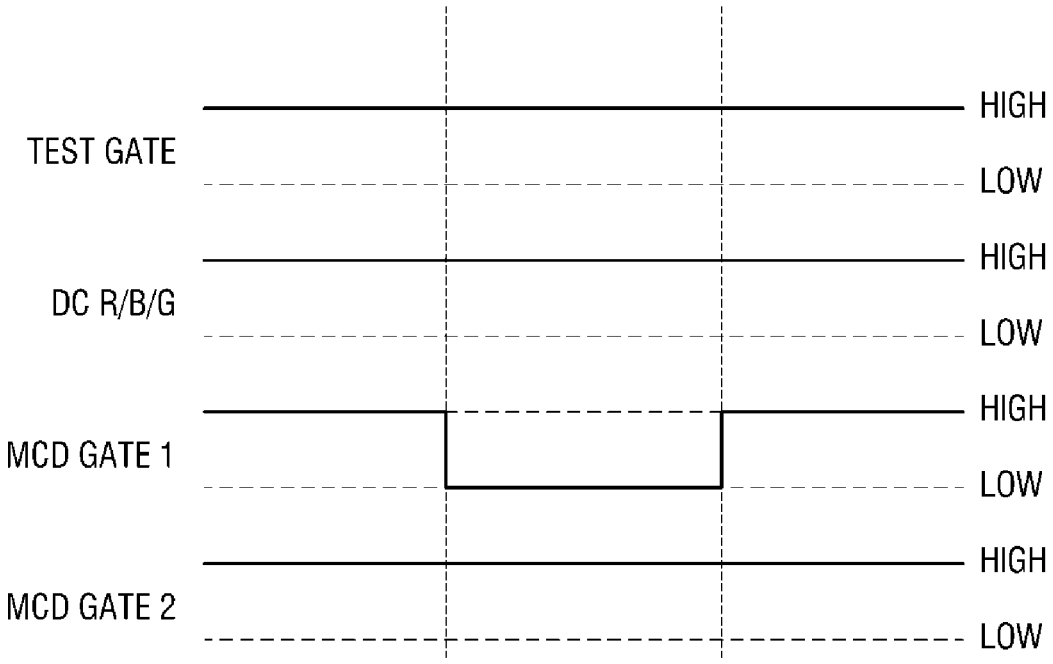
FIGS. 31-32 are timing charts for explaining a fan-out line inspection in a display device according to an embodiment.
Figure 32:
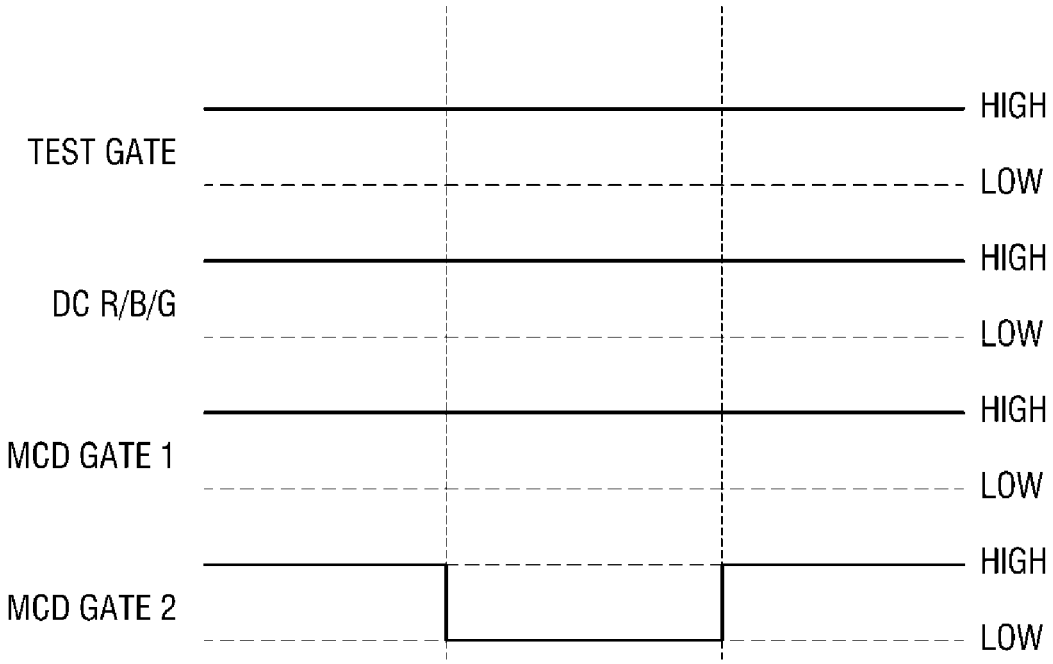
Figure 33:
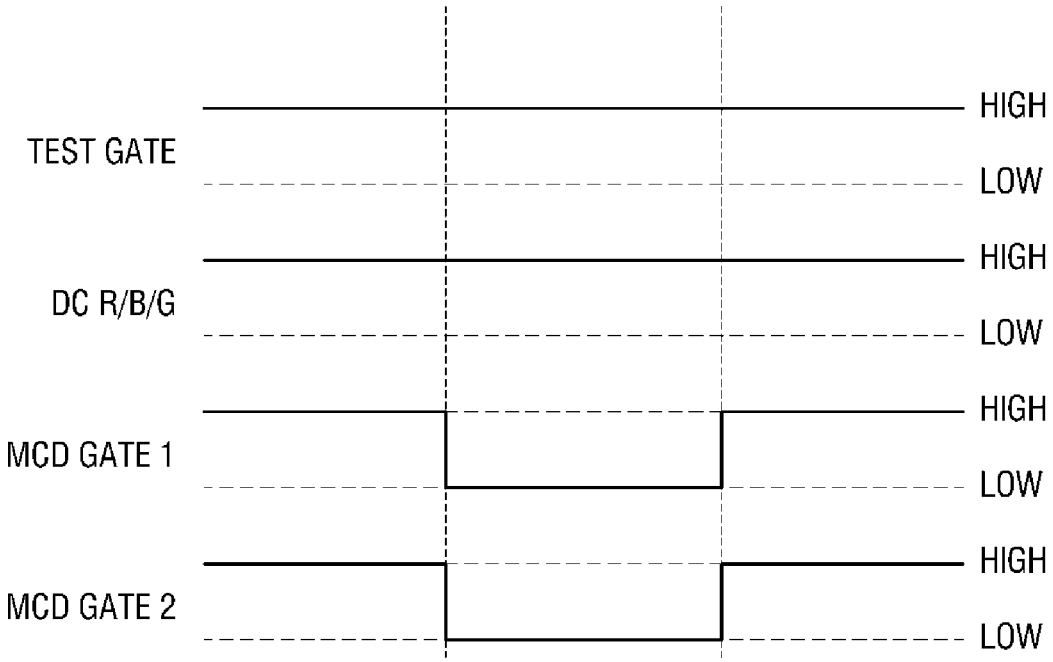
FIG. 33 is a timing chart for explaining a crack inspection in a display device according to an embodiment.

FIG. 30 is a diagram showing a circuit configuration of a display device according to an embodiment, FIGS. 31-32 are timing charts for explaining a fan-out line inspection in a display device according to an embodiment, and FIG. 33 is a timing chart for explaining a crack inspection in a display device according to an embodiment. The embodiment of FIGS. 30-33 is different from the embodiment of FIGS. 26-29 in that the demultiplexer unit ('160' in FIG. 10) is omitted. A description redundant to that of the embodiment of FIGS. 26-29 may be omitted, and differences may be primarily described.

Referring to FIG. 30, the inspection unit 150 and the lighting circuit unit 170_2 may be disposed between the sub-pixels SP and the wiring pads DP1, DP2, DP3, and DP4. Illustratively, the inspection unit 150 may be disposed adjacent to the sub-pixels SP, and the lighting circuit unit 170_2 may be disposed between the sub-pixels SP and the wiring pads DP1, DP2, DP3, and DP4.

Because the connection relationship between the inspection unit 150 and the lighting circuit unit 170_2 is the same as that in FIG. 26, a redundant description may be omitted.

In the embodiment of FIG. 30, the demultiplexer unit ('160' in FIG. 26) is omitted, and thus the fan-out lines FOL1, FOL2, FOL3, and FOL4 are connected one to one with the data lines DL1, DL2, DL3, and DL4. Illustratively, the first fan-out line FOL1 may connect the first wiring pad DP1 and the first data line DL1, the second fan-out line FOL2 may connect the second wiring pad DP2 and the second data line DL2, the third fan-out line FOL3 may connect the third wiring pad DP3 and the third data line DL3, and the fourth fan-out line FOL4 may connect the fourth wiring pad DP4 and the fourth data line DL4.

Referring to FIGS. 31-33, the lighting circuit unit 170_2 may be inactive during the inspection of the fan-out lines FOL and the inspection of crack. For example, high-level lighting inspection control signals TEST_GATE and lighting inspection signals DC_R/G/B may be applied to the lighting inspection circuit unit 170_2. Because the contents of the inspection of the fan-out lines FOL and the inspection of crack are the same as those of FIGS. 19-21, a redundant description may be omitted.

As described above, according to the present embodiment, it is possible to perform a defect inspection of the fan-out lines FOL and a crack inspection of the display panel 100 through one inspection unit 150. Thus, because it is not required to provide a circuit unit for the defect inspection of the fan-out lines FOL and a circuit unit for the crack inspection of the display panel 100, the dead space of the display device 10 can be effectively reduced.

According to a display device and a method of inspecting a display device according to embodiments, a crack inspection and a spider wiring inspection can be performed by one inspection unit. Therefore, a circuit unit for a spider wiring inspection can be omitted, and thus a dead space can be reduced.

The effects of the present invention are not limited by the foregoing, and other various effects are anticipated herein.

Although the example embodiments of the present invention have been disclosed for illustrative purposes, those skilled in the art will appreciate that various modifications, additions and substitutions are possible, without departing from the scope and spirit of the invention as disclosed in the accompanying claims, and equivalents thereof.

What is claimed is:

1. A display device comprising:

sub-pixels in a display area and arranged along first to eighth columns;

first to fourth wiring pads in a non-display area at a periphery of the display area and arranged at one side of the display area;

first to fourth fan-out lines connecting the sub-pixels arranged along the first to eighth columns to the first to fourth wiring pads; and an inspection unit between the first to fourth wiring pads and the display area, the inspection unit being electrically connected to the first to fourth fan-out lines, wherein the inspection unit is configured to apply a test voltage to the first to fourth fan-out lines to inspect whether the first to fourth fan-out lines are shorted or open, wherein the inspection unit comprises:

first to fourth switches;

a first control line configured to supply a first inspection control signal to a gate of each of the first switch and the second switch;

a second control line configured to supply a second inspection control signal to a gate of each of the third switch and the fourth switch; and a data voltage line configured to supply the test voltage to a first terminal of each of the first to fourth switches, wherein a second terminal of the first switch is connected to the first wiring pad and the first fan-out line, wherein a second terminal of the second switch is connected to the second wiring pad and the second fan-out line, wherein a second terminal of the third switch is connected to the third wiring pad and the third fan-out line, and wherein a second terminal of the fourth switch is connected to the fourth wiring pad and the fourth fan-out line.

2. The display device of claim 1, wherein the first fan-out line and the third fan-out line are at a same layer, the second fan-out line and the fourth fan-out line are at a same layer, and the first fan-out line and the second fan-out line are at different layers.

3. The display device of claim 1, further comprising:

a first data line connected to the sub-pixels arranged along the first column, a second data line connected to the sub-pixels arranged along the second column, a third data line connected to the sub-pixels arranged along the third column, a fourth data line connected to the sub-pixels arranged along the fourth column, a fifth data line connected to the sub-pixels arranged along the fifth column, a sixth data line connected to the sub-pixels arranged along the sixth column, a seventh data line connected to the sub-pixels arranged along the seventh column, and an eighth data line connected to the sub-pixels arranged along the eighth column; and a demultiplexer unit in the non-display area and located between the display area and the inspection unit, wherein the first data line and the second data line are connected to the first fan-out line through the demultiplexer unit, the third data line and the fourth data line are connected to the second fan-out line through the demultiplexer unit, the fifth data line and the sixth data line are connected to the third fan-out line through the demultiplexer unit, and the seventh data line and the eighth data line are connected to the fourth fan-out line through the demultiplexer unit.

4. The display device of claim 3, wherein the demultiplexer unit comprises fifth to twelfth switches, a third control line configured to supply a first demultiplexer control signal to a gate of each of the fifth, seventh, ninth and eleventh switches, and a fourth control line configured to supply a second demultiplexer control signal to a gate of each of the sixth, eighth, tenth and twelfth switches.

5. The display device of claim 4, wherein first terminals of the fifth switch and the sixth switch are connected to the first fan-out line, first terminals of the seventh switch and the eighth switch are connected to the second fan-out line, first terminals of the ninth switch and the tenth switch are connected to the third fan-out line, and first terminals of the eleventh switch and the twelfth switch are connected to the fourth fan-out line.

6. The display device of claim 5, wherein a second terminal of the fifth switch is connected to the first data line, a second terminal of the sixth switch is connected to the second data line, a second terminal of the seventh switch is connected to the third data line, a second terminal of the eighth switch is connected to the fourth data line, a second terminal of the ninth switch is connected to the fifth data line, a second terminal of the tenth switch is connected to the sixth data line, a second terminal of the eleventh switch is connected to the seventh data line, and a second terminal of the twelfth switch is connected to the eighth data line.

7. The display device of claim 6, further comprising:

a lighting circuit unit between the display area and the demultiplexer unit.

8. The display device of claim 7, wherein the lighting circuit unit further comprises a lighting inspection signal line configured to supply a white data voltage to the second data line, the fourth data line, the sixth data line, and the eighth data line.

9. The display device of claim 1, wherein the test voltage is a black data voltage.

10. The display device of claim 1, wherein the sub-pixels comprises:

red sub-pixels and blue sub-pixels alternately arranged in the first, third, fifth, and seventh columns; and green sub-pixels arranged in the second column between the first column and the third column, the fourth column between the third column and the fifth column, the sixth column between the fifth column and the seventh column, and the eighth column outside the seventh column, and wherein the red sub-pixels and the blue sub-pixels are alternately arranged in the third column and the seventh column in a reverse order to the first column and the fifth column.

11. The display device of claim 1, wherein the first to fourth switches are transistors, the gate is a gate electrode, the first terminal is a drain electrode, and the second terminal is a source electrode.

12. A display device comprising:

sub-pixels in a display area;

a display driving circuit in a non-display area at a periphery of the display area and located below the display area in a plan view;

crack detection lines in the non-display area;

fan-out lines connecting the sub-pixels and the display driving circuit; and an inspection unit between the display area and the display driving circuit, located adjacent to the display driving circuit, and electrically connected to the fan-out lines through the crack detection lines, wherein the inspection unit is configured to apply a test voltage to the fan-out lines to inspect whether the fan-out lines are shorted or open, and is configured to apply the test voltage to the crack detection lines to inspect damage to the crack detection lines.

13. The display device of claim 12, further comprising:

wiring pads electrically connected to the fan-out lines, wherein the display driving circuit comprises a driving integrated circuit electrically connected to the wiring pads.

14. The display device of claim 13, further comprising:

a display pad located outside the display driving circuit; and a circuit board attached to the display pad.

15. The display device of claim 14, further comprising:

a lighting circuit unit between the display area and the inspection unit and located adjacent to the display area.

16. The display device of claim 15, further comprising:

first to fourth data lines connected to the sub-pixels, wherein the fan-out lines comprise first to fourth fan-out lines, the first data line is connected to the first fan-out line, the second data line is connected to the second fan-out line, the third data line is connected to the third fan-out line, and the fourth data line is connected to the fourth fan-out line.

17. The display device of claim 16, wherein the sub-pixels are arranged in a stripe form in which the sub-pixels are arranged along a plurality of columns and the sub-pixels of the same color are arranged in the same column.

18. A method of inspecting a display device, the display device comprising sub-pixels in a display area, a display driving circuit in a non-display area at a periphery of the display area and located below the display area, crack detection lines in the non-display area, fan-out lines connecting the sub-pixels and the display driving circuit, and an inspection unit between the display area and the display driving circuit, located adjacent to the display driving circuit, and electrically connected to the fan-out lines through the crack detection lines, the method comprising:

applying a test voltage to the fan-out lines utilizing the inspection unit to inspect whether the fan-out lines are shorted or open; and applying the test voltage to the crack detection lines utilizing the inspection unit to inspect damage to the crack detection lines.

* * * * *